US006371352B1

(12) United States Patent
Mochizuki

(10) Patent No.: US 6,371,352 B1
(45) Date of Patent: Apr. 16, 2002

(54) STAPLE MAGAZINE AND STAPLER APPARATUS

(75) Inventor: Naoto Mochizuki, Yamanashi (JP)

(73) Assignee: Nisca Corporation, Minamikoma Gun (JP)

( * ) Notice: Subject to any disclaimer, the term of this patent is extended or adjusted under 35 U.S.C. 154(b) by 0 days.

(21) Appl. No.: 09/452,465

(22) Filed: Dec. 2, 1999

(51) Int. Cl.[7] ..... B25C 5/16

(52) U.S. Cl. ..... 227/155; 227/120; 227/131; 227/136

(58) Field of Search ..... 227/131, 155, 227/120, 136, 119

(56) References Cited

U.S. PATENT DOCUMENTS 5,474,222 A * 12/1995 Kanai et al. ..... 227/155
5,560,529 A * 10/1996 Udagawa et al. ..... 227/131
5,702,047 A * 12/1997 Yoshie ..... 227/120
5,823,415 A * 10/1998 Udagawa et al. ..... 227/136
6,039,230 A * 3/2000 Yagi et al. ..... 227/131
6,050,471 A * 4/2000 Yagi ..... 227/131

* cited by examiner

*Primary Examiner*—Scott A. Smith
(74) *Attorney, Agent, or Firm*—Armstrong, Westerman & Hattori, LLP

(57) ABSTRACT

A stapler magazine and a stapler apparatus which do not require an initial feeding action for advancing a staple to a stapling position immediately after the staple magazine is mounted in the stapler apparatus. The staple magazine has a case for accommodating a rolled staple assembly, and a roller that comes into contact with a portion of the roller staple assembly and feeds the leading edge of the staple assembly to a preselected position in the stapler apparatus. The stapler apparatus has a roller guide that comes into contact with the roller of the staple magazine when the staple magazine is mounted in the stapler apparatus. The roller is automatically driven by the roller guide in response to insertion of the staple magazine in the stapler apparatus. The stapler apparatus may have a feeding device for feeding the leading edge of the rolled staple assembly in response to the insertion of the staple magazine in the stapler apparatus.

4 Claims, 65 Drawing Sheets

152
153
P
S
230
232L
233A
233B
233L
233
232R
233C
233D
233R
231

Fig. 45(A)
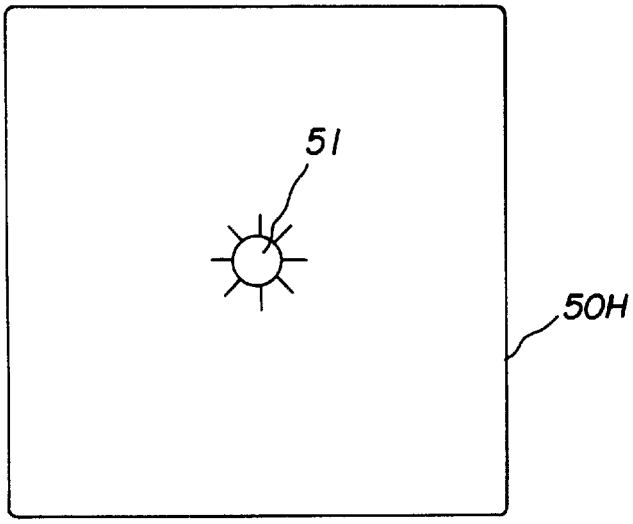
Fig. 45(B)
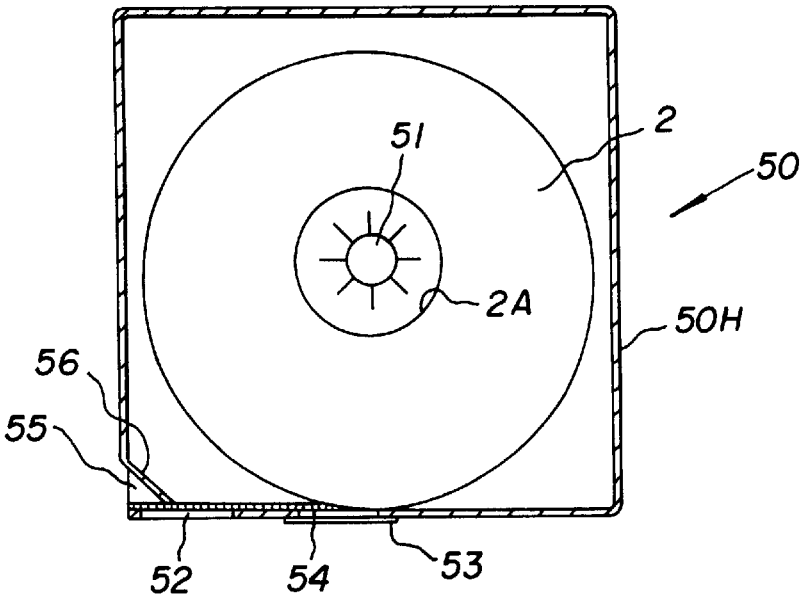
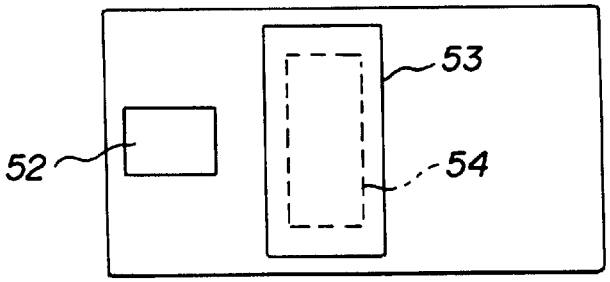
Fig. 45(C)

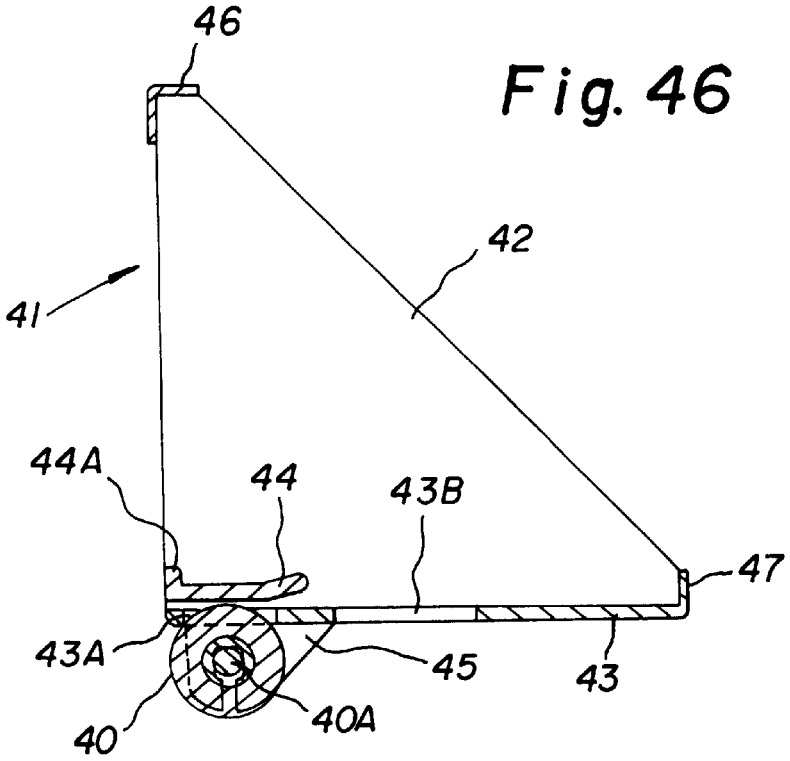
Fig. 46
Fig. 47
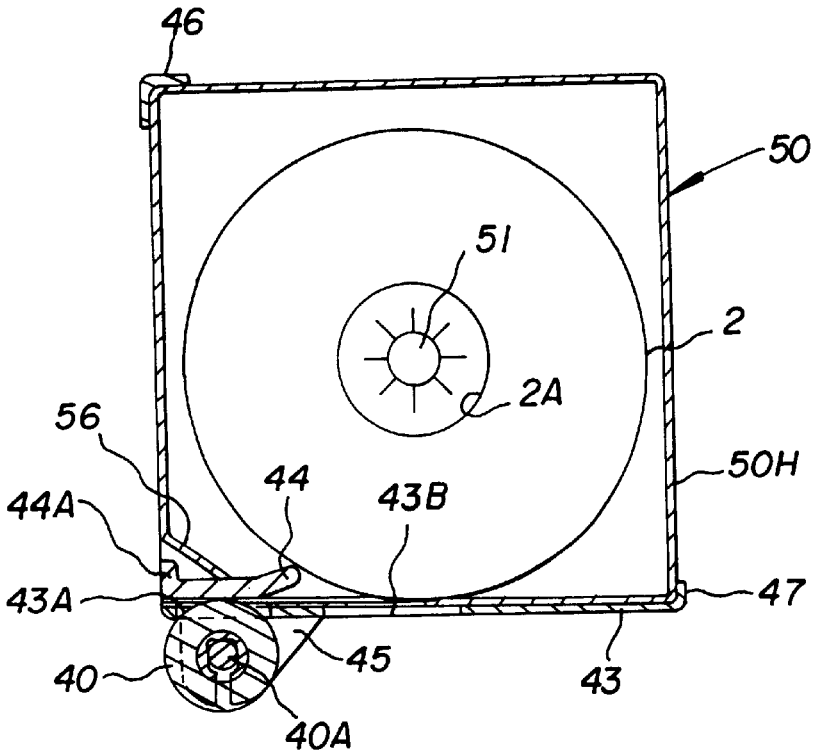

STAPLE MAGAZINE AND STAPLER APPARATUS

BACKGROUND OF THE INVENTION

1. Field of the Invention

This invention relates to a staple magazine and a stapler apparatus for stapling printed sheets supplied to a sorter or a finisher from an imaging apparatus, such as a copy machine or a printer.

2. Description of the Related Art

Japanese Patent Application Laid-open No. H10-80877 discloses a staple magazine (or a staple cartridge) and a stapler apparatus used in an imaging apparatus. The staple magazine has a feed roller, which is driven by the driving mechanism of the stapler apparatus. Sheet-like staple assemblies are stacked in the staple magazine. When the staple magazine is loaded in the stapler apparatus, the lowermost sheet of staples is pushed forward by the driving mechanism, and is transported to the shooting unit of the stapler apparatus by the feed roller, which is being driven in conjunction with the driving mechanism. The shooting unit shoots a staple, which pierces a sheaf of paper to staple them at the stapling position.

With this staple magazine and the stapler apparatus, the sheet-like staple assemblies accommodated in the staple magazine are placed apart from the stapling position when the staple magazine is initially loaded in the staple apparatus. Accordingly, an extra action for pushing the staple assembly to the stapling position must be taken.

SUMMARY OF THE INVENTION

Therefore, it is an object of the invention to provide a staple magazine and a stapler apparatus, which do not require an extra action to push a sheet of staples forward when the staple magazine is initially loaded in the stapler apparatus.

In order to achieve the object, a stapler magazine according to the invention accommodates a rolled staple assembly that consists of a number of staples bonded into a belt. The stapler magazine has a roller, which is in contact with a portion of the rolled staple assembly to feed the leading edge of the rolled staple assembly to a prescribed stapling position of a stapler apparatus.

When the staple magazine is inserted in a stapler apparatus, the roller is engaged with a guide provided in the stapler apparatus. Accordingly, the roller pushes the leading staple toward the stapling position in response to the insertion of the staple magazine.

Alternatively, a handle may be provided to the staple magazine so that the roller is manually driven in order to feed the leading staple of the rolled staple assembly.

In another aspect of the invention, a stapler apparatus comprises a detachable staple magazine, which accommodates a rolled staple assembly, and a roller, which comes into contact with a portion of the rolled staple assembly to feed the leading edge of the staple assembly to a prescribed stapling position.

In still another aspect of the invention, a stapler apparatus comprises a detachable staple magazine and a guide. The detachable staple magazine accommodates a rolled staple assembly, and it has a roller for feeding the leading staple of the rolled staple assembly. The guide is engaged with the roller when the staple magazine is inserted in the staple apparatus, and drives the roller.

BRIEF DESCRIPTION OF THE DRAWINGS

The above and other objects and advantages of the invention will become apparent from the following detailed description in conjunction with the accompanying drawings, in which:

FIGS. 17(A) and 17(B) illustrate the face plate used in the attachment, in which FIG. 17(B) is a cross-sectional view of the face plate taken along the line indicated by the arrows in FIG. 17(A);

FIGS. 18(A) and 18(B) illustrate the driver used in the attachment, in which FIG. 18(B) is a cross-sectional view of the driver taken along the line indicated by the arrows in FIG. 18(A);

FIGS. 19(A) and 19(B) illustrate the former plate used in the attachment, in which FIG. 19(B) is a cross-sectional view of the former plate taken along the line indicated by the arrows in FIG. 19(A);

FIGS. 20(A) and 20(B) illustrates the sheath used in the attachment, in which FIG. 20(B) is a cross-sectional view of the sheath taken along the line indicated by the arrows in FIG. 20(A);

FIGS. 33(A) and 33(B) illustrate the initial state of a stapling action, in which a straight staple is positioned at the initial position, wherein FIG. 33(B) shows the configuration taken from the direction indicated by the arrows shown in FIG. 33(A);

FIGS. 34(A) and 34(B) illustrate the staple which is bent into a reversed U-shape, wherein FIG. 34(B) shows the configuration taken from the direction indicated by the arrows shown in FIG. 34(A);

FIGS. 35(A) and 35(B) illustrate the staple which is being stuck into paper, wherein FIG. 35(B) shows the configuration from the direction indicated by the arrows shown in FIG. 35(A);

FIGS. 36(A) and 36(B) illustrate the staple that has been stuck into the paper, wherein FIG. 36(B) shows the configuration taken from the direction indicated by the arrows shown in FIG. 36(A);

FIGS. 37(A) through 37(D) illustrate how the staple is clinched, wherein FIG. 37(D) shows the configuration taken from the direction indicated by the arrows shown in FIG. 37(B);

FIGS. 38(A) through 38(D) illustrate the staple which has been clinched, wherein FIG. 37(D) shows the configuration taken from the direction indicated by the arrows shown in FIG. 38(B):

FIG. 45 illustrates the staple magazine according to the second embodiment of the invention, wherein FIG. 45(A) is a side view of the staple magazine, FIG. 45(B) is a cross-sectional view of the staple magazine, and FIG. 45(C) is a bottom view of the staple magazine;

FIG. 46 illustrates the roller unit according to the second embodiment of the invention;

FIG. 47 illustrates how the staple magazine is attached to the roller unit according to the second embodiment of the invention;

FIG. 50 illustrates the attachment according to the fourth embodiment of the invention, wherein

FIG. 53 illustrates the attachment according to the fifth embodiment of the invention, wherein

FIG. 54 illustrates the structure of the staple magazine according to the sixth embodiment of the invention; wherein

FIG. 56 illustrates the structure of the staple magazine according to the seventh embodiment of the invention, wherein

FIG. 65 illustrates the structure of the staple magazine according to the eighth embodiment of the invention, wherein

FIG. 68 illustrates the structure of the staple magazine according to the tenth embodiment of the invention, wherein FIG. 69 illustrates the structure of the staple magazine according to the eleventh embodiment of the invention, wherein

DETAILED DESCRIPTION OF THE INVENTION

<Structure >

(1) Overall Structure

Figure 1:
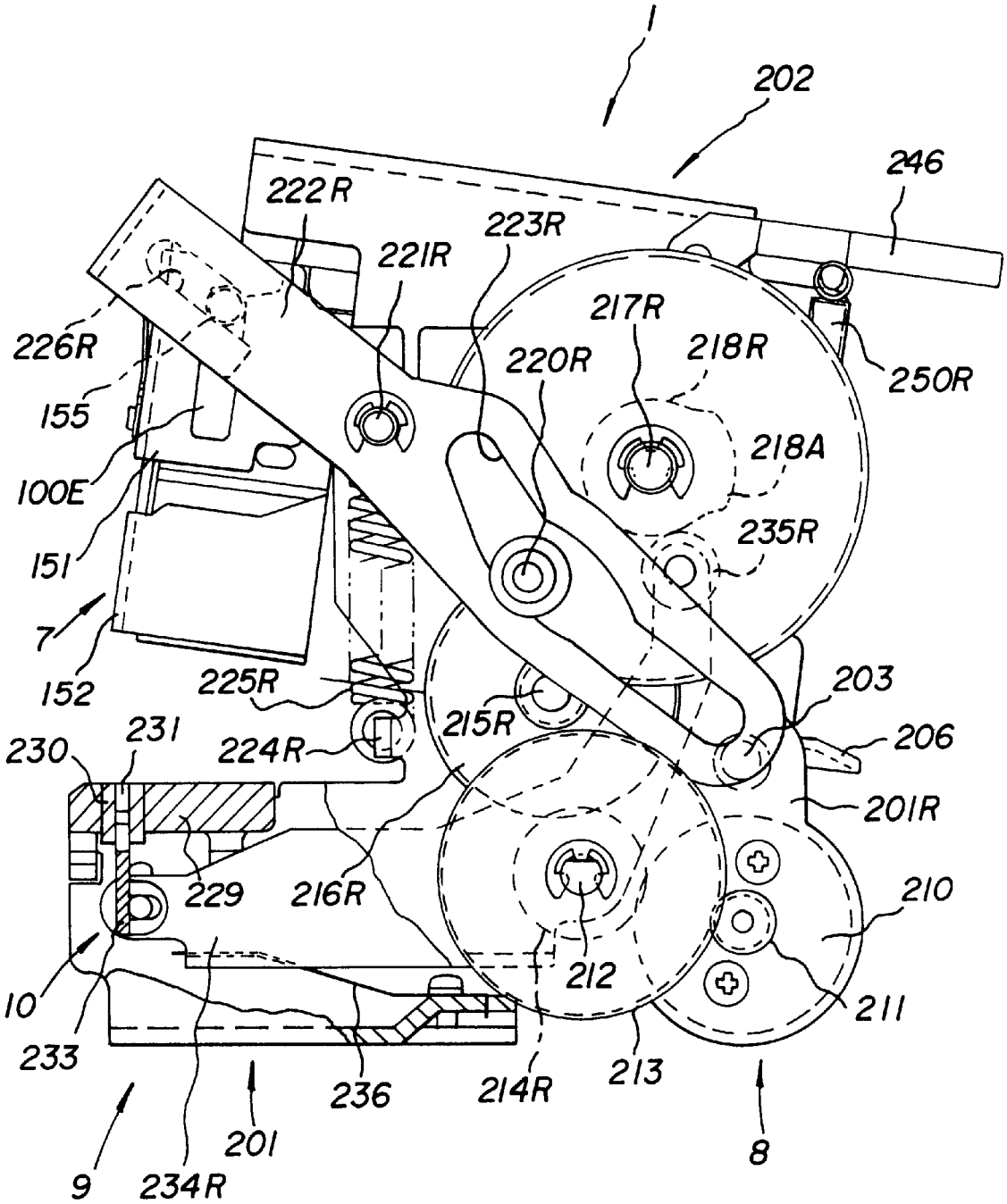
FIG. 1 is a right-side view of the stapler according to the first embodiment of the invention.
Figure 2:
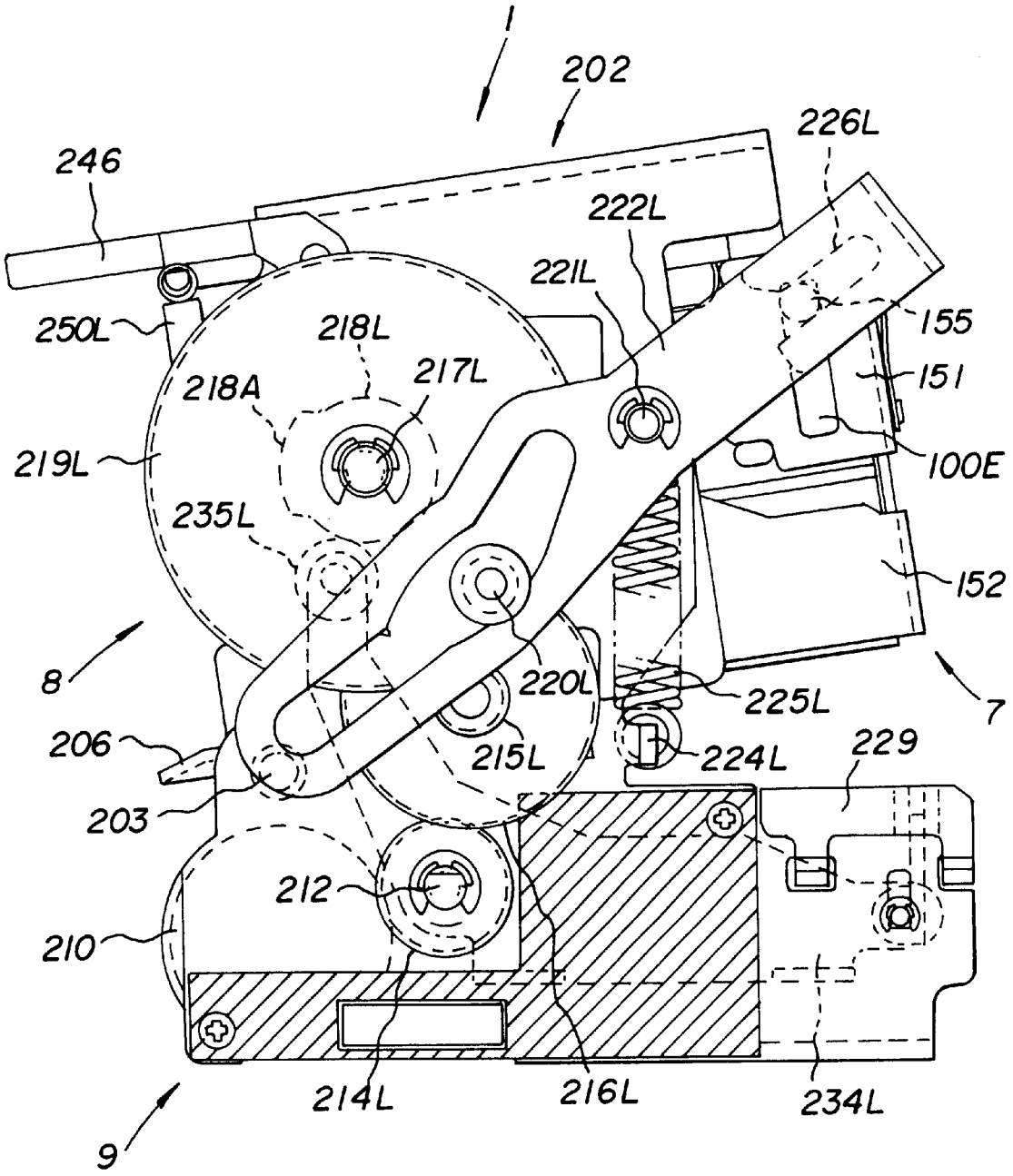
FIG. 2 is a left-side view of the stapler according to the first embodiment of the invention.
Figure 3:
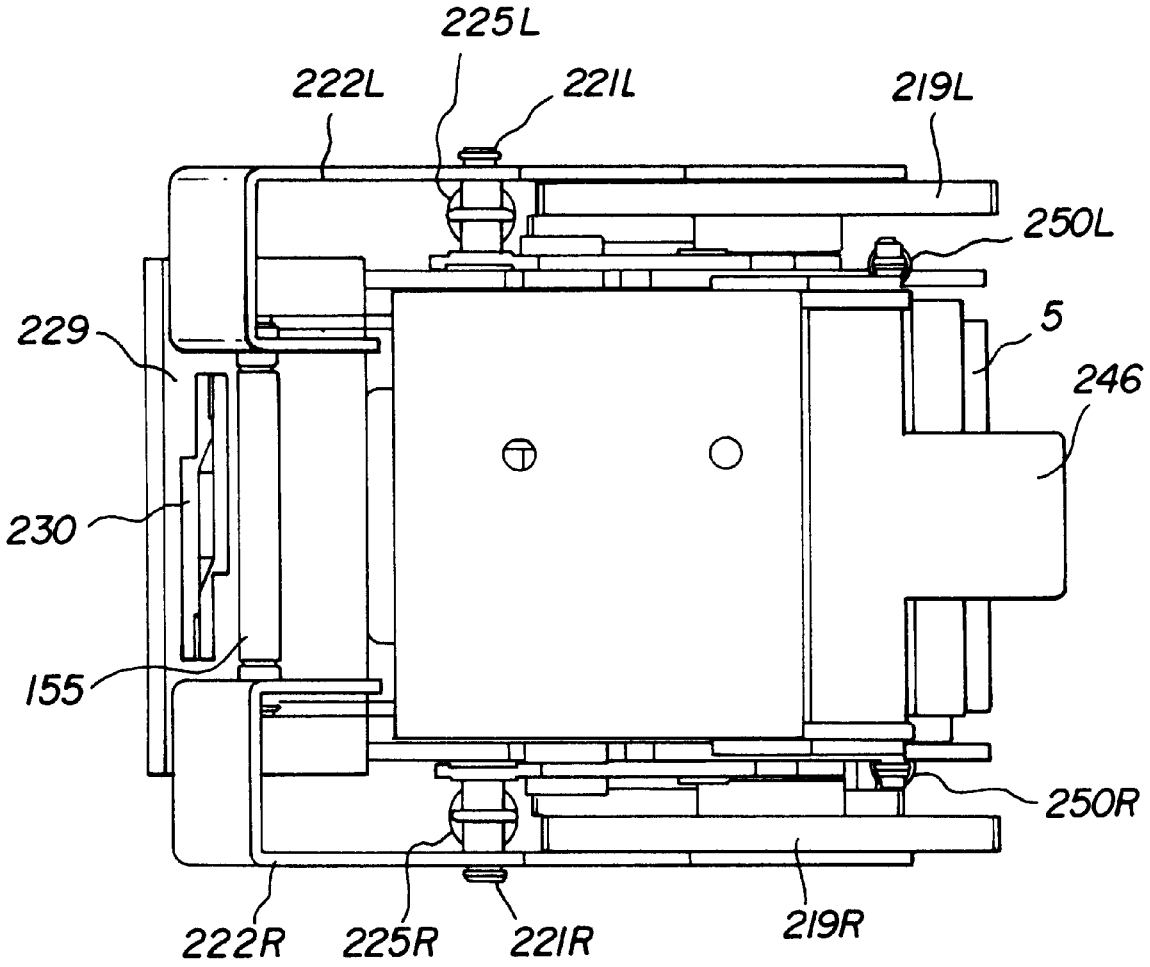
FIG. 3 is a plan view of the stapler according to the first embodiment of the invention.
Figure 4:
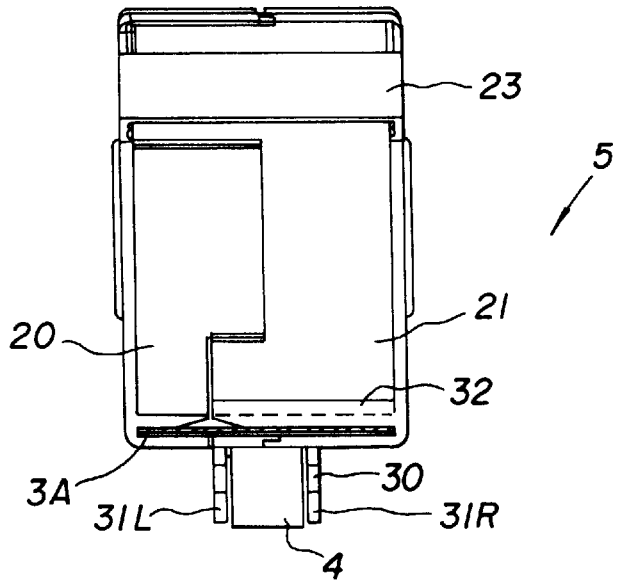
FIG. 4 is a front view of the staple magazine used in the stapler according to the first embodiment.
Figure 21:
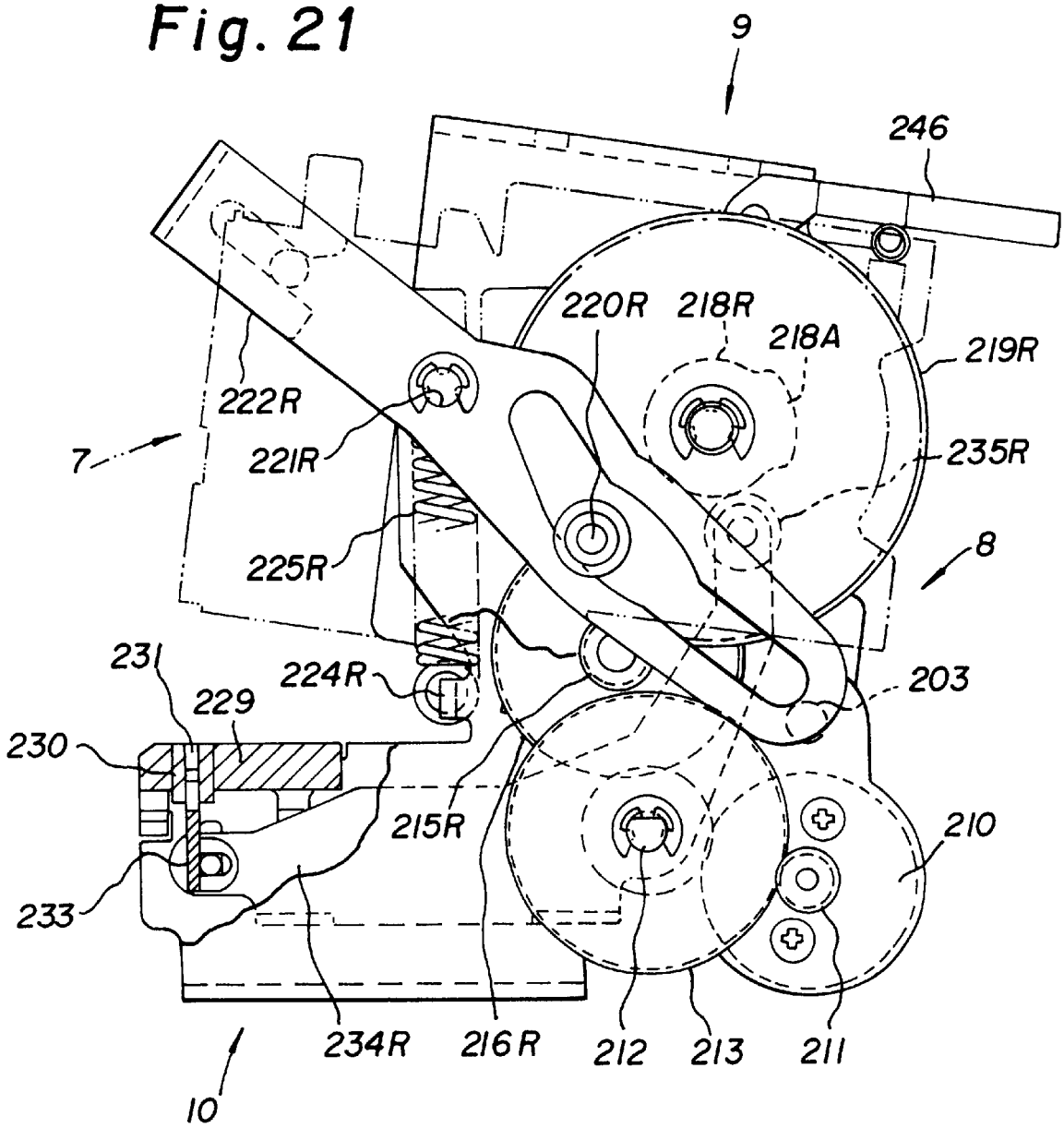
FIG. 21 is a right-side view of the stapler body.

FIGS. 1 through 3 illustrate a stapler apparatus 1. The stapler apparatus 1 comprises a staple magazine 5 shown in FIGS. 4 through 7, an attachment 5 for receiving the staple magazine 5, as shown in FIG. 8, and a stapler body 9 shown in FIG. 21. The staple magazine 5 has a casing 3 for accommodating a belt-like rolled staple assembly 2, and a feed roller 4 which is in contact with a portion of the rolled staple assembly 2 in order to feed the tip of a staple to a preselected position. The attachment 7 has a shooting unit 6 for shooting a staple S, which has been separated from the rolled staple assembly 2 and fed by the feed roller. The staple magazine 5 is inserted in and removed from the attachment 7. The stapler body 9 has a driving means 8, as shown in FIG. 21. The attachment 7 is attached to and detached from the stapler body 9. When the attachment 7 is attached to the stapler body 9, the shooting unit 6 of the attachment 7 and the driving means 8 of the stapler body 9 cooperate to shoot the staple, which has automatically been fed to the stapling position by the feed roller 4 in response to the insertion of the attachment 7 into the stapler body 9.

(2) Staple Magazine 5

The staple magazine 5 shown in FIGS. 4 through 7 are made of, for example, a transparent resin. The casing 3 is opened to insert a new rolled staple assembly when the previous one has run out. The rolled staple assembly consists of a number of staples which are bonded by a strip of adhesive in the middle of the staple belt. The casing 3 is refilled with a new staple assembly and continuously used. The casing 3 comprises a first case 20 and a second case 21, which are coupled by a hinge 22 in a pivotable manner. The first case 20 and the second case 21 are locked by a lock 23.

Figure 7:
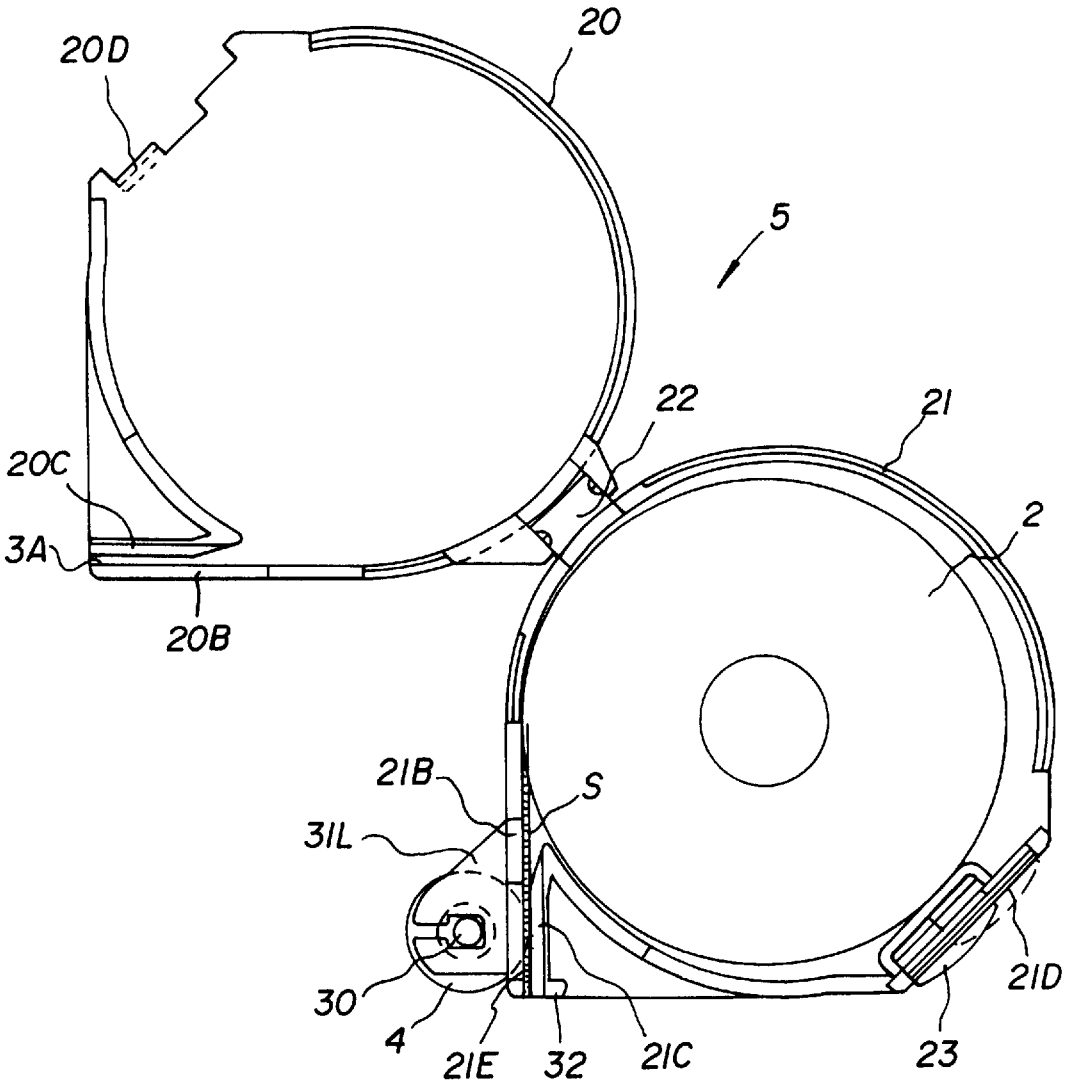
FIG. 7 illustrates an opened staple magazine, in which a rolled staple assembly is accommodated.
Figure 8:
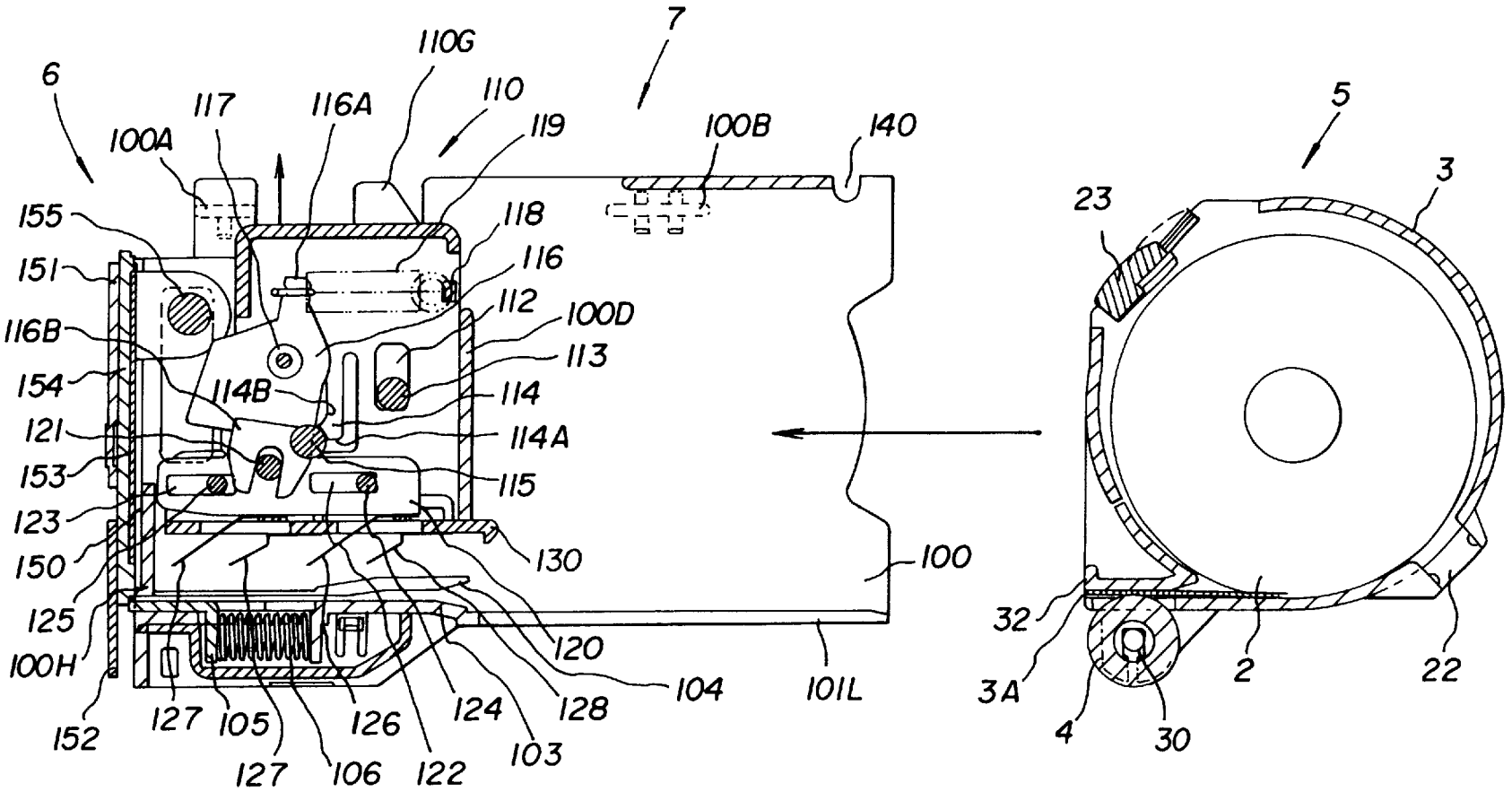
FIG. 8 illustrates the staple magazine which is being inserted in an attachment in a cross-sectional view.

The first case 20 has a recess 20A for casing the rolled staple assembly 2, staple guides 20B and 20C for guiding the leading edge of the rolled staple assembly 2, and a lock guide 20D, as shown in FIG. 7.

The second case 21 has a recess 21A for receiving the rolled staple assembly 2, staple guides 21B and 21C for guiding the leading edge of the rolled staple assembly 2, and a lock guide 21D. The staple guide 21B has an opening 21E, through which the bonded portion of the rolled staple assembly 2 comes into contact with a feed roller 4. The staple guides 20C and 21C function as control means for controlling the rear surface of the rolled staple assembly 2 that faces the opening 21E.

The second case 21 also has a pair of retainers 31L and 31R for retaining the rotation shaft 30 of the feed roller 4.

Figure 5:
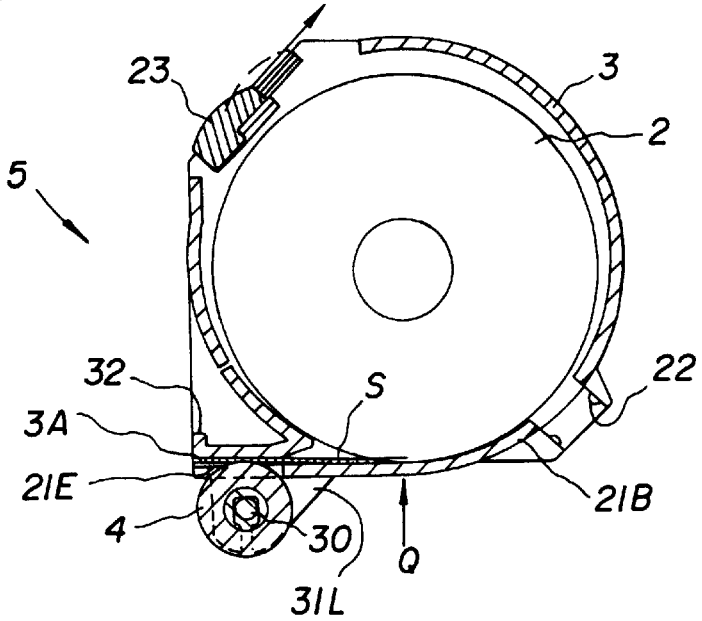
FIG. 5 is a cross-sectional view of the staple magazine shown in FIG. 4.
Figure 6:
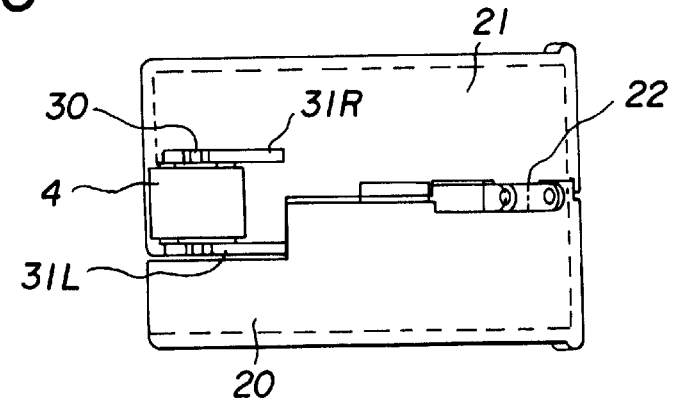
FIG. 6 is a bottom view of the staple magazine shown in FIG. 4.

As shown in FIG. 5, the feed roller 4 is positioned on the line extended from the leading edge of the rolled staple assembly 2. To be more precise, the feed roller 4 is positioned between the point Q, at which the rolled staple assembly 2 is in contact with the staple guide 21B, and the feeding port 3A, so that the rolled staple comes into contact with the feed roller 4.

A coupler 32 is provided to the edge of the staple guide 21C of the second case 21 in order to assure a connection with the attachment 7.

The lock 23 is engaged with the lock guide 21D in a detachable manner, and the first case 20 and the second case 21 are locked at the engaging position. When the lock 23 is disengaged from the lock guide 20D, the first and second cases 20 and 21 are unlocked, and opened via the hinge 22.

At least the cylindrical surface of the feed roller 4 is made of a rubber. When a load applied onto the rolled staple assembly 2, which has been guided to the feed roller 4 by the guides 20B and 21*b*, becomes greater than a predetermined value, the rolled staple assembly 2 slips on the rubber surface of the feed roller 4. Accordingly, even if the feed roller 4 continuously rotates, the leading staple of the staple assembly 2 is not fed any longer. A torque limiter may be provided to the feed roller 4.

As has been described, the middle portion of the rolled staple assembly 2, which is bonded by a strip of adhesive, comes into contact with the feed roller 4. However, the feed roller 4 may be arranged so that a portion other than the bonded portion of the rolled staple assembly 2 comes into contact with the feed roller 4.

The feed roller 4 is driven automatically in conjunction with an insertion of the attachment 7 that holds the staple magazine 5 into the stapler body 9 in the preferred embodiment. However, the feed roller 4 may be driven manually in order to supply the rolled staple assembly 2 to guides' 103A and 104 (FIG. 8). Any suitable feeding means may be used in place of the feed roller 4. For example, rotational units, such as a belt or paddles, may be used.

(3) Attachment 7

Figure 9:
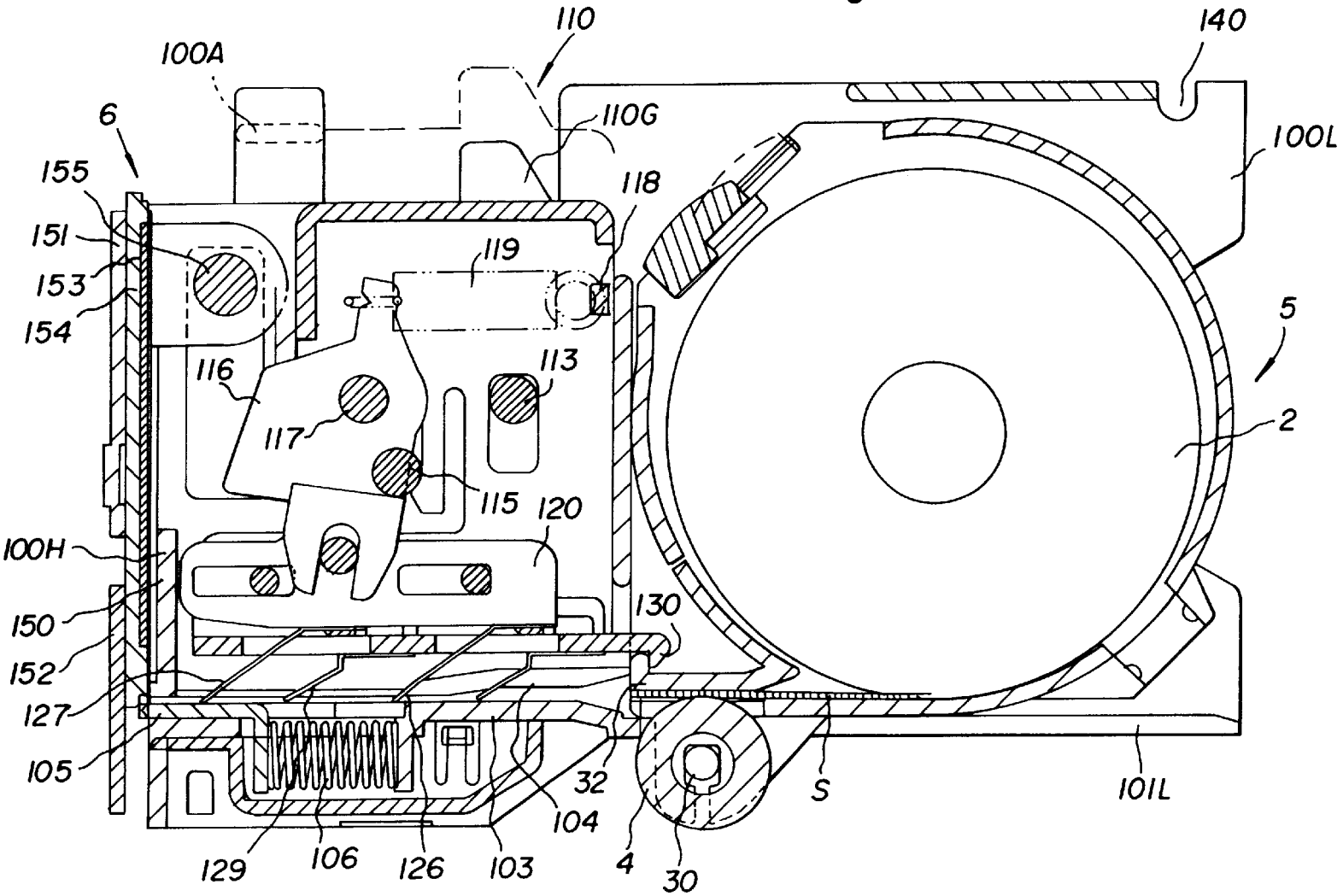
FIG. 9 is a cross-sectional view of the attachment, in which the staple magazine is inserted.
Figure 10:
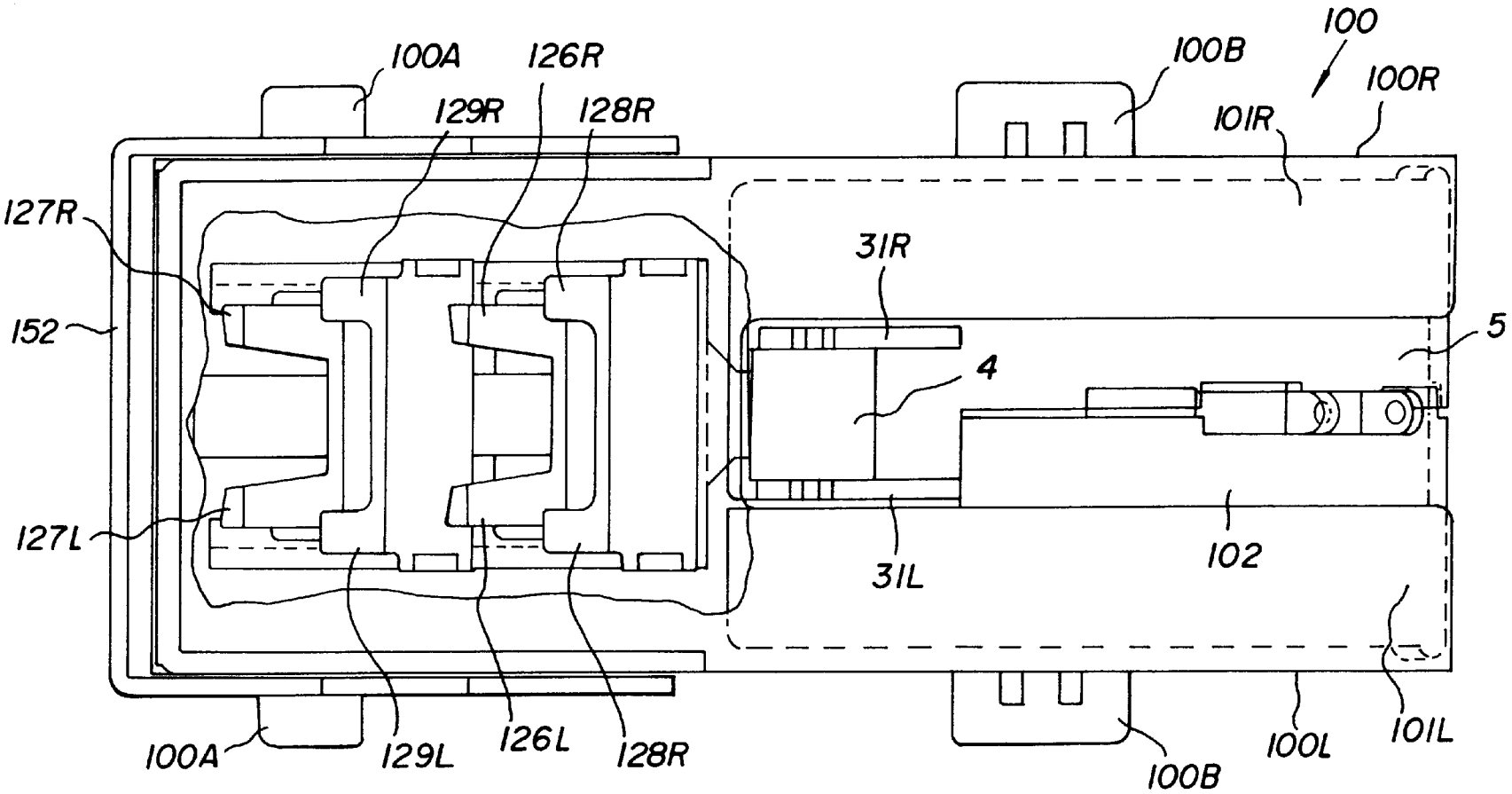
FIG. 10 is a bottom view of the attachment, in which the staple magazine is inserted.

FIGS. 8 through 12 show the attachment 7. The attachment 7 has a frame 100, on which a shooting unit 6, a staple feeder 110, and other elements are mounted, as shown in FIGS. 8 through 10.

Figure 11:
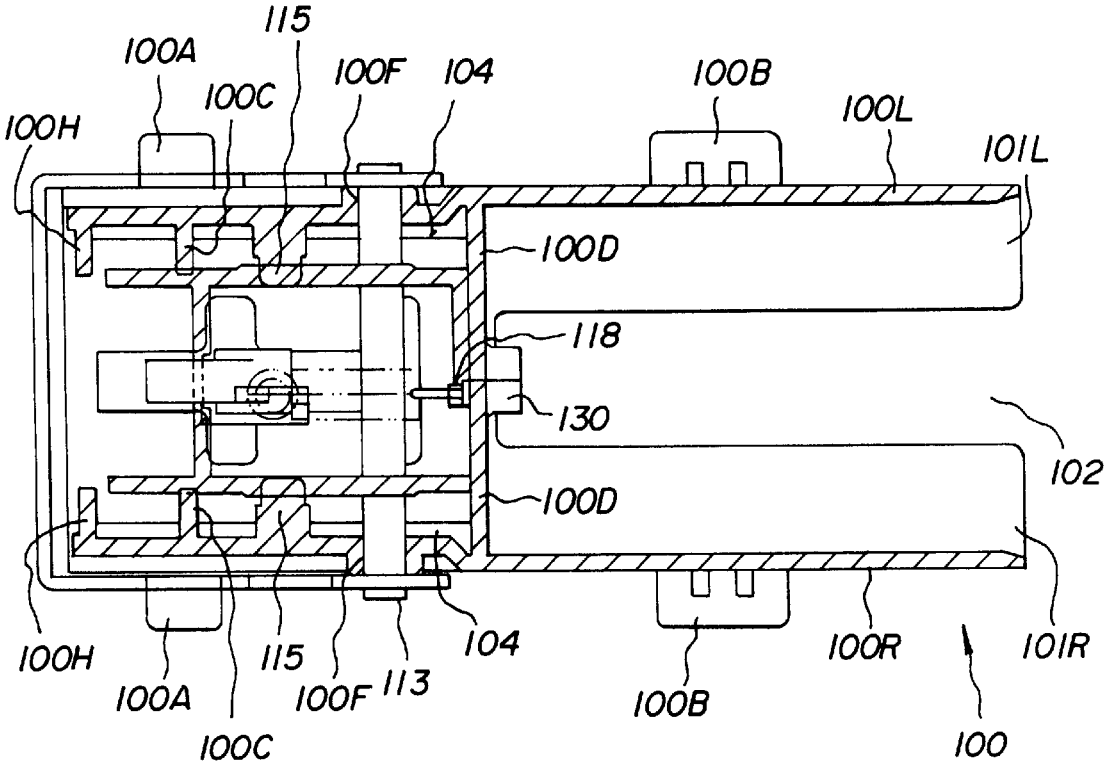
FIG. 11 is a cross-sectional view of the attachment showing the structure of the attachment.
Figure 12:
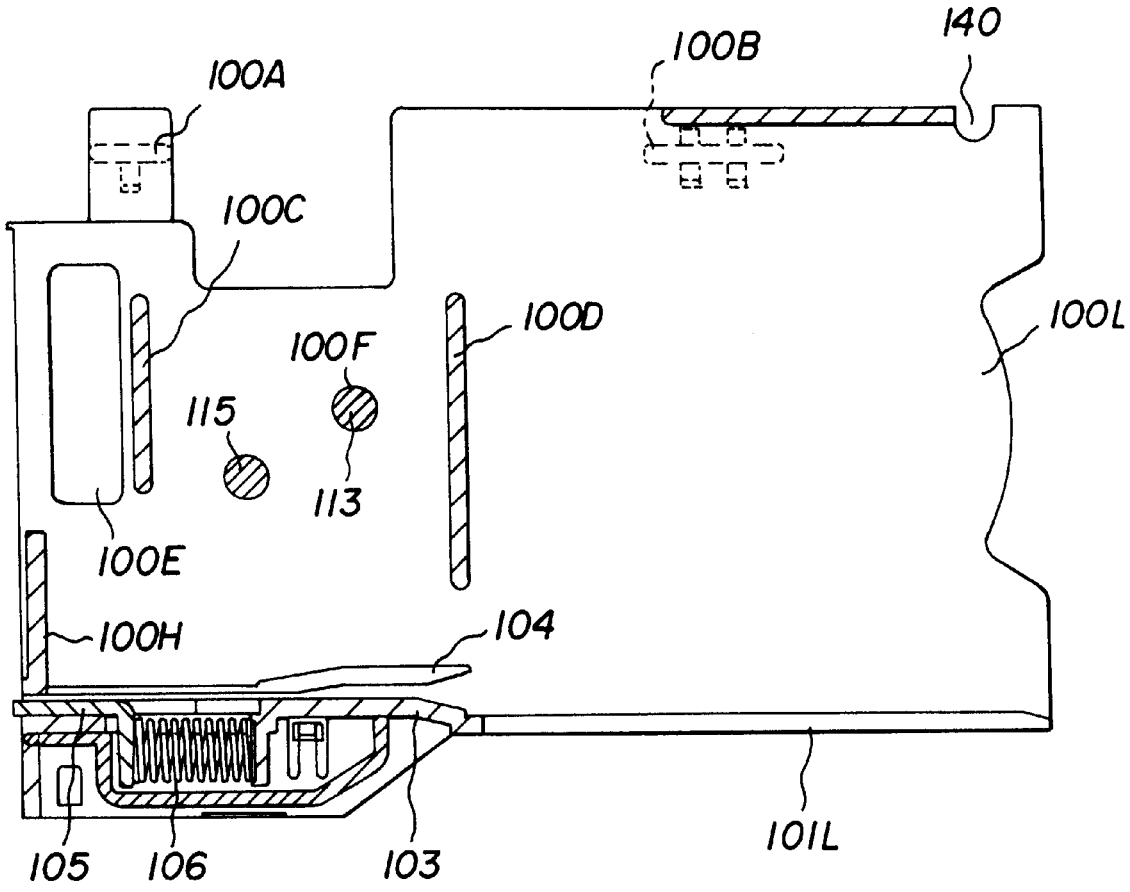
FIG. 12 is another cross-sectional view of the attachment showing the structure of the attachment.

As shown in FIGS. 11 and 12, guides 101L and 101R are provided on the bottom of the frame 100 in order to guide the staple magazine 5 which is inserted in the attachment 7. An opening 102 for receiving the feed roller 4, a guide 103 for guiding the rolled staple assembly 2 to the stapling position, a control guide 104, and a bending plate 105 are also provided for the frame 100.

Figure 13:
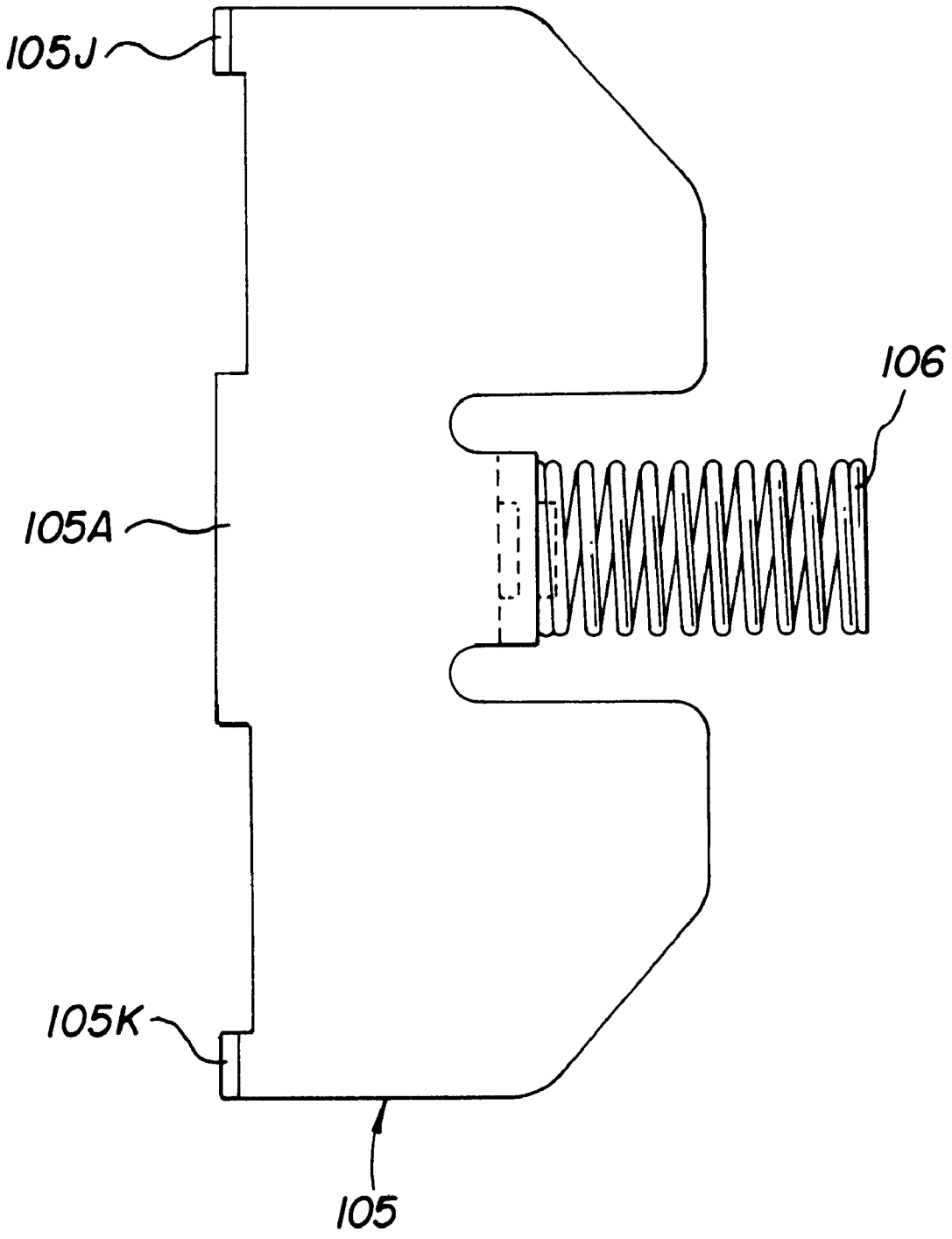
FIG. 13 is a plan view of the bending plate used in the attachment.

As shown in FIG. 13, the bending plate 105 has a center holder 105A for holding the staple assembly, and projections 105J and 105K arranged on both ends of the bending plate 105. The bending plate 105 is forced forward by a spring 106.

The frame 100 has side walls 100L and 100R. As shown in FIG. 11, each of the side walls 100L and 100R has flanges 100A and 100B for engaging the attachment 7 with the staple body 9. Guides 100C and 100D are also provided to each of the side walls 100L and 100R of the frame 100 in order to elevate and lower the staple feeder 110. An elongated hole 100E and a hole 100F are formed on each side wall, as shown in FIG. 12. The shaft 155 of the driver 153 moves upward and downward in the elongated hole 100E, as shown in FIG. 9. The hole 100F receives a shaft 113.

As shown in FIG. 12, an indent 140 is formed on the upper edge of each of the side walls 100L and 100R. The attachment 7 is attached to the stapler body 9 by the indents 140.

Holders 100H for holding a face plate 150 (which will be described below) are formed near the front face of the frame 100, as shown in FIG. 11.

As shown in FIGS. 8 and 9, the staple feeder 110 has a grip 110G and an arm 130. A user can hold the grip 100G, and lower or elevate the staple feeder 110. When the staple feeder 110 is lowered, the arm 130 is engaged with the coupling unit 32 of the staple magazine 5. When the staple feeder 110 is elevated, the arm 130 is disengaged from the coupling unit 32, and opens a staple-supply path.

Figure 14:
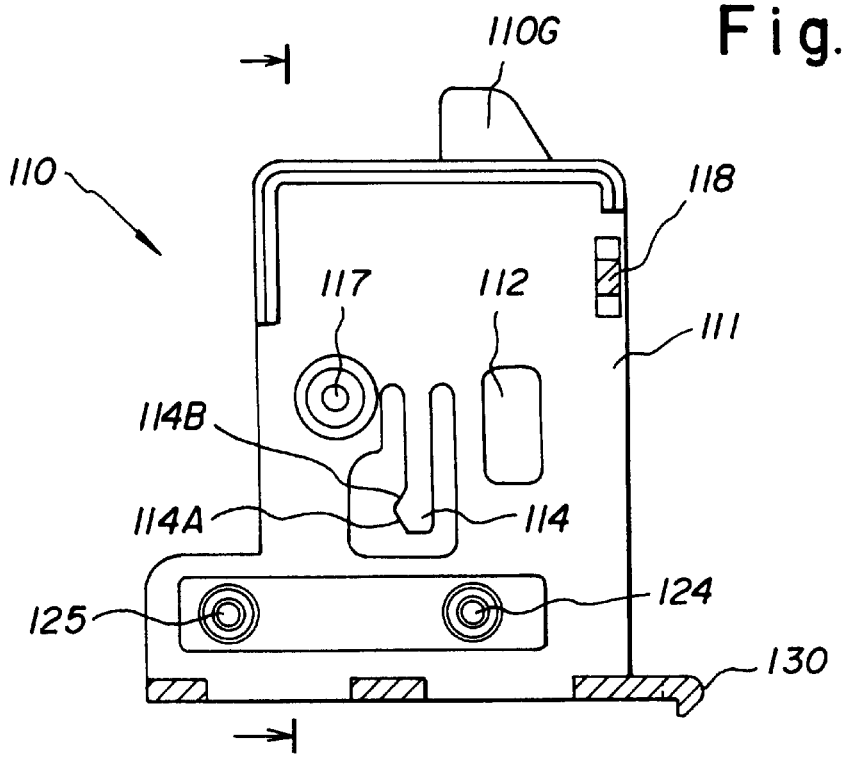
FIG. 14 is a side view of the staple feeder of the attachment.
Figure 15:
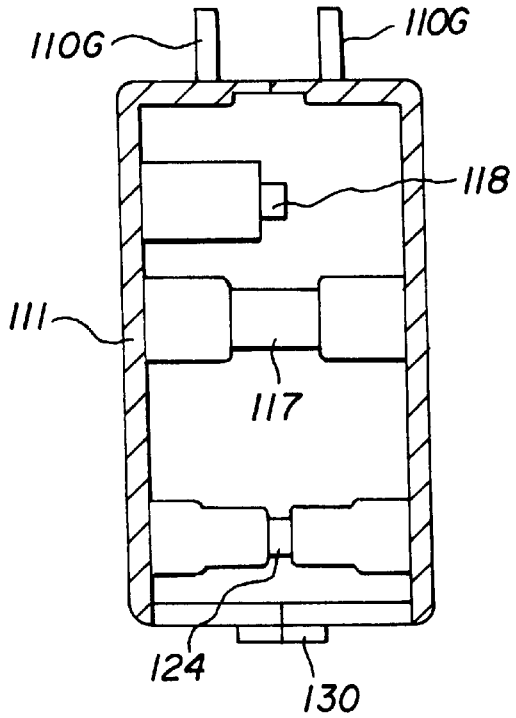
FIG. 15 is a cross-sectional view of the staple feeder taken along a plane perpendicular to FIG. 14, the plane including the bold lines indicated by the arrows in FIG. 14.
Figure 16:
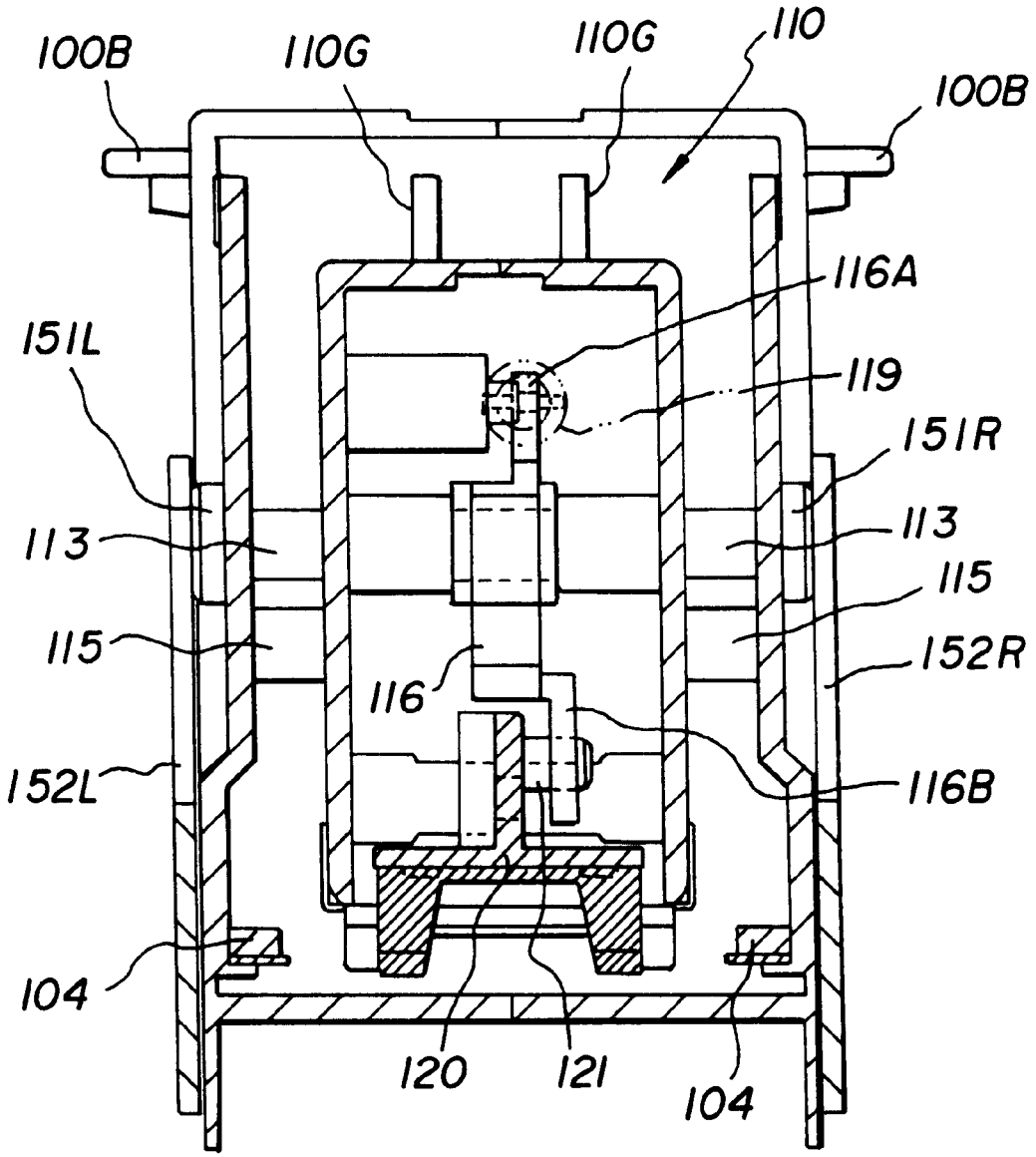
FIG. 16 is another across-sectional view of the attachment.

FIGS. 14 through 16 illustrate the structure of the staple feeder 110. The staple feeder 110 has a frame 111, on which an elongated hole 112 is formed. A rod 113 which supports the staple feeder 110 is inserted in the elongated hole 112, whereby the staple feeder 110 is movable upward and downward. A lock arm 114 is provided to the frame 111. The lock arm 114 has a slope 114A, which comes into contact with the rod 115 (FIG. 16) when the staple feeder 110 is positioned at the upper position, and a shoulder 114B, which comes into contact with the rod 115 when the staple feeder 110 is at the lower position.

As shown in FIG. 8, a feed arm 116 is provided to the frame 111 via a shaft 117, so that the feed arm 116 is swung about the shaft 117. As shown in FIG. 16, a hook 116A is provided to one end of the feed arm 116, and a spring 119 is provided between the hook 116A and a hook 118 which is attached to the frame 111.

A coupling unit 116B is provided to the other end of the feed arm 116, whereby the feed arm 116 is connected, in a pivotable manner, to the coupling pin 121 of a movable arm 116.

The movable arm 120 has guide holes 122 and 123. Guide pines 124 and 125 (FIG. 14) are inserted in the guide holes 122 and 123, whereby the movable arm 120 is swung back and forth.

As shown in FIGS. 9 and 10, the movable arm 120 has pushing means 126 and 127, which come into contact with the surface of the rolled staple assembly 2 to push the rolled staple assembly 2 toward the stapling position. The pushing means 126 and 127 are, for example, leaf springs, and have wings 126L, 126R, 127L, and 127R. The tips of the wings 126L, 126R, 127L, 127R are in touch with both sides of the strip of adhesive on the rolled staple assembly 2.

Figure 26:
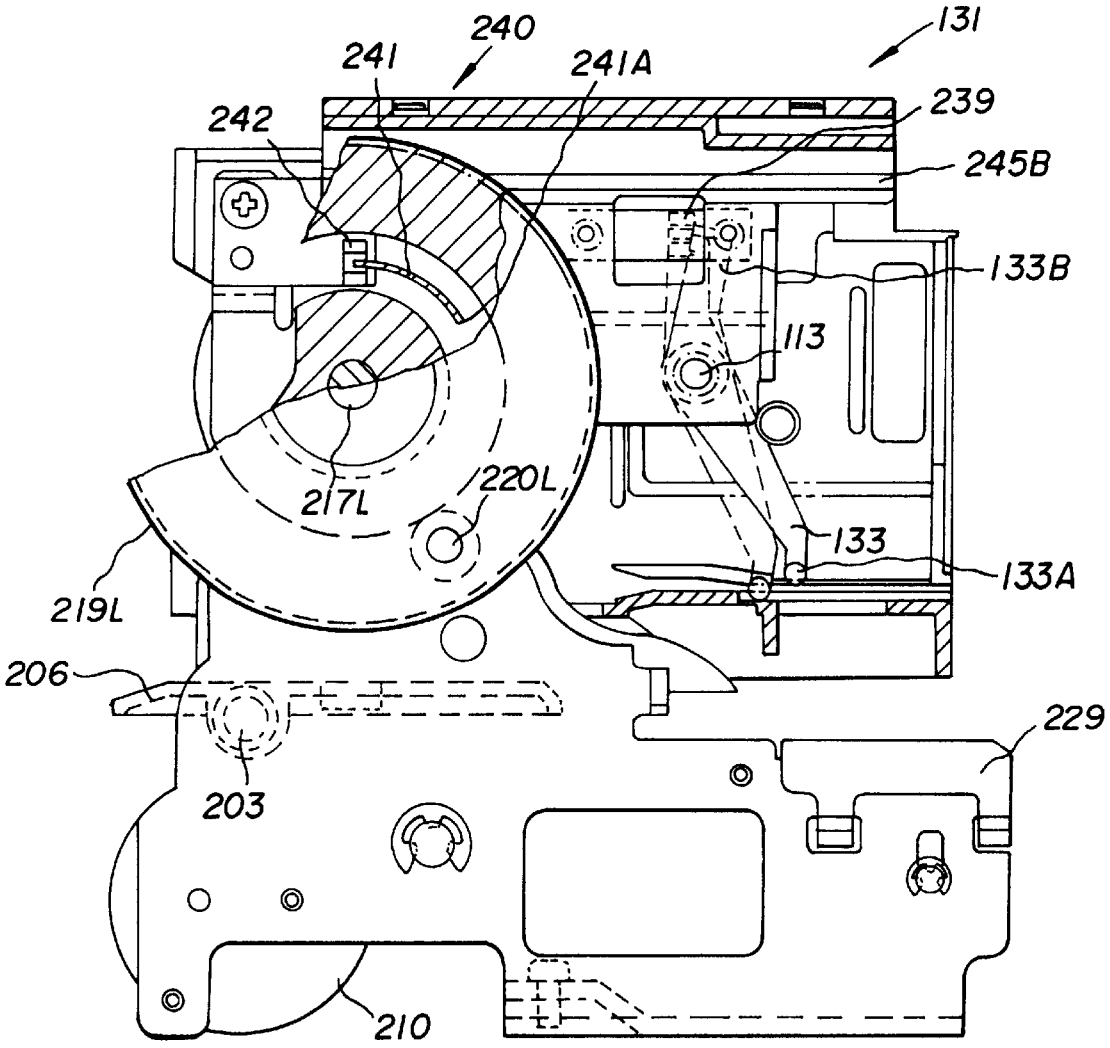
FIG. 26 illustrates the structure of the trailing edge detector and the home position detector.
Figure 27:
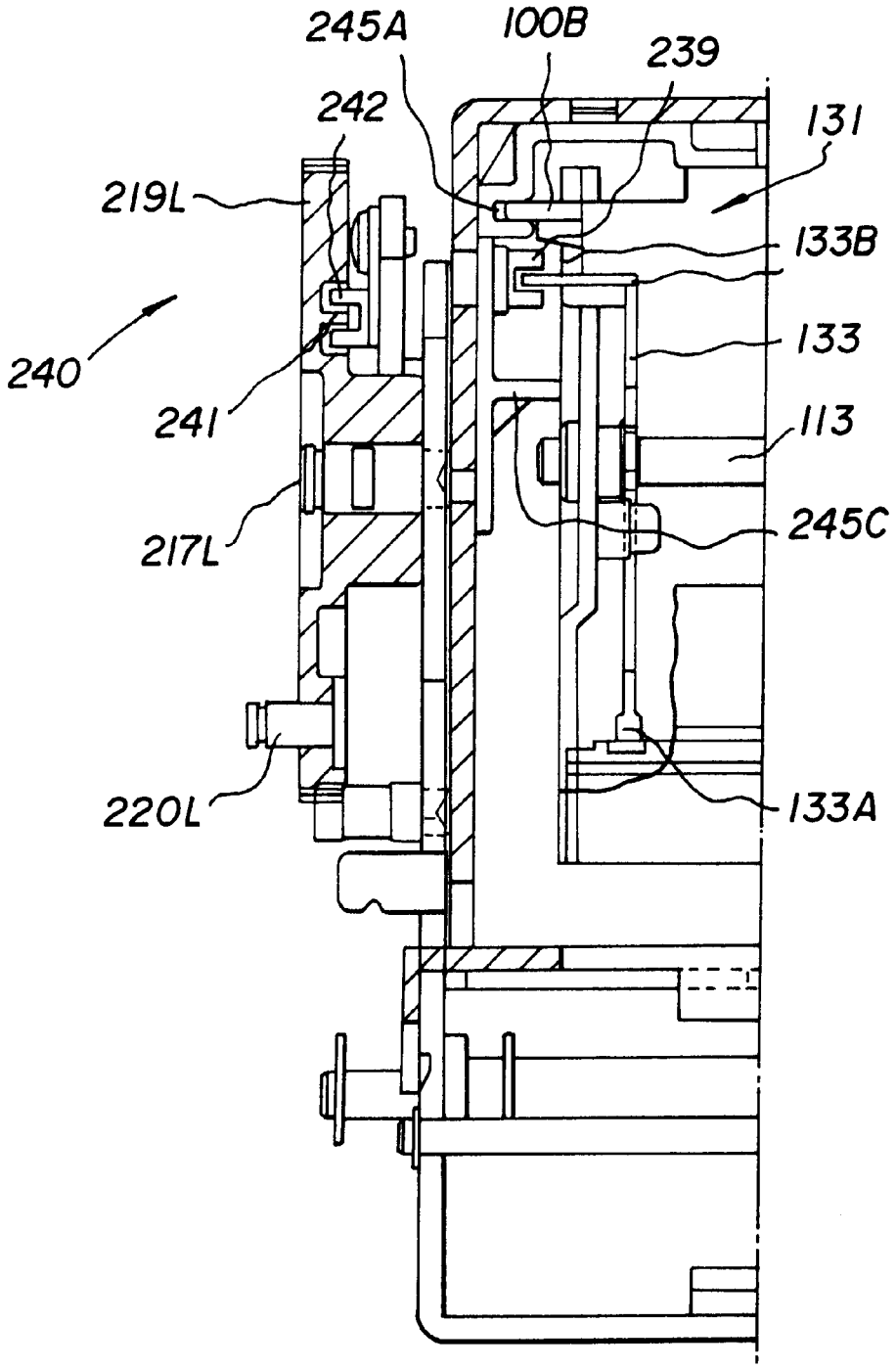
FIG. 27 illustrates the structure of the trailing edge detector and the home position detector shown in FIG. 26 in a different view.

The rear end of the rolled staple assembly 2 is detected by the near-end detection means 131 (shown in FIGS. 26 and 27). When the end of the rolled staple assembly 2 is positioned between the two pushing means 126 and 127, an action for feeding staples is stopped. If a new roll of staple assembly is inserted in the staple magazine 5, and if the front end of the new staple assembly comes into contact with the rear end of the remaining staple assembly 2, then the pushing means 126 pushes the new staple assembly 2, while the pushing means 127 pushes the remaining staple assembly 2.

As shown in FIGS. 8 and 9, retracement prevention means 128 and 129 are provided to the frame 111 for purposes of preventing the rolled staple assembly 2 from going back the path as the pushing means 126 and 127 go back their way. The retracement prevention means 128 and 129 are leaf springs, which have wings 128L, 128R, 129L, and 129R, as shown in FIG. 10. The tips of the wings 128L, 128R, 129L, and 129R come into contact with both sides of the strip of adhesive on the rolled staple assembly 2.

As shown in FIGS. 26 and 27, the near-end detection means 131 has a detection arm 133 connected to the shaft 113 in a pivotable manner, and a sensor 239 connected to the stapler body 9 and for detecting the rotation of the detection arm 133.

One end 133A of the detection arm 133 swings between a position, at which the end 133A comes into contact with the surface of the rolled staple assembly 2 supplied from the staple magazine 5, and a position, at which the end 133A is out of contact with the rolled staple assembly 2 because the rear end of the staple assembly 2 has passed this position. The detection arm 133 is forced by a spring (not shown) in a clockwise direction about the rod 113 in FIG. 26.

The shooting unit 6 is shown in FIGS. 8 and 9. A face plate 150 is attached to the front end of the frame 100. A driver 153 and a former 154 are positioned between the first and second sheathes 151 and 152, which are supported by the shaft 113.

Figure 17B:
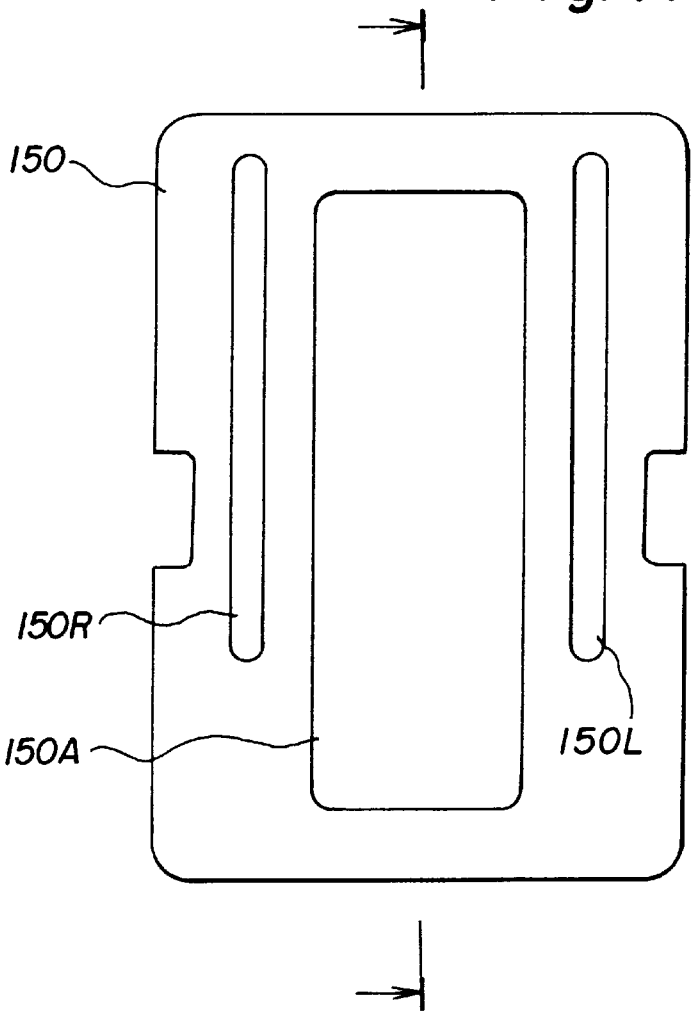
Figure 17A:
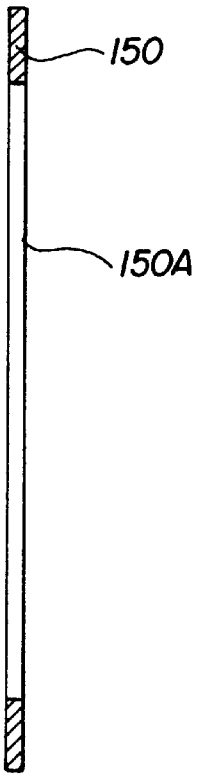
Figure 18B:
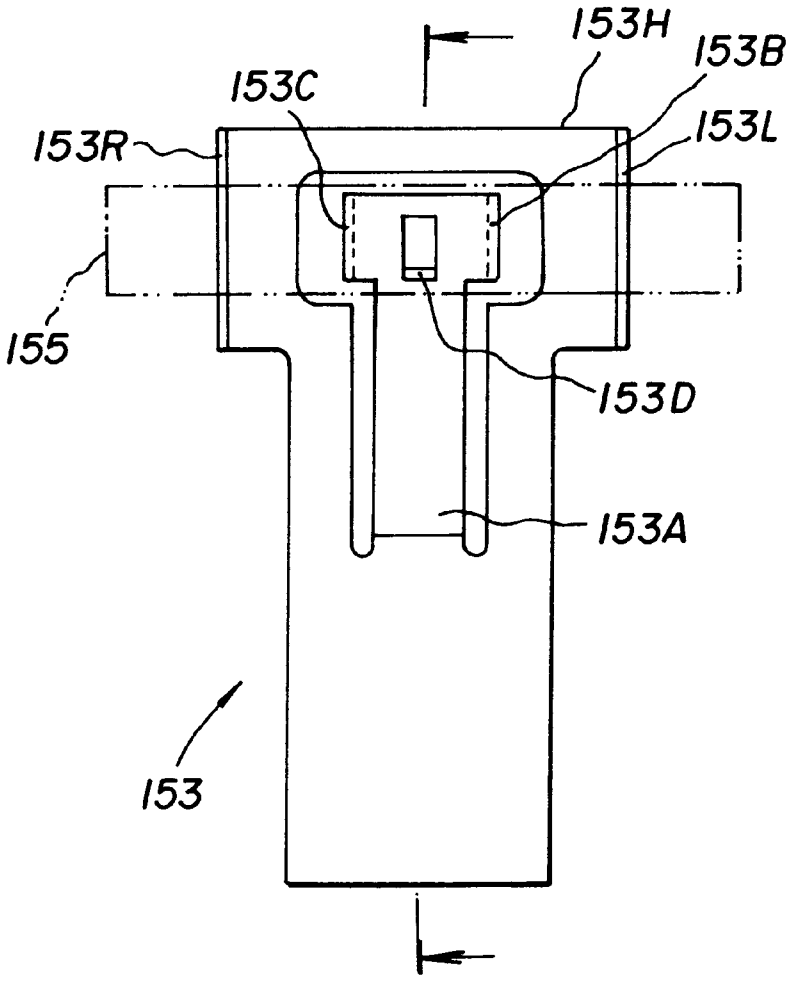
Figure 18A:
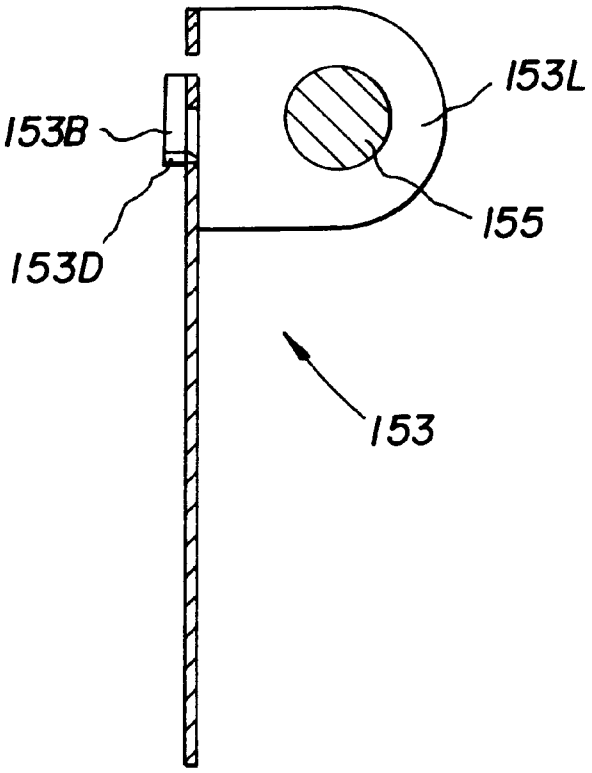

The face plate 150 has an opening 150A in the center, and slits 150L and 150R on both sides of the opening 150A, as show in FIG. 17. The flanges 153L and 153R of the driver 153 (shown in FIG. 18) are inserted in the slits 150L and 150R.

The flanges 153L and 153R have holes for receiving a shaft 155. The driver 153 has a swinging portion 153A which has projections 153B, 153C, and 153D. The projections 153B and 153C are engaged with the former 154 in order to lower the former 154. The projection 153D disengage the swinging portion 153A from the former 154.

Figure 19B:
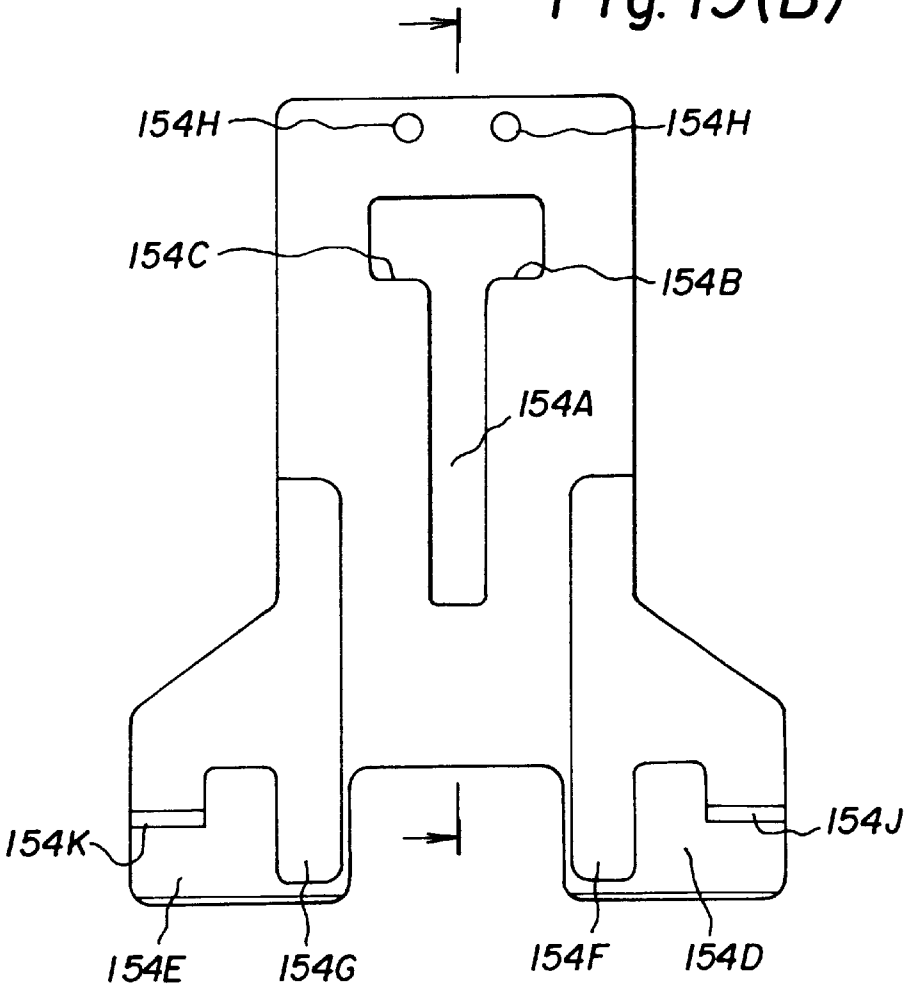
Figure 19A:
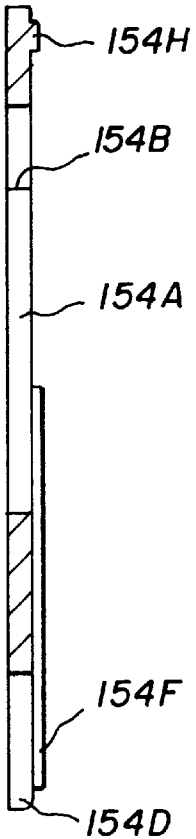

FIG. 19 illustrates the former 154. The former 154 has a T-shaped opening 154A in the center. The wings 154B and 154C of the T-shaped opening 154A receive the projections 153B and 153C of the driver 153.

The former 154 has stoppers 154H above the T-shaped opening 154A. The top end 153H of the driver 153 is received by the stoppers 154H as the driver 153 is elevated.

The former 154 has staple controller 154D and 154E for controlling the position of the leading staple of the staple assembly 2, which is supported by a bending plate 105, and benders 154F and 154G for bending both ends of the leading staple on the bending plate 105. The former 154 also has portions 154J and 154K, which are engaged with the projections 105J and 105K of the bending plate 105 to push back the bending plate 105 from the moving path of the driver 153 after both ends of the staple are bent.

Figure 20B:
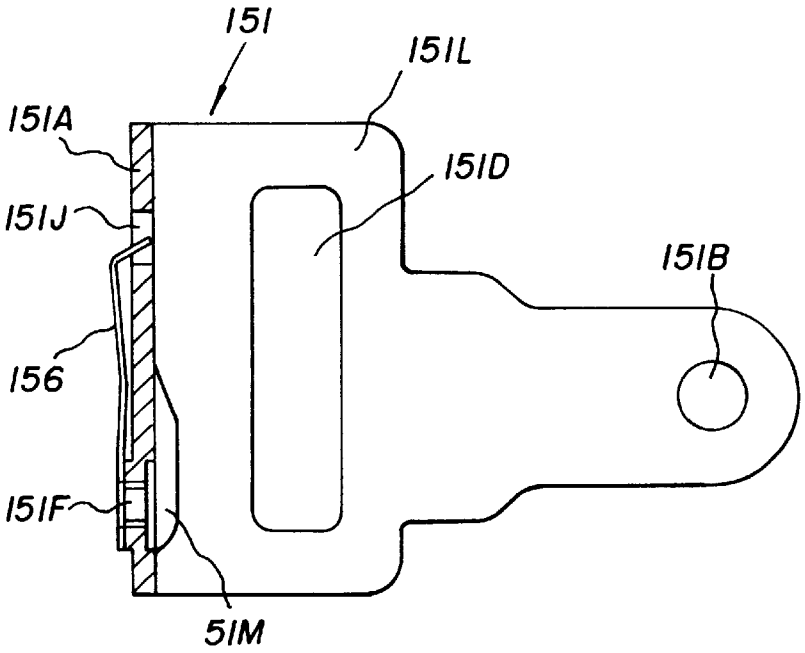
Figure 20A:
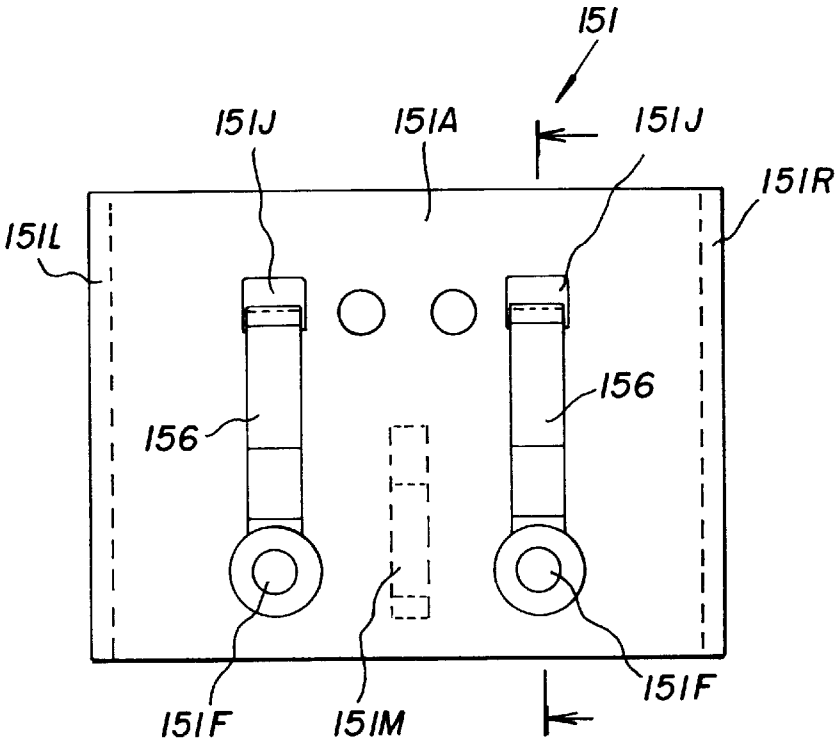

FIG. 20 illustrates the first sheath 151, which has a front wall 151A and side walls 151L and 151R. Each of the side walls 151L and 151R has a hole 151B for receiving the shaft 113, and an elongated hole 151D, in which the shaft 155 of the driver 153 moves.

The front wall 151A of the sheath 151 has a pair of fixing units 151F, each of which fixes one end of each of a pair of leaf springs 156, and a pair of holes 151J, each of which lets the other end of the associated leaf spring 156 project toward the former 154.

A projection 151M is formed on the inner face of the front wall 151A. As the driver 153 is lowered, the projection 153D of the driver 153 runs onto the projection 151M, whereby the swinging portion 153A goes into the opening 150A of the face plate 150, and the projections 153B and 153C of the driver 153 are disengaged from the opening wings 154B and 154C of the former 154. The driver 153 is further lowered to pierce both ends of the staple S, which have been bent by the former 154, through sheets.

Figure 28:
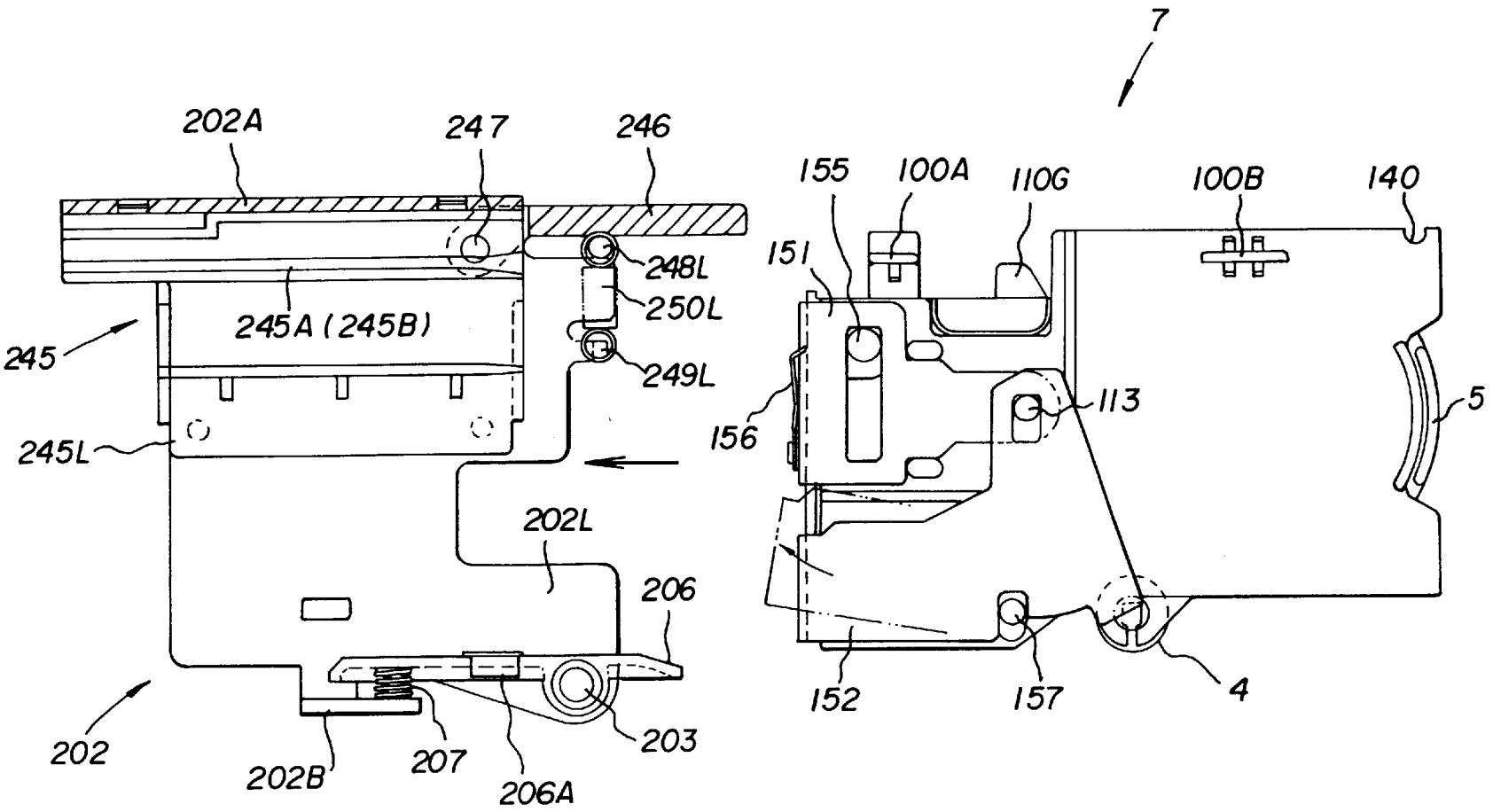
FIG. 28 illustrates the state 1, in which the attachment is going to be attached to the stapler body.

The second sheath 152 has a front wall 152A, and side walls 152L and 152R. As shown in FIG. 28, the second sheath 152 is pivotable about the shaft 113 as a lock pin 157 is lowered, so that a jammed staple is removed.

(4) Stapler Body 9

Figure 22:
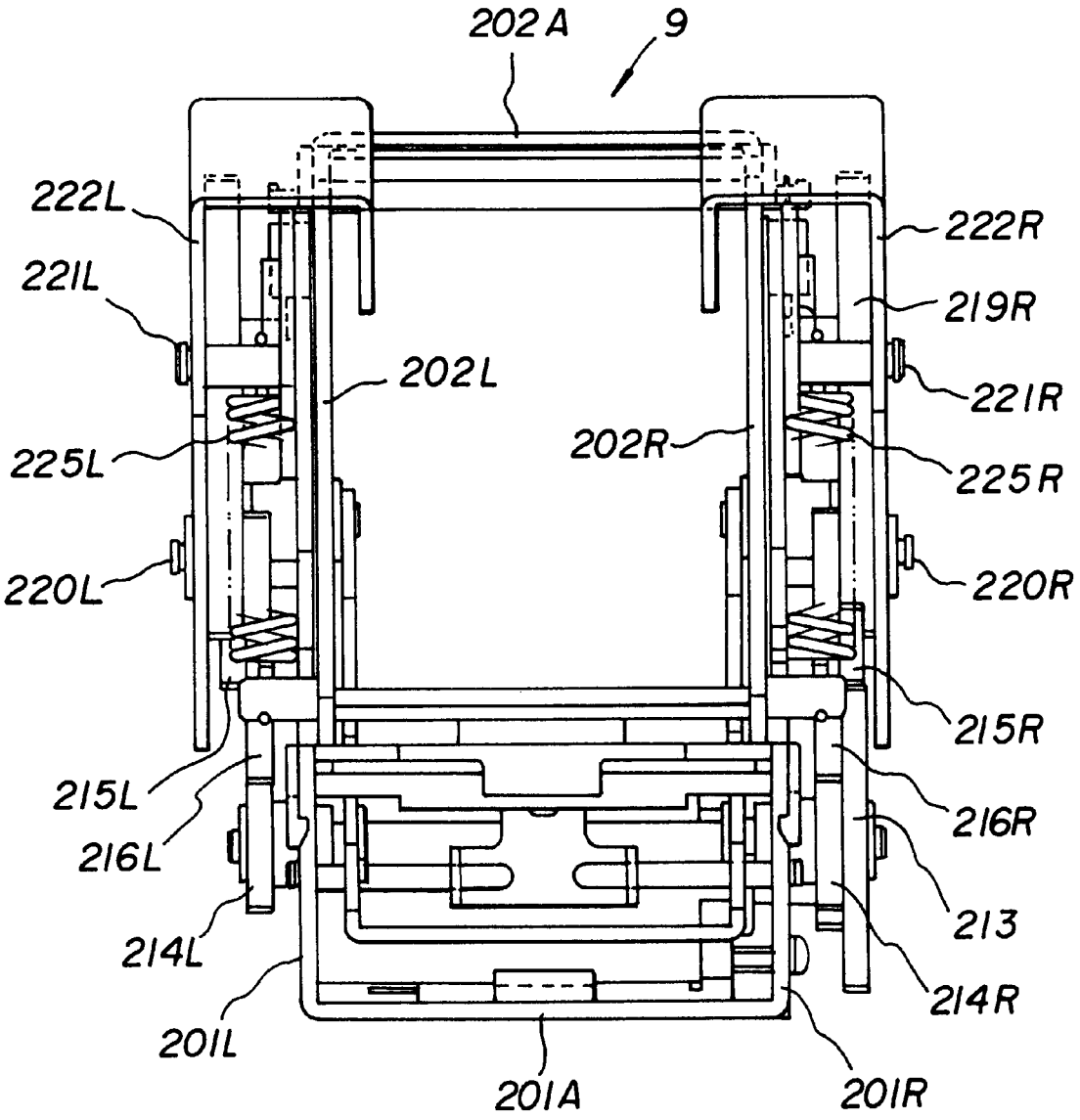
FIG. 22 is a front view of the stapler body.
Figure 23:
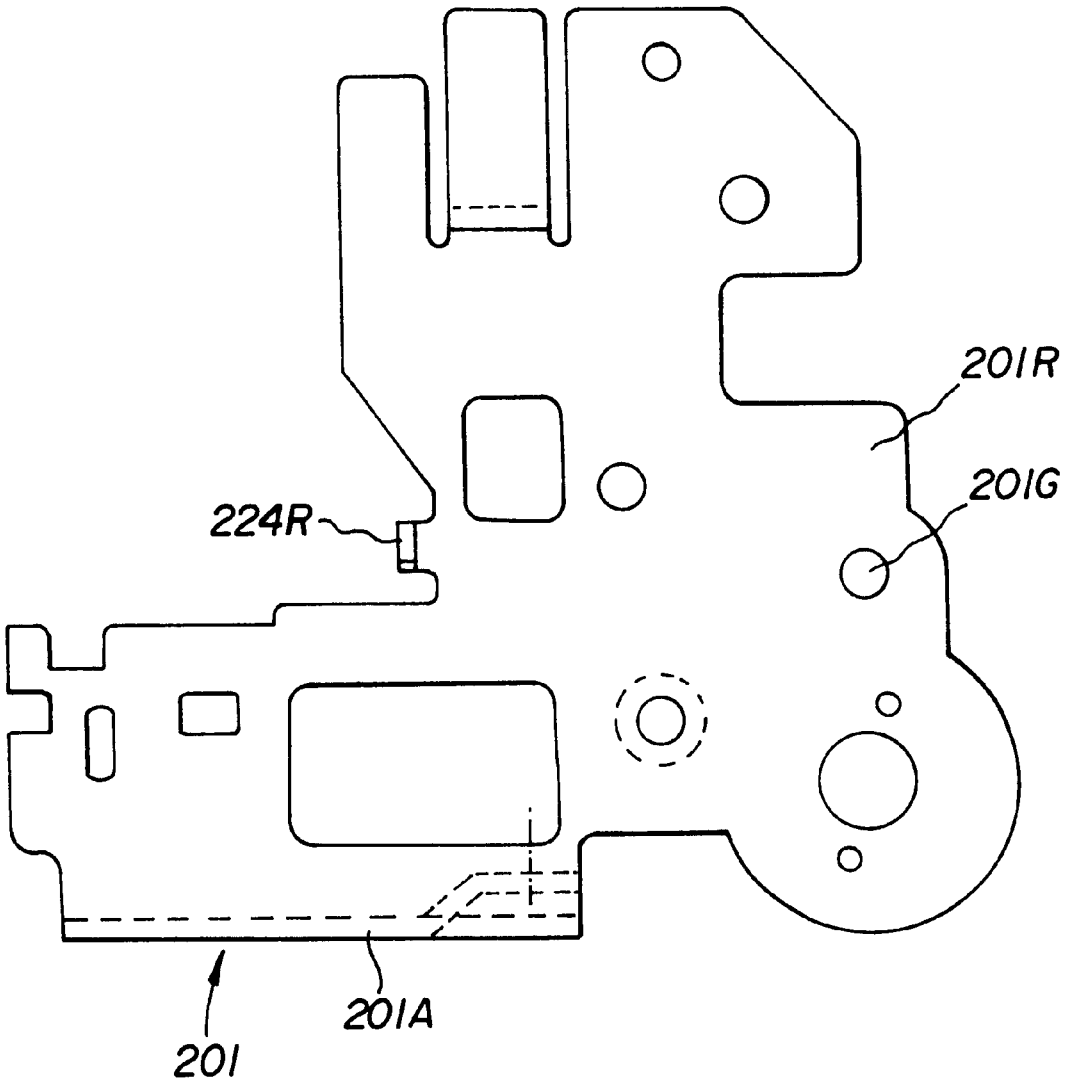
FIG. 23 illustrates the first frame of the stapler body.

FIGS. 21 through 23 illustrate the stapler body 9. The stapler body 9 has a first frame 201, a second frame 202 which is pivotable with respect to the first frame 201, a holder fixed to the second frame 202 and for receiving the attachment 7, a driving means 8 fixed to the first frame 201 and driving a staple piercing through sheets, and a clincher 10 fixed to the first frame 201 and for clinching both ends of the staple which has penetrated through sheets.

Figure 24:
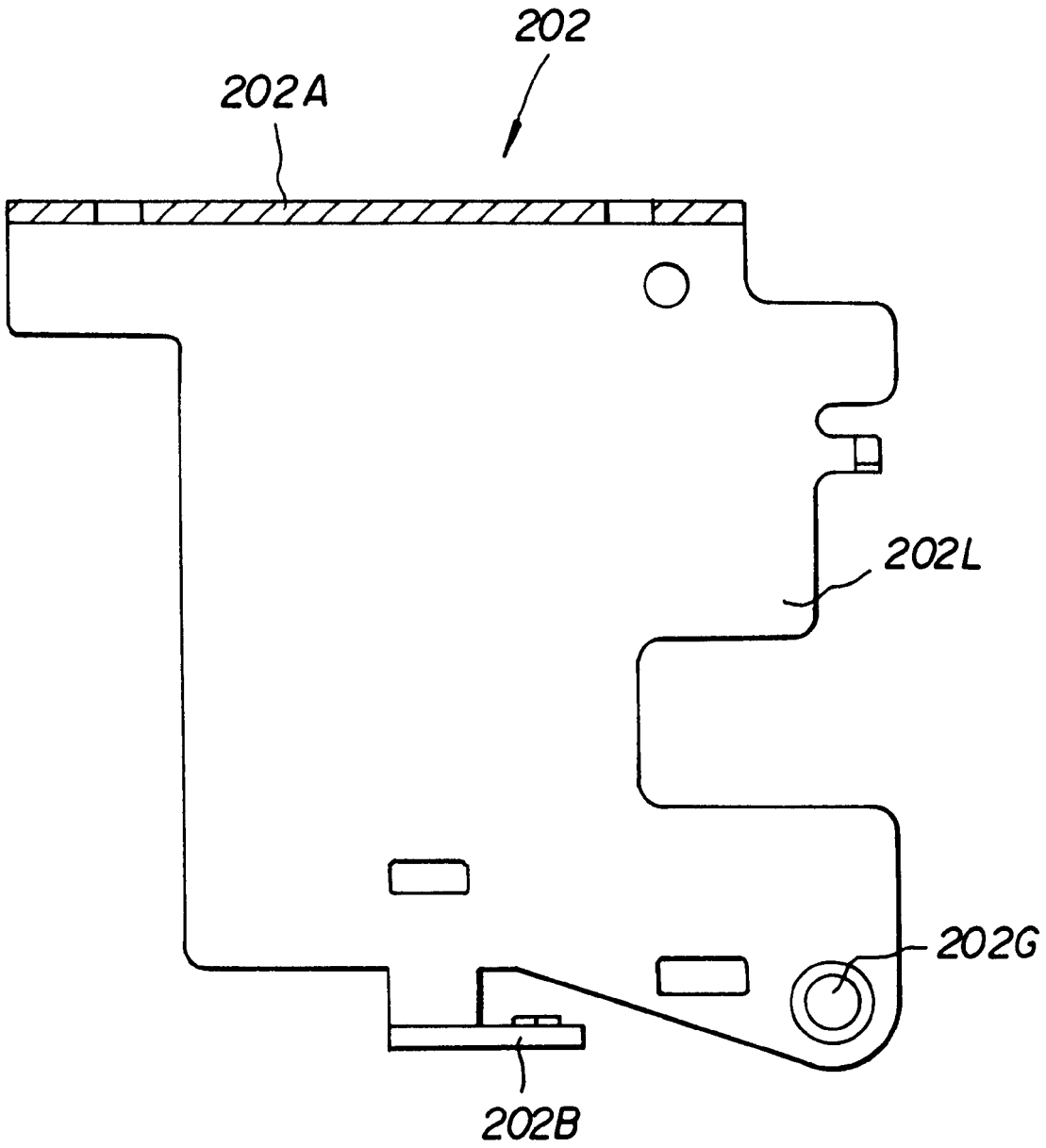
FIG. 24 illustrates the second frame of the stapler body.

The first frame 201 shown in FIG. 23 is connected to the second frame 202 shown in FIG. 24 in a pivotable manner about the shaft 203 which is inserted in the holes 201G and 202G. The first and second frames 201 and 202 are made of metal plates which are bent in U-shapes.

The first frame 201 has a connection wall 201A which is fixed to a imaging apparatus, such as a copy machine or a printer. The side walls 201L and 201R extend from the connection wall 201A so as to be perpendicular to the connection wall 201A. The side walls 201L and 201R and the connection wall 201A are monolithically formed.

The second frame 202 has a connection wall 202A, which is fixed to the imaging apparatus, and side walls 202A and 202B, which extend from the connection wall 202A in the normal direction. When the stapler apparatus 1 is incorporated in the imaging apparatus, such as a copy machine or printer, one of the connection walls 201A and 202A is fixed to the imaging apparatus. Accordingly, the stapler apparatus 1 can be fixed to the imaging apparatus either upward or downward.

As shown in FIG. 28, the shaft 203 has a roller guide 206, which comes into contact with the feed roller 4 when the attachment 7 is inserted in the stapler body 9. The roller guide 206 rotates the feed roller 4 in a direction of feeding the staple. The roller guide 206 is forced against the feed roller 4 by a spring 207 which is fixed to the supporter 202B of the second frame 202. The rotation of the roller guide 206 is limited by a stopper 206A so that the roller guide 206 is rotated in a limited range.

A holders 245 is provided to each of the side walls 202L and 202R of the second frame 202 in order to receive the attachment 7 in the stapler body 9. The holder 245 has side plates 245L and 245R, which have unit guides 245A and 245B for guiding the flanges 100A, 100B, 100C, and 100D, as well as guides 245C and 245D for guiding both ends of the shaft 155.

The second frame 202 also has a lock lever 246 for fixing the attachment 7 in the stapler body 9. The lock lever 246 is pivotable about the shaft 247. The lock lever 246 has a lock 248 which is received by the recess 140 of the attachment 7. A spring 250 is positioned between each end of the lock 248 and the supporter 249 of each of the side walls 202L and 202R of the second frame 202.

The driving means 8, which is shown in FIGS. 1 through 3, has a driving motor 210 fixed to the side wall 201R of the first frame 201. The driving motor 210 has a gear 211 which is meshing with a gear 213 supported by a shaft 212. The shaft 212 extends between the left and right side walls 201L and 201R of the first frame 201 in a rotatable manner.

A gear 214R is fixed just inside the gear 213 to one end of the shaft 212, and another gear 214L is fixed to the other end of the shaft 212. The gear 214R rotates together with the gear 213. The gears 214L and 214R are meshing with gears 216L and 216R, respectively. The gears 216L and 216R are coupled with the gears 215L and 215R, respectively, and rotate in the same rate.

The gears 215L and 215R are meshing with driving wheels 219L and 219R, respectively, which, in turn, are coupled with clinching cams 218L and 218R connected to the wheel shafts 217L and 217R in a rotatable manner. The clinch cams 218L and 218R have swells 218A for driving follower links 222L and 222R.

The stapler body 9 has a home position detection means 240, the structure of which is shown in FIGS. 26 and 27. The home position detection means 240 comprises a light-blocking member 241 located inside the driving wheel 219L, and a sensor 242.

Figure 25:
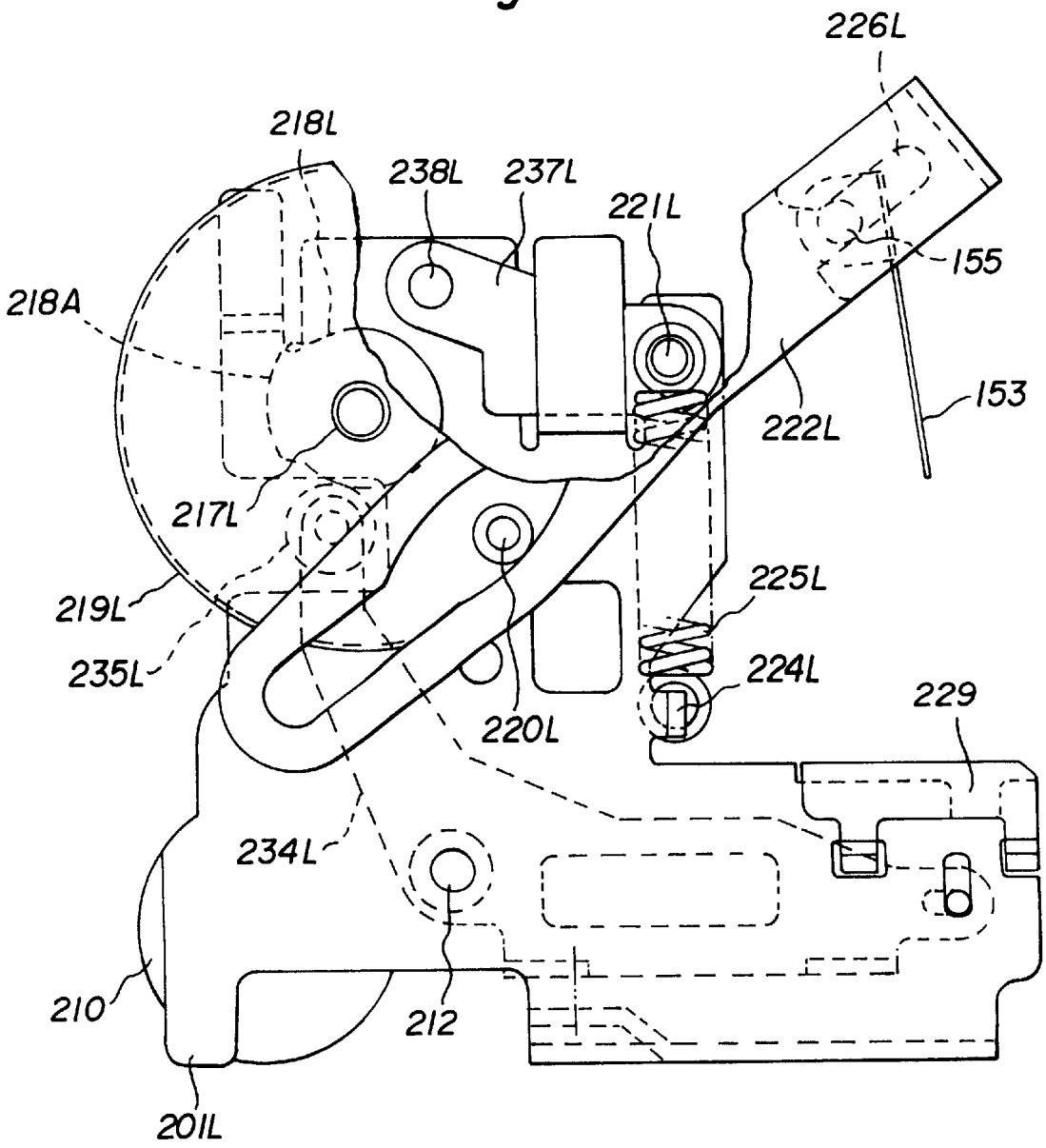
FIG. 25 illustrates the structure of the driving mechanism.

As shown in FIG. 25, arms 237L and 237R are connected at one end to the side walls 201L and 201R in a rotatable manner via shafts 238L and 238R, respectively. The other end of each of the arms 237L and 237R is connected to one of follower links 222L and 222R in a rotatable manner via one of shafts 221L and 221R. The shafts 221L and 221R are movable up and down. Accordingly, even if the position of the driver 153 changes in response to the thickness of sheets after a staple is shot through the sheets, the driving means 8 is not locked because the rotational fulcrums of the follower links 222L and 222R move so that driving pins 220L and 220R can move in the cam holes 223L and 223R of the follower links 222L and 222R.

The driving pins 220L and 220R, which are fixed to the surface of the driving wheels 219L and 219R, are received in the cam holes 223L and 223R of the follower links 222L and 222R, respectively, as shown in FIGS. 1 and 2. The shafts 221L and 221R are forced downward by tension springs 225L and 225R which are fixed to spring hooks 224L and 224R, respectively.

Driving grooves 226L and 226R are formed in the end portion of the follower links 222L and 222R. The driver of the attachment 7 is received in the driving grooves 226L and 226R.

Figures 37A, 37B, 37C, 37D:
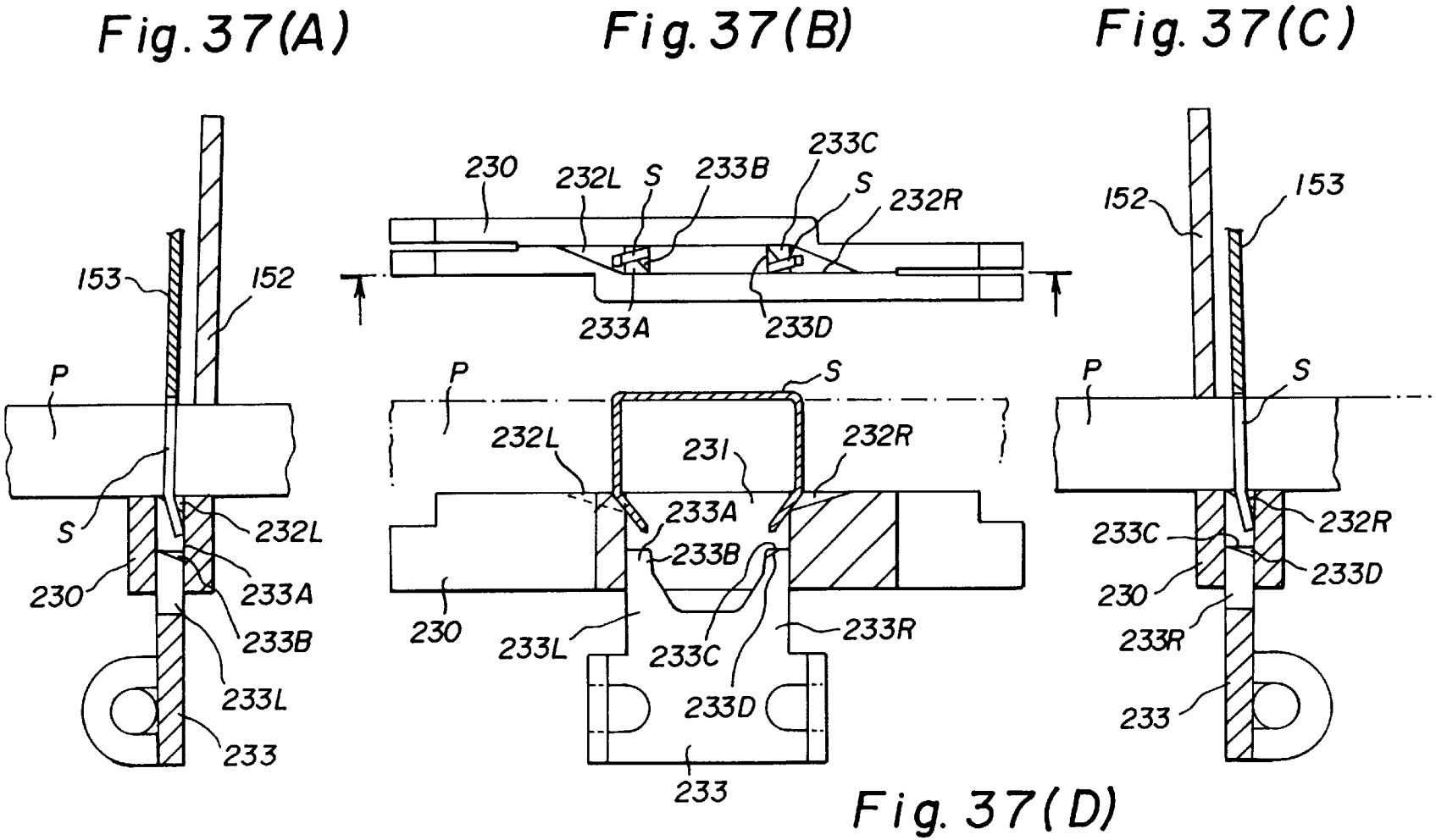
Figures 38A, 38B, 38C, 38D:
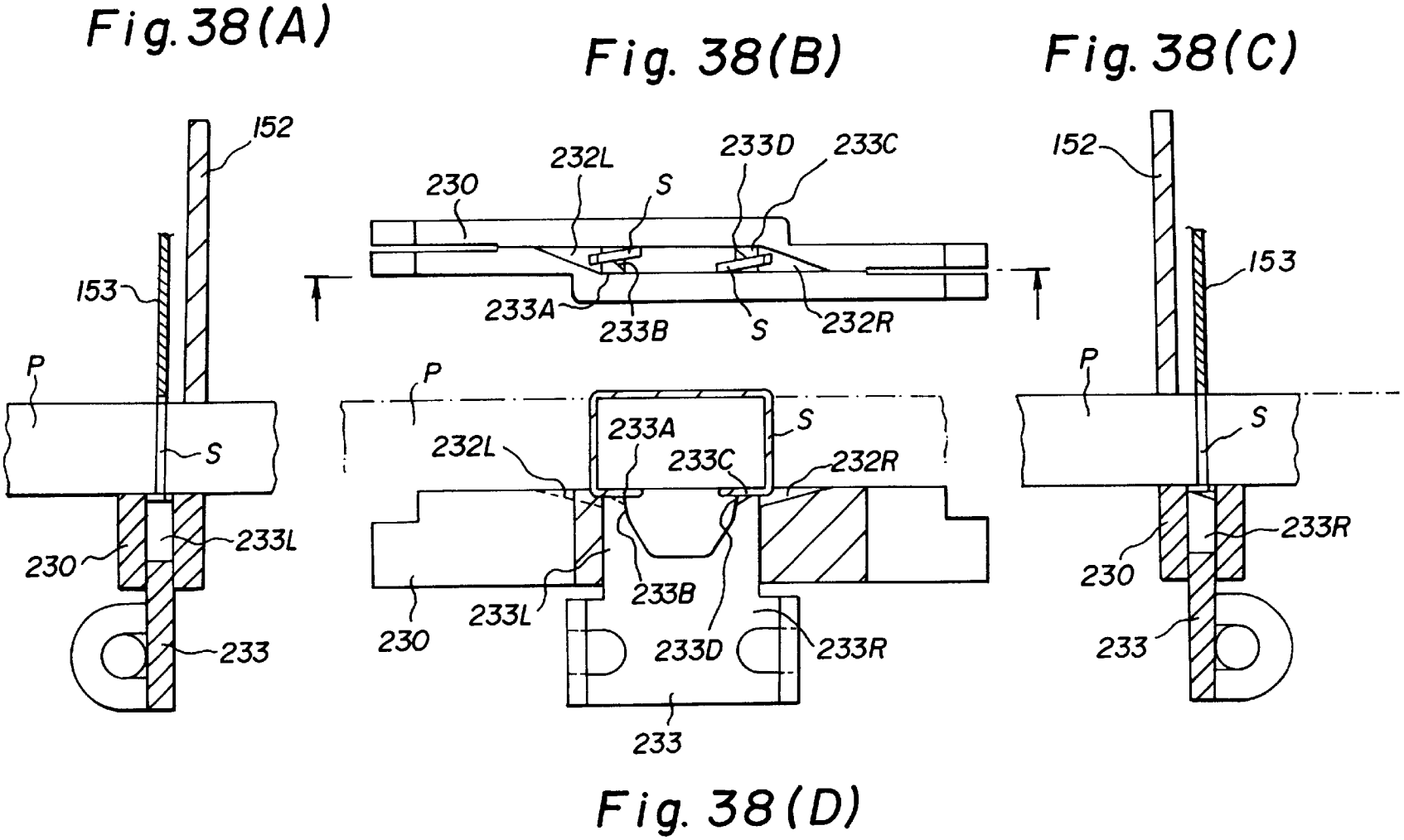

The clinching means 10 has a clincher cover 229 and a clincher block 230, which are fixed to the first frame 201, as shown in FIGS. 1 and 37. The clincher block 230 has a center hole 231, in which the tips of the U-shaped staple, which have penetrated through paper, stick out. The clincher block 230 also has slopes 232L and 232R which initially push the tips of the U-shaped staple inward as the staple is driven by the driver 153. A clincher 233 is positioned movable upward and downward in the center hole 231. Upward movement of the clincher 233 completes the clinch of the tips of the staple.

The clincher 233 has a pair of projections 233L and 233R. The projection 233L has a horizontal top plane 233A and an inclined face 233B. The projection 233R has a horizontal plane 233C and an inclined face 233D which is inclined in a direction opposite to the inclined face 233B.

The clincher 233 is connected to one end of each of the clinch levers 234L and 234R which are supported by the shaft 212 in a rotatable manner. Follower rollers 235L and 235R are provided to the other end of the clinch levers 234L and 234R. The follower rollers 235L and 235R follow the clinch cams 218L and 218R, and move up and down. One end of each of the clinch levers 234L and 234R is forced by a pressing spring 236 in a counterclockwise direction about the shaft 212 in FIG. 1.

As each of the clinch cams 218L and 218R makes one revolution, the follower rollers 235L and 235R of the clinch levers 234L and 234R move along the clinch cams 218L and 218R. Consequently, the clinch levers 234L and 234R rotate about the shaft 212*k,* and the clincher 233 pushes and clinches the tips of the U-shaped staple inward as the clincher 233 moves upward.

<Operations >

(1) Filling Staple Magazine 5 with Rolled Stable Assembly 2

As shown in FIGS. 4 through 7, by moving the lock 23 along the lock guides 20D and 21D, the first and second cases 20 and 21 are unlocked and opened via the hinge 22. A new roll of staple assembly 2 is inserted in the recess 21A of the second case 21 so that the leading edge of the rolled staple assembly 2 is received between the staple guides 21B and 21C. The rolled staple assembly 2 comes into contact with the feed roller 4, which presses the rolled staple assembly 2 against the staple guide 21.

After the new staple assembly 2 is accommodated in the second case 21, the first case 20 is closed about the hinge 22, and locked by the lock 23. If the leading edge of the rolled staple assembly 2 sticks out of the port 2A of the case 20, the leading edge of the staple assembly 2 may be pushed back directly by a finger, or alternatively, by rotating the feed roller 4 manually. The user does not have to remove a portion of the staple assembly 2 which sticks out of the port 3A of the staple magazine 5, and can use the staple assembly 2 economically.

(2) Inserting Staple Magazine 5 into Attachment 7

The grip 110G of the staple feeder 110 is held in order to raise the staple feeder 110 of the attachment 7. In this state, the staple magazine 5, which is filled with a rolled staple assembly 2, is inserted in the attachment 7 along the guides 101L and 101R. The staple magazine 5 is inserted until the staple guides 20B and 21B of the staple magazine 5 strike the guide 100D of the attachment 7.

Then, the staple feeder 110 is lowered, as shown in FIG. 9, and the coupling arm 130 comes into contact with the coupler 32 of the staple magazine 5. In this manner, the staple magazine 5 is fixed into the attachment 7.

(3) Inserting Attachment 7 into Stapler Body 9

As the attachment 7, in which the staple magazine is held, is inserted in the stapler body 9, the flanges 100A and 100B of the attachment 7 are guided by the unit guides 245A and 245B of the stapler body 9, while both ends of the shaft 155 are guided by the guides 245C and 245D, as shown in FIG. 28.

Figure 29:
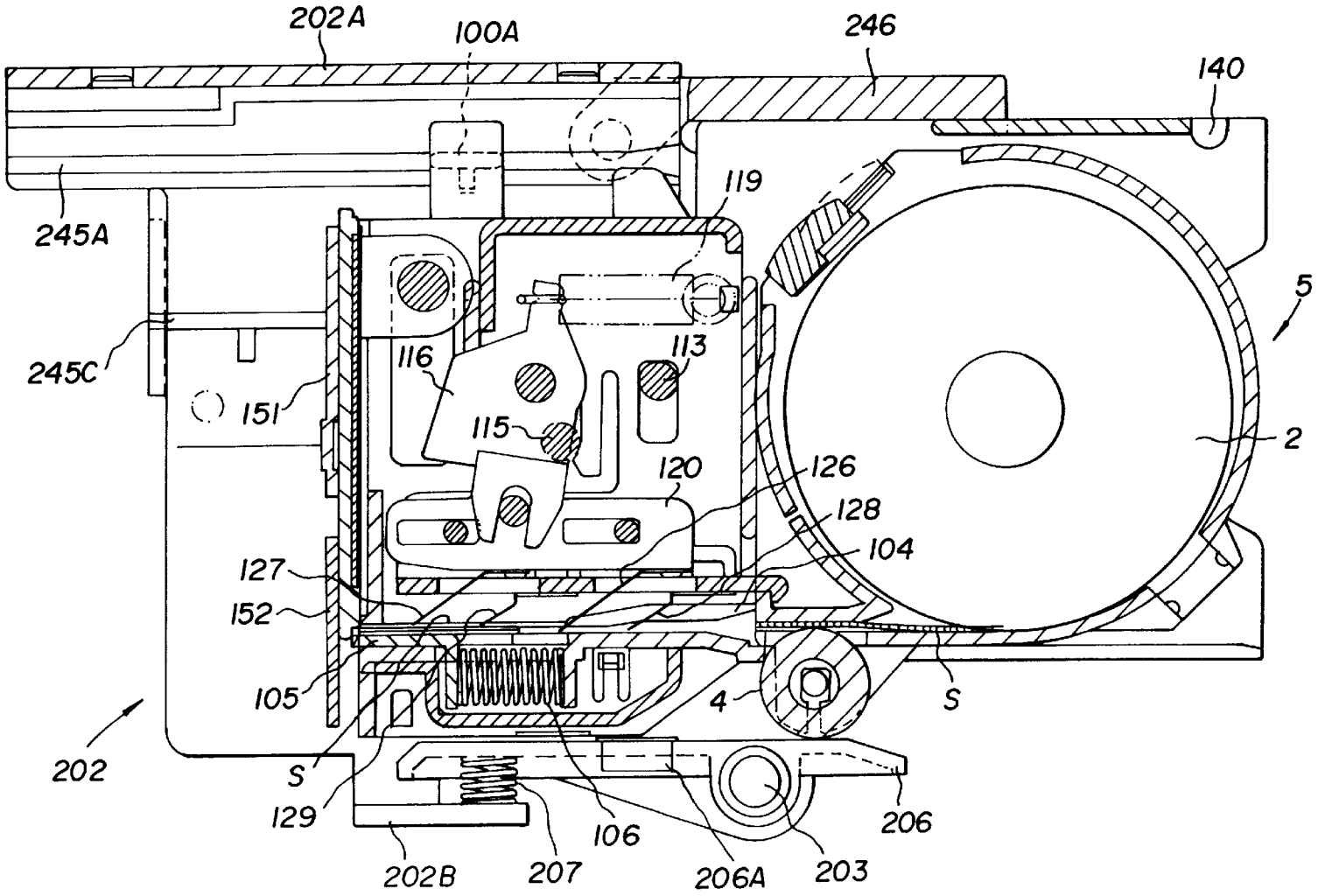
FIG. 29 illustrates the state 2, in which the attachment is attached to the stapler body.
Figure 30:
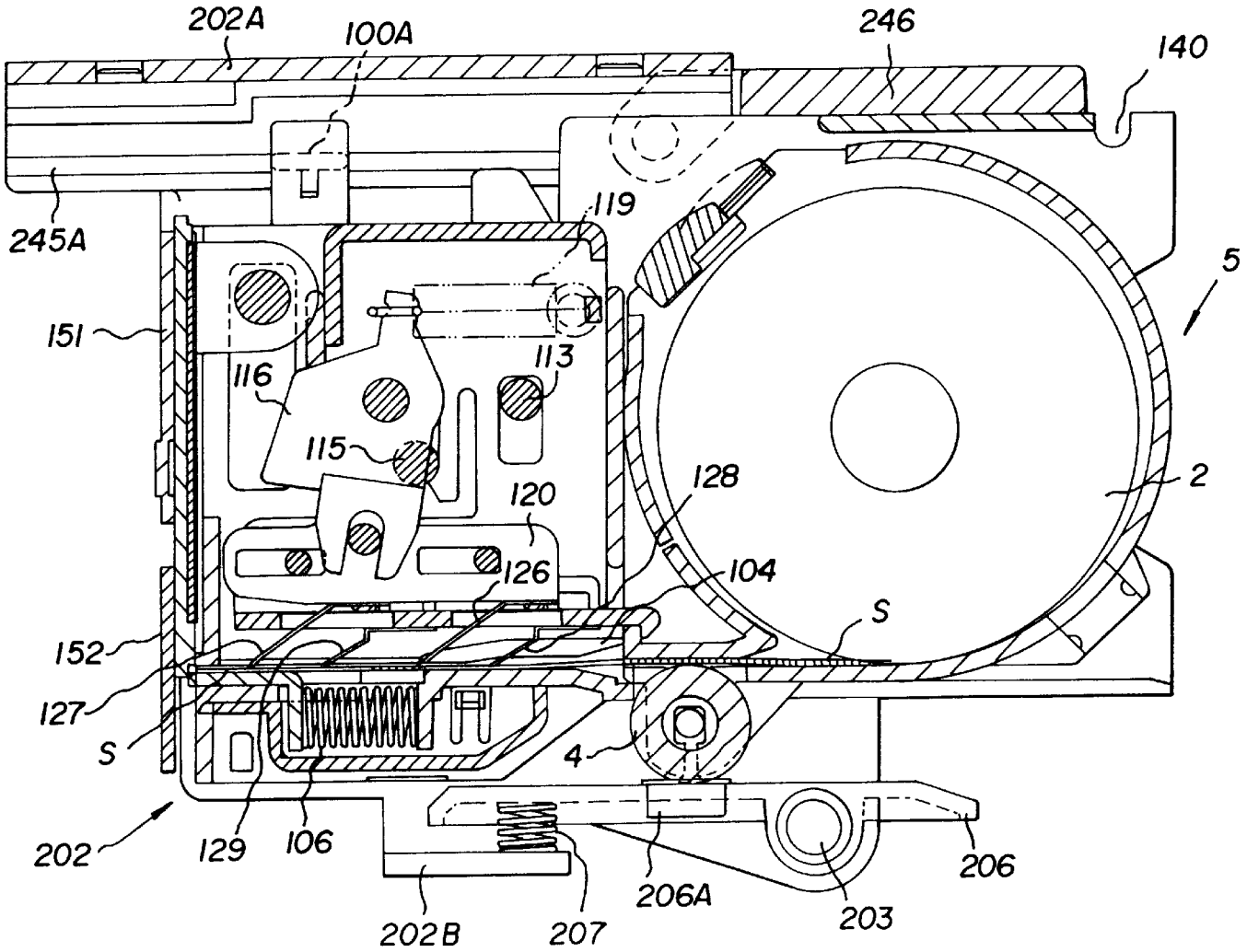
FIG. 30 illustrates the state 3, in which the attachment is attached to the stapler body.
Figure 31:
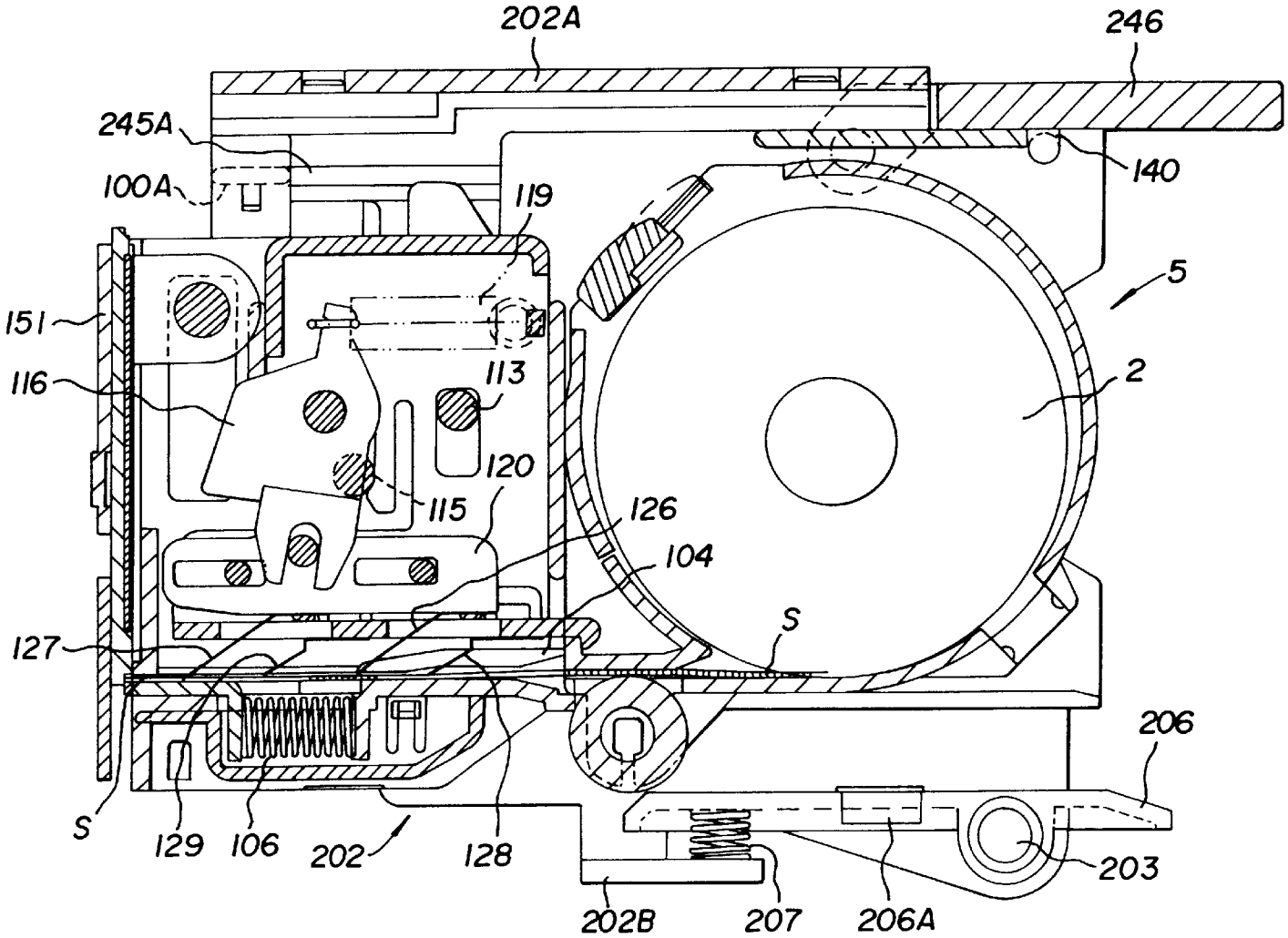
FIG. 31 illustrates the state 4, in which the attachment is attached to the stapler body.

As shown in FIG. 29, the feed roller 4 of the attachment 7 comes into contact with the roller guide 206. The feed roller rotates in the staple-feeding direction in response to the insertion of the attachment 7, whereby the leading edge of the staple assembly 2 is sent out toward the stapling position. The leading edge of the staple assembly 2 is transported between the guides 103 and 104 until the leading staple strikes the former 154 unless there is no staple remaining on the bending plate 105 and the guide 103. If some of the previous staple assembly 2 remain on the bending plate 105, the new staple assembly 2 is transported until the leading edge of the new staple assembly 2 strikes the trailing edge of the previous staple assembly 2, as shown in FIG. 30.

When the leading edge of the new staple assembly 2 hits the former 154 or the trailing edge of the remaining staple assembly, the feed roller 4 slips on the surface of the staple assembly 2, and the new staple assembly 2 is not fed any longer. Accordingly, if the staple magazine 5 is inserted in the attachment 7 with no old staples remaining in the attachment 7, a staple S is automatically supplied to the stapling position in response to insertion of the staple magazine 5 in the attachment 7. The stapler apparatus 1 can reliably staple sheets from the first shot immediately after the insertion of the stapler magazine 5, without taking any blank shot.

When the rear end of the staple assembly is detected, the staple magazine 5 is removed from the attachment 7 to fill the staple magazine 5 with a new roll staple assembly. In this case, the staple magazine 5 is inserted again in the attachment 7 so that the leading edge of the new staple assembly is connected to the trailing edge of the old staple assembly remaining in the attachment 7. Accordingly, the user can make full use of the staple assembly without wasting any staples.

During the insertion of the attachment in the stapler body 9, the shaft 155 of the attachment 7 is received by the coupling grooves 226L and 226R of the follower links 222L and 222R, as shown in FIG. 1, whereby the shooting unit 6 is connected to the driving means 8 of the stapler apparatus 1. When the attachment is attached to the stapler body 9, the lock lever 246 is engaged with the recess 140 of the attachment 7, and the attachment 7 is fixed to the stapler body 9.

(4) Stapling Action

Figure 39:
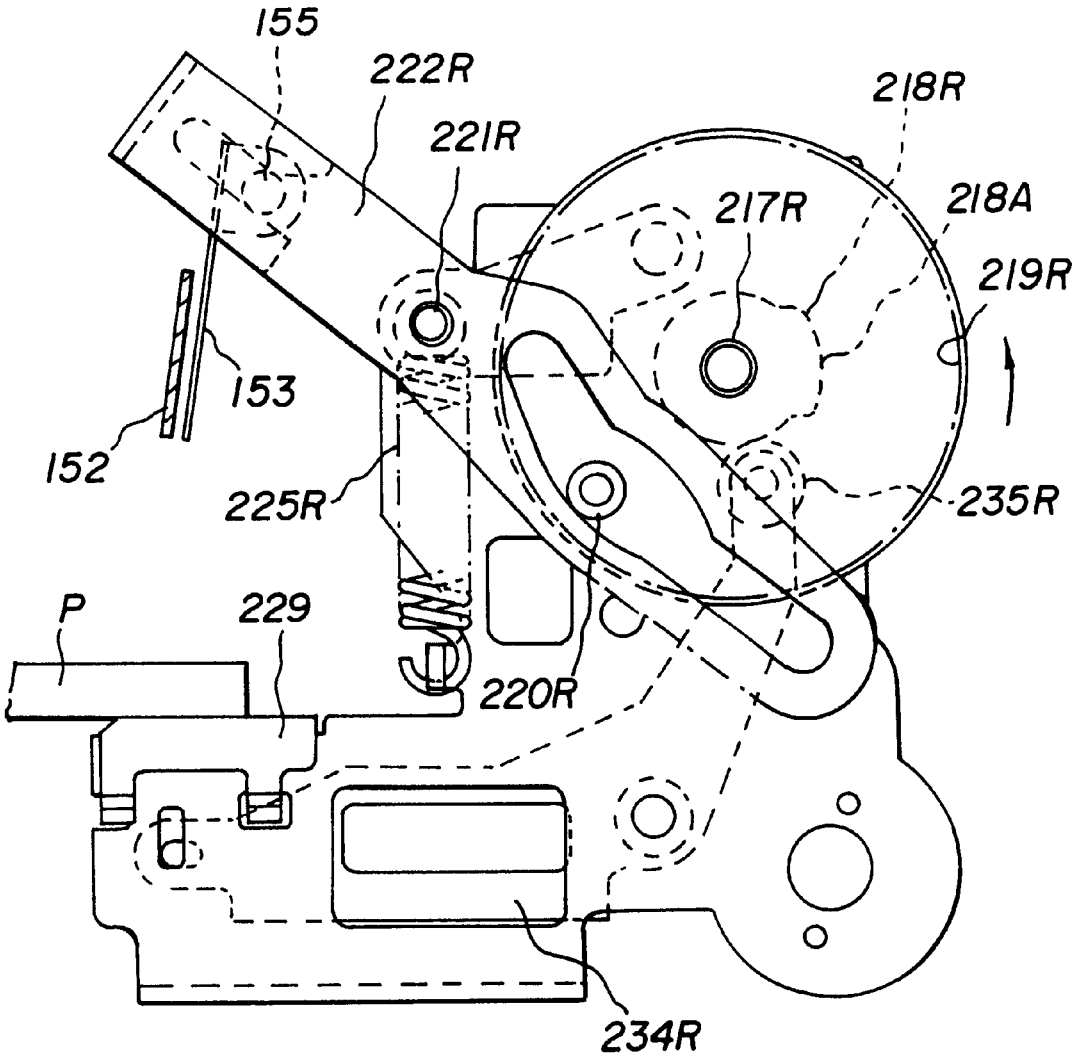
FIG. 39 illustrates the initial state of the driver and the clinch lever.
Figure 40:
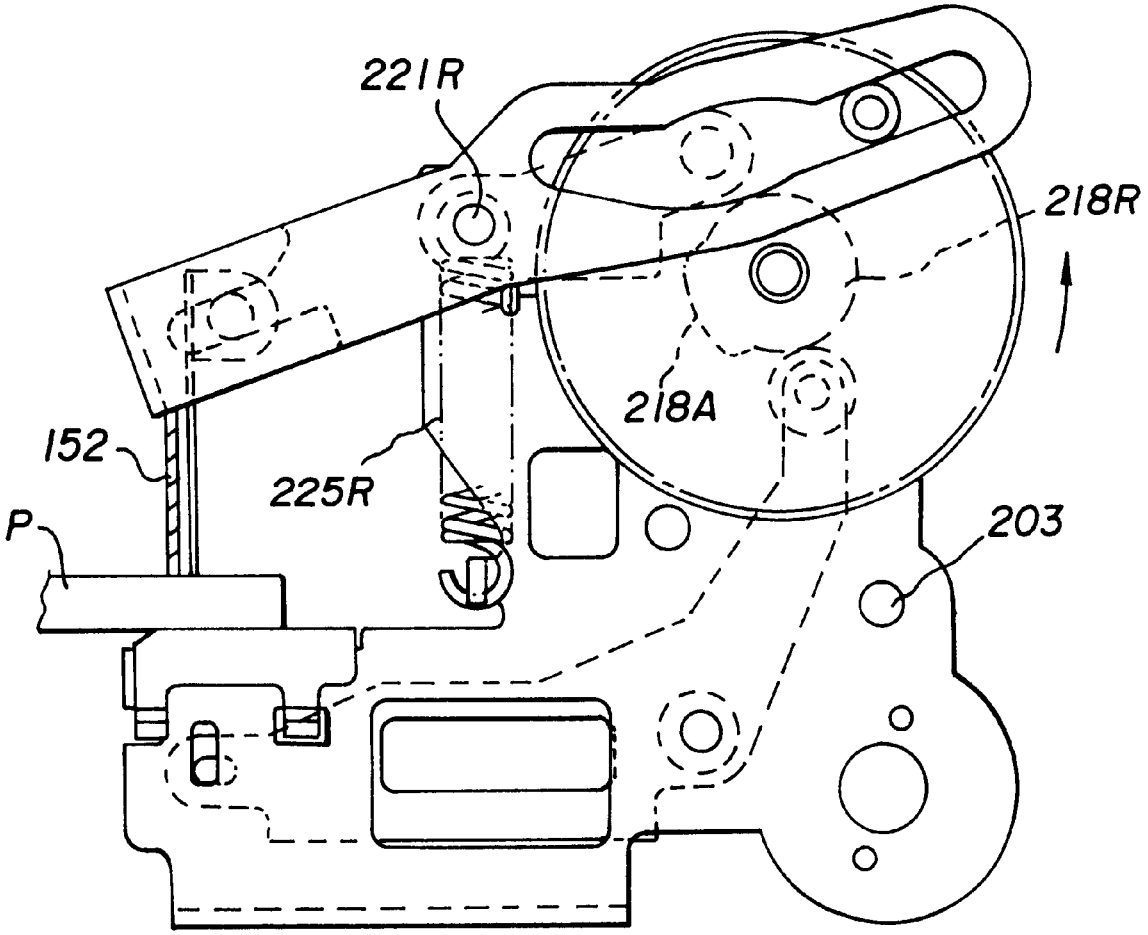
FIG. 40 illustrates the state, in which the driver has pushed the staple into the paper.

If, at the beginning of the stapling action, the sensor 242 of the home position detection means 240 shown in FIGS. 26 and 27 detects the light-blocking member 241, the operation is normal, in which the driver 153 is positioned at the home position. If not, the operation is abnormal. In this case, the motor 210 is rotated in reverse until the sensor 242 detects the light-blocking member 241 in order to bring the driver 153 back to the home position, as shown in FIG. 39.

When the motor 210 is driven in the normal direction with a sheaf of paper P set on the clincher cover 229 (FIGS. 1 and 2), the shaft 212 is rotated via the gears 211 and 213. The shaft 212 protrudes to the left and right from the frame 201, and the rotation of the shaft 212 causes the gears 214L and 214R to rotate, which further causes the driving wheels 219L and 219R via the gears 216L, 216R, 215L, and 215R. The driving pins 220L and 220R move in the cam holes 223L and 223R, and the follower links 222L and 222R rotate downward about the shafts 221L and 221R.

Since the follower links 222L and 222R are connected to the shaft 155 which is fixed to the driver 153, the rotation of the follower links 222L and 222R cause the second frame 202 which holds the attachment 7 to rotate downward about the shaft 203. As a result, the lower end of the sheath 152 or the bottom face of the attachment 7 presses the top face of the paper P. In this state, the rotation of the second frame 202 stops, and the driver 153 starts to descend.

Figure 32:
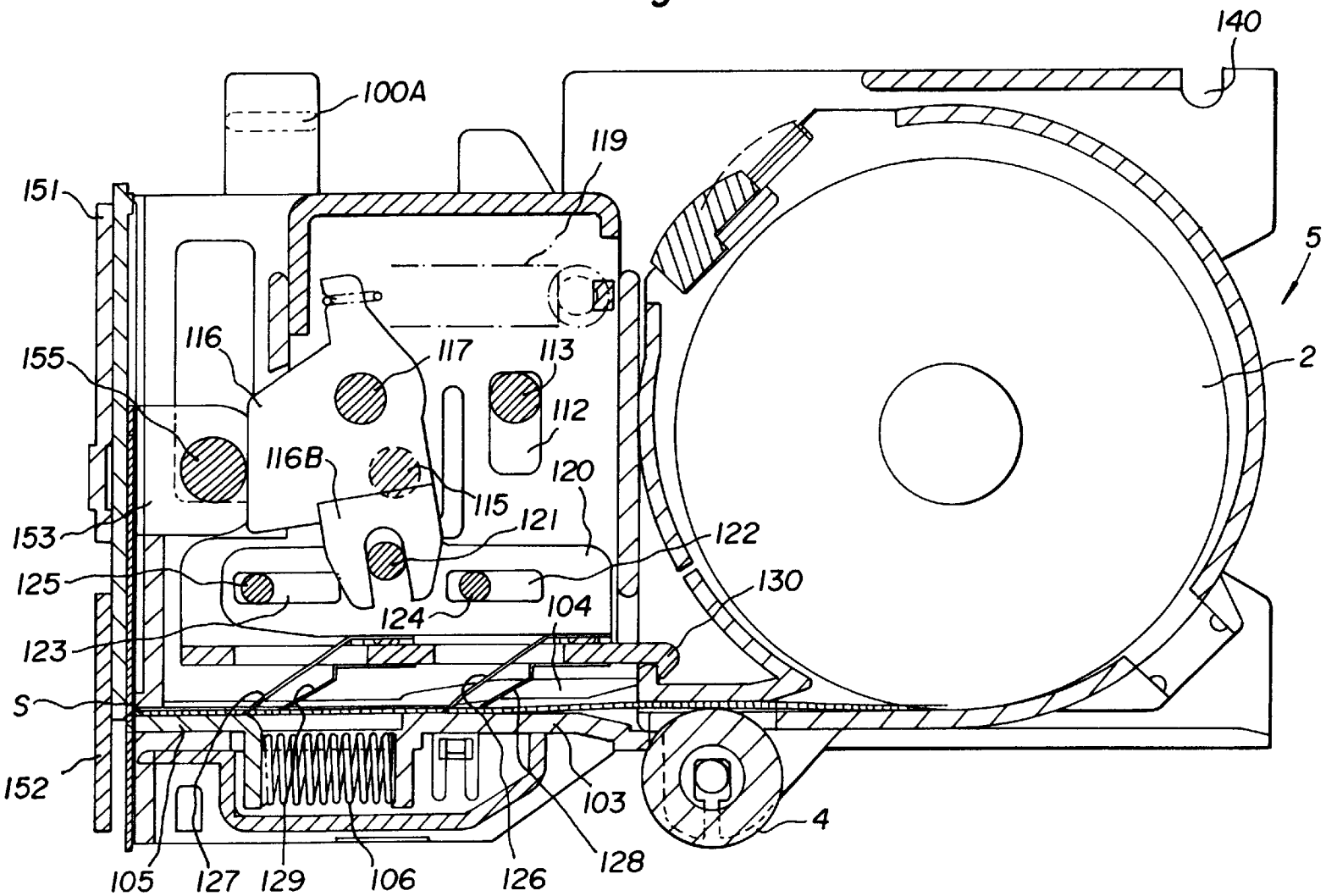
FIG. 32 shows how a staple is fed to the stapling position.
Figure 33B:
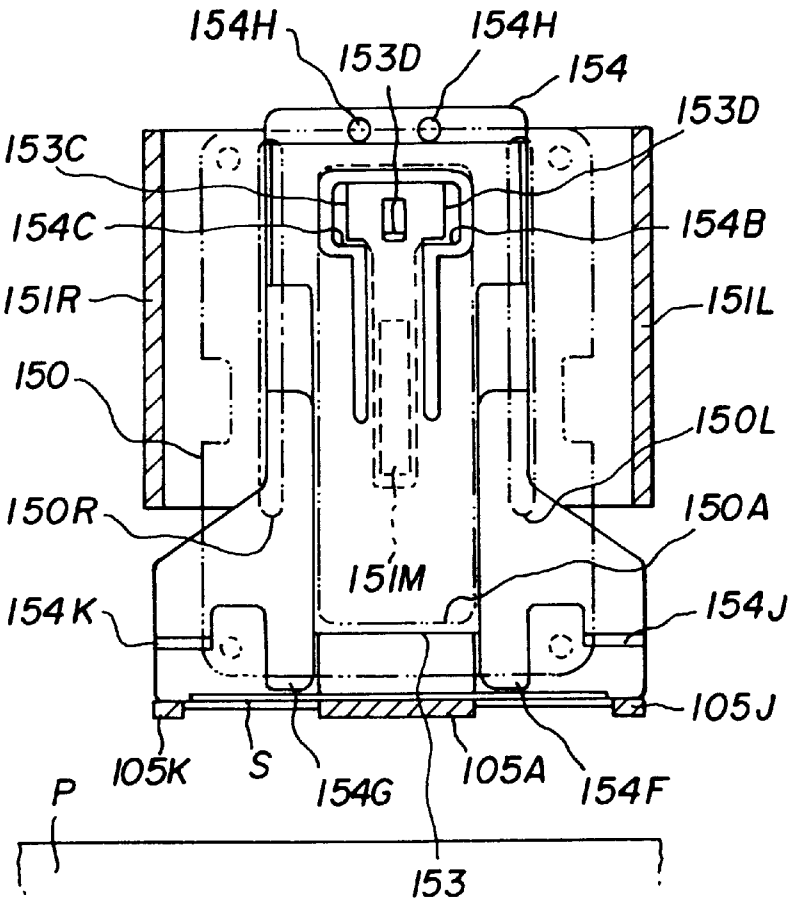
Figure 33A:
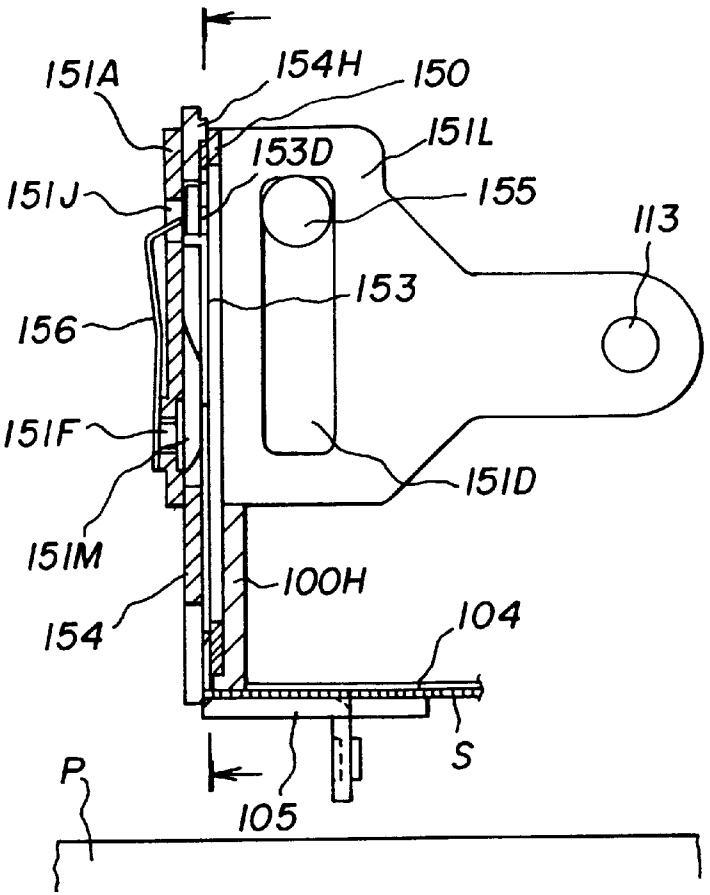

In response to the descent of the driver 153, the shaft 155 pushes the feed arm 116, and causes the feed arm 116 to rotate about the shaft 117, as shown in FIG. 32. The rotation of the feed arm 116 causes the coupling unit 116B to push the coupling pin 121, which further causes the moving arm 120 to move along the guide pins 124 and 125 toward the staple magazine 5. Consequently, the pushing means 126 and 127 move backward on the surface of the rolled staple assembly 2. However, the rolled staple assembly 2 does not go back due to the retracement prevention means 128 and 129.

On the other hand, the projections 153B and 153C provided to the driver 153 push down the wings 154B and 154C of the former 154, and accordingly, the former 154 is lowered together with the driver 153. At this time, the tips of the leaf springs 156L and 156R are in contact with the surface of the former 154.

Figure 34B:
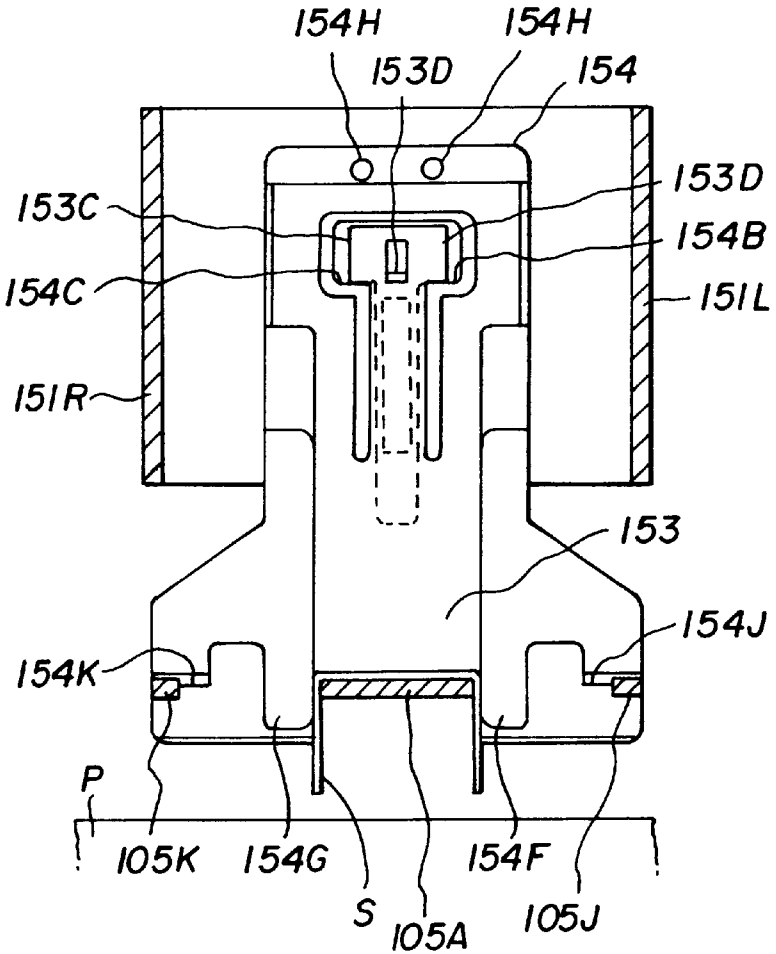
Figure 34A:
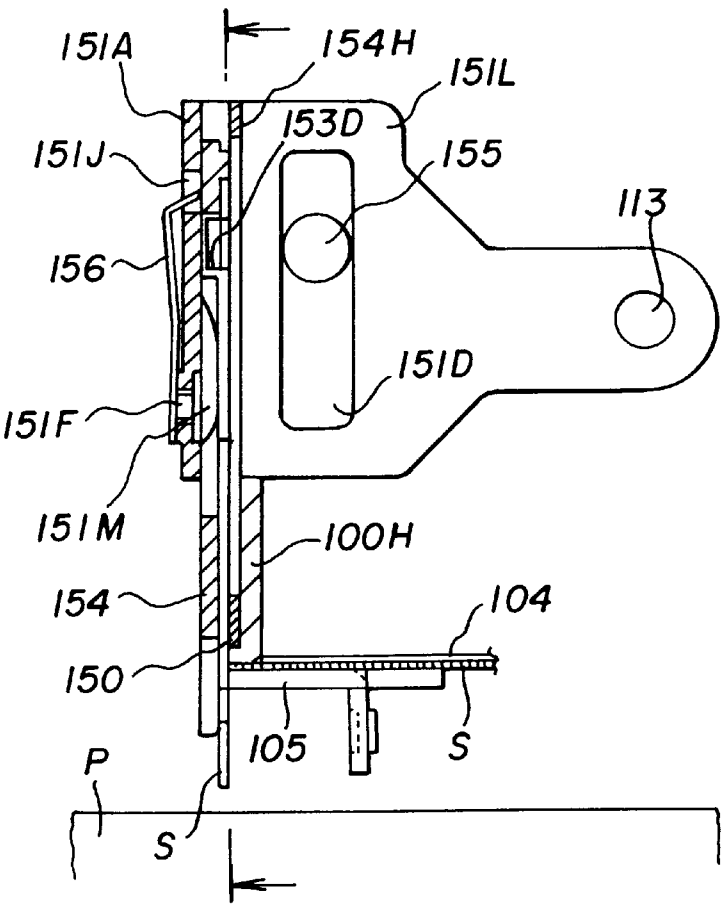

Because the leading staple of the staple assembly 2 is supported on the bending plate 105 directly below the former 154, the both ends of the leading staple supported on the bending plate 105 are bent by the benders 154F and 154G as the former 154 descends, as shown in FIG. 34. At this time, the tips of the leaf springs 156L and 156R slip and fall from the top end of the former 154.

Figure 35B:
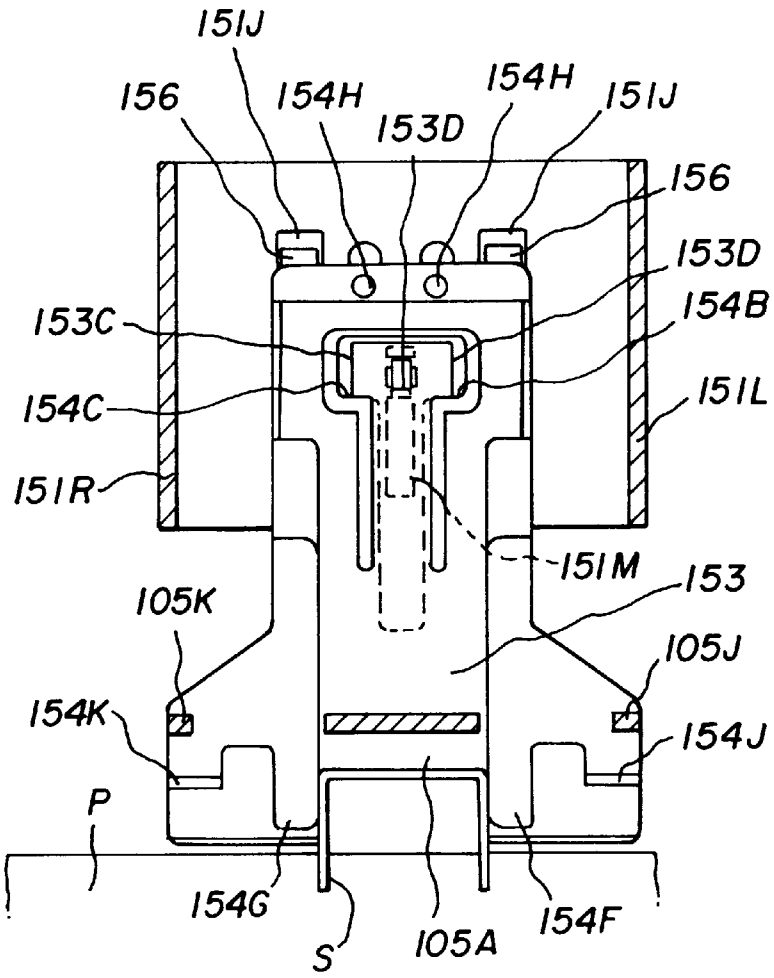
Figure 35A:
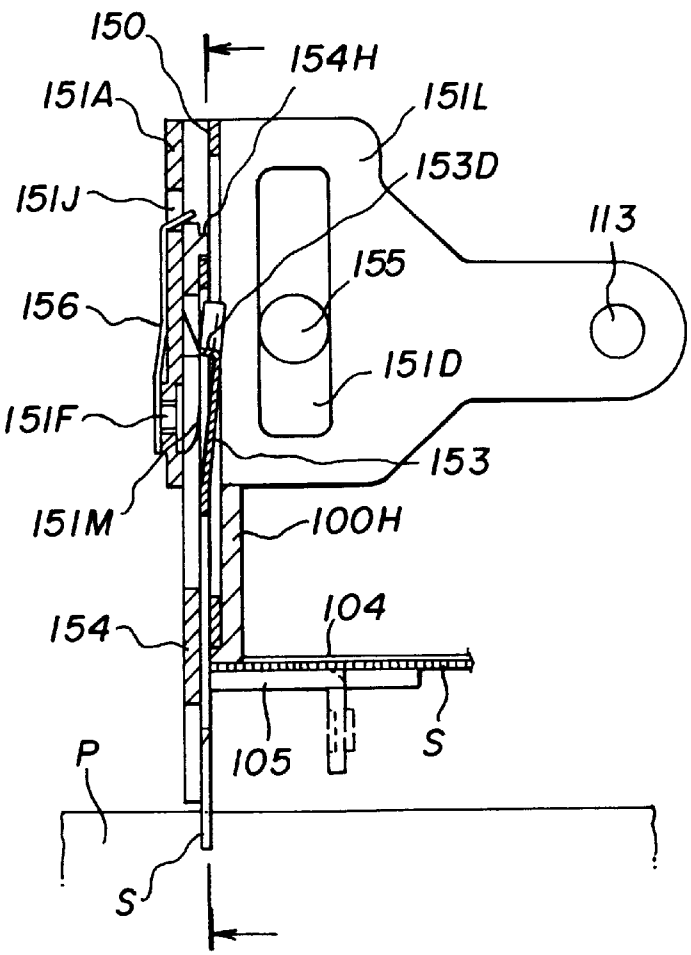
Figure 36B:
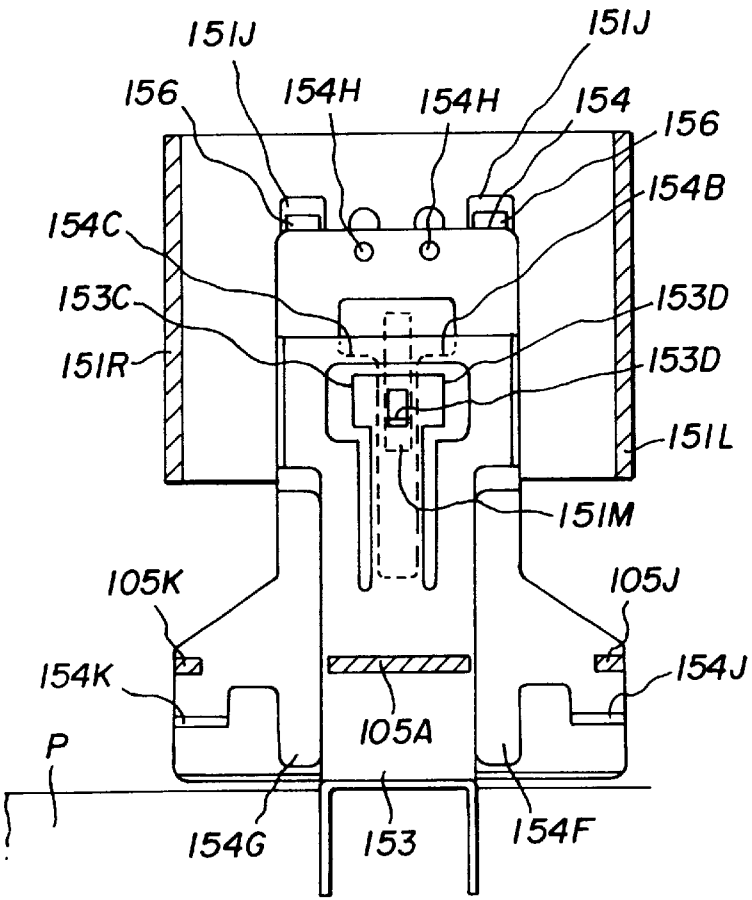
Figure 36A:
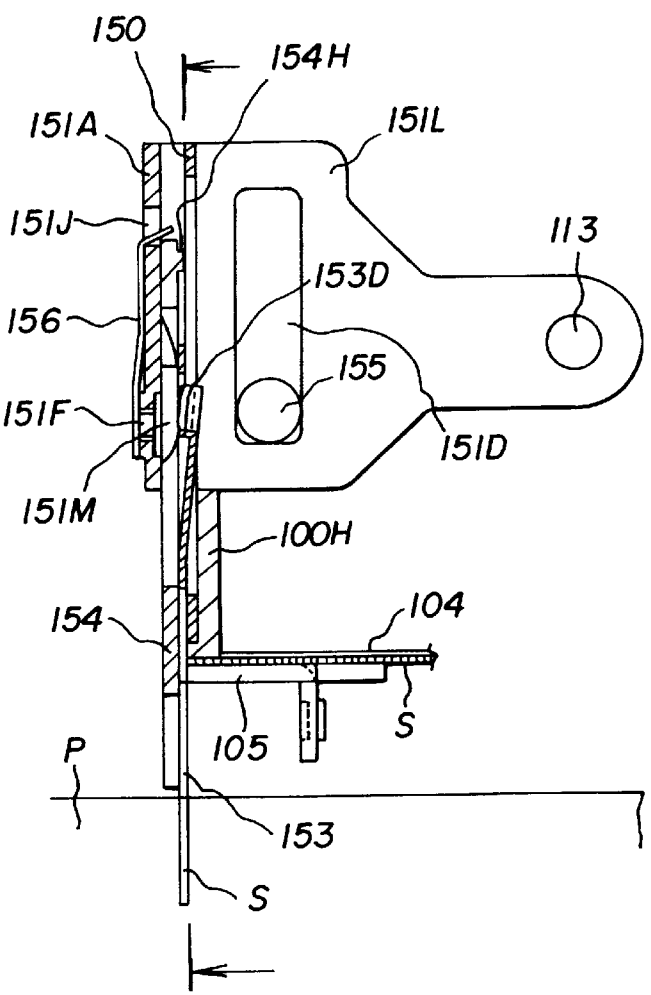

After the both ends of the staple were bent, the projection 153D of the driver 153 steps on the projection 151M, and the swinging portion 153A retreats into the opening 150A of the face plate 150, as shown in FIG. 35. The projections 153B and 153C of the driver 153 are disengaged from the wings 154B and 154C of the former 154, and the driver 153 solely descends to drive the U-shaped staple S, which were bent by the former 154, penetrating through the paper P.

Figure 41:
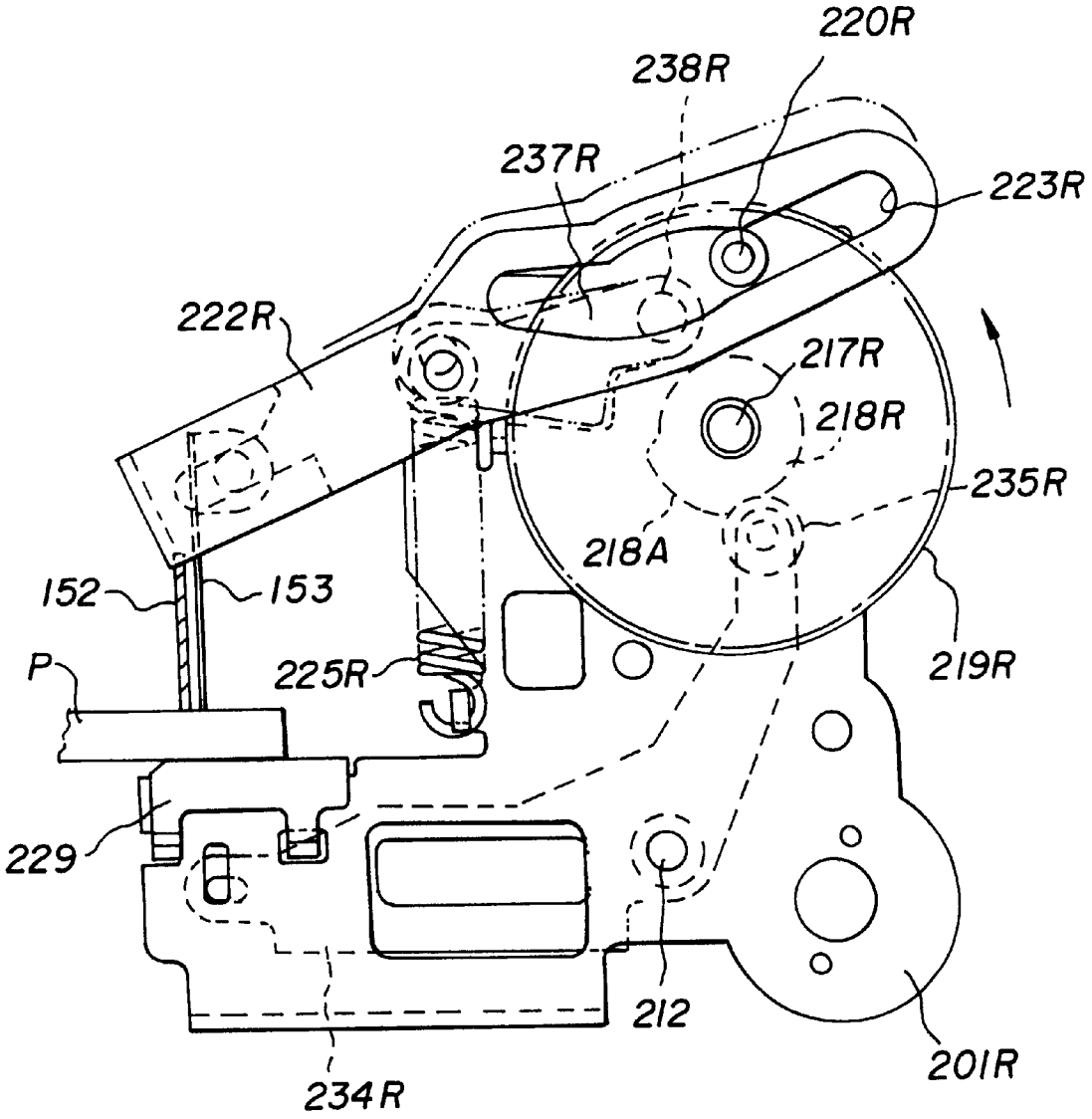
FIG. 41 illustrates the state, in which the moving fulcrum is being activated.
Figure 42:
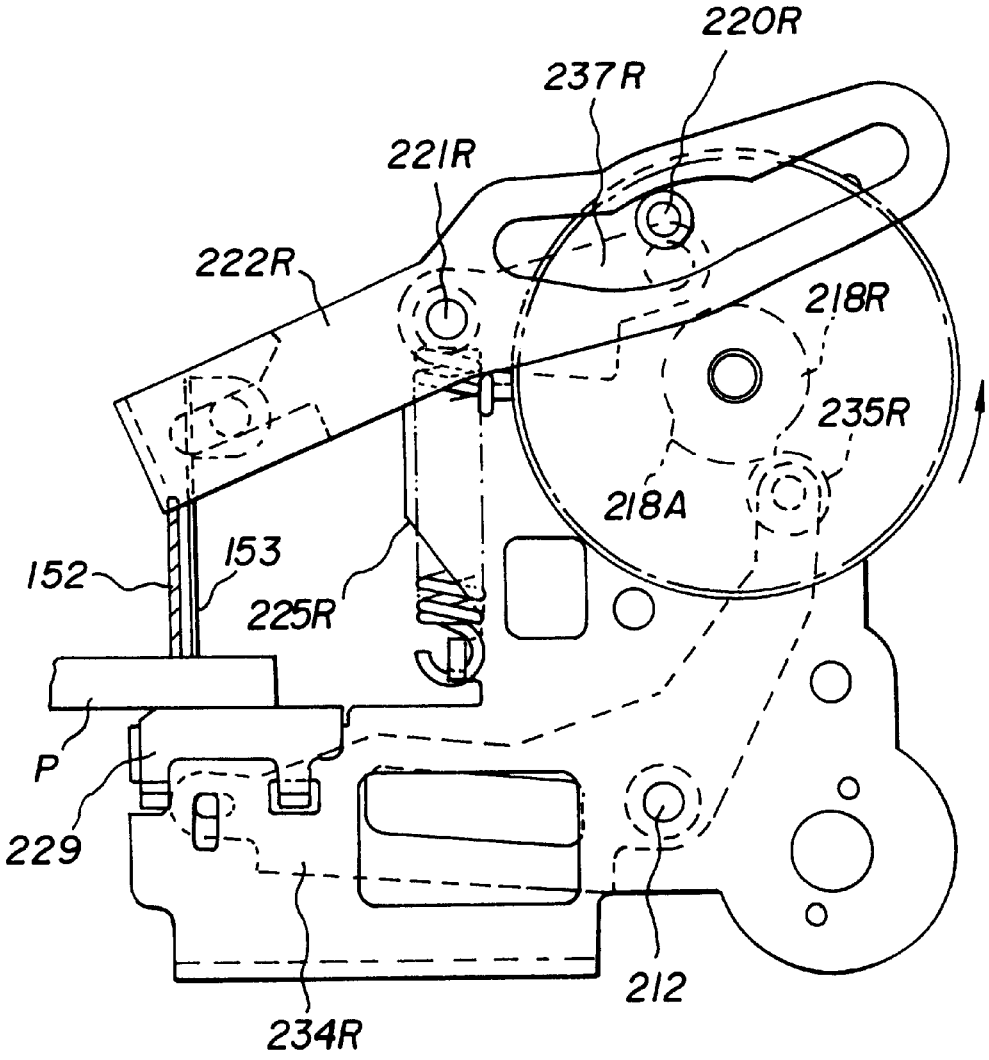
FIG. 42 illustrates the state, in which a clinching action starts.
Figure 43:
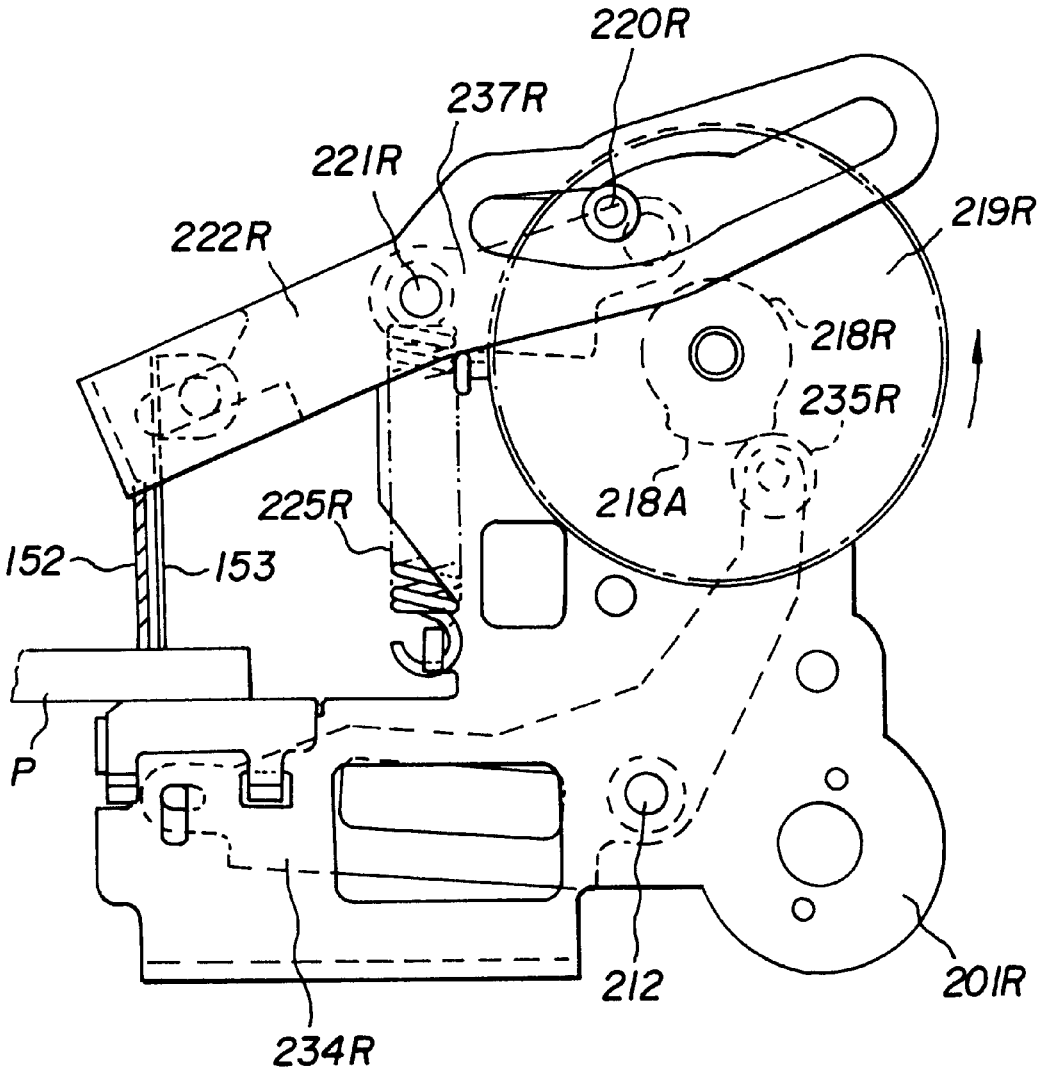
FIG. 43 illustrates the state, in which the clinching action has been completed.
Figure 44:
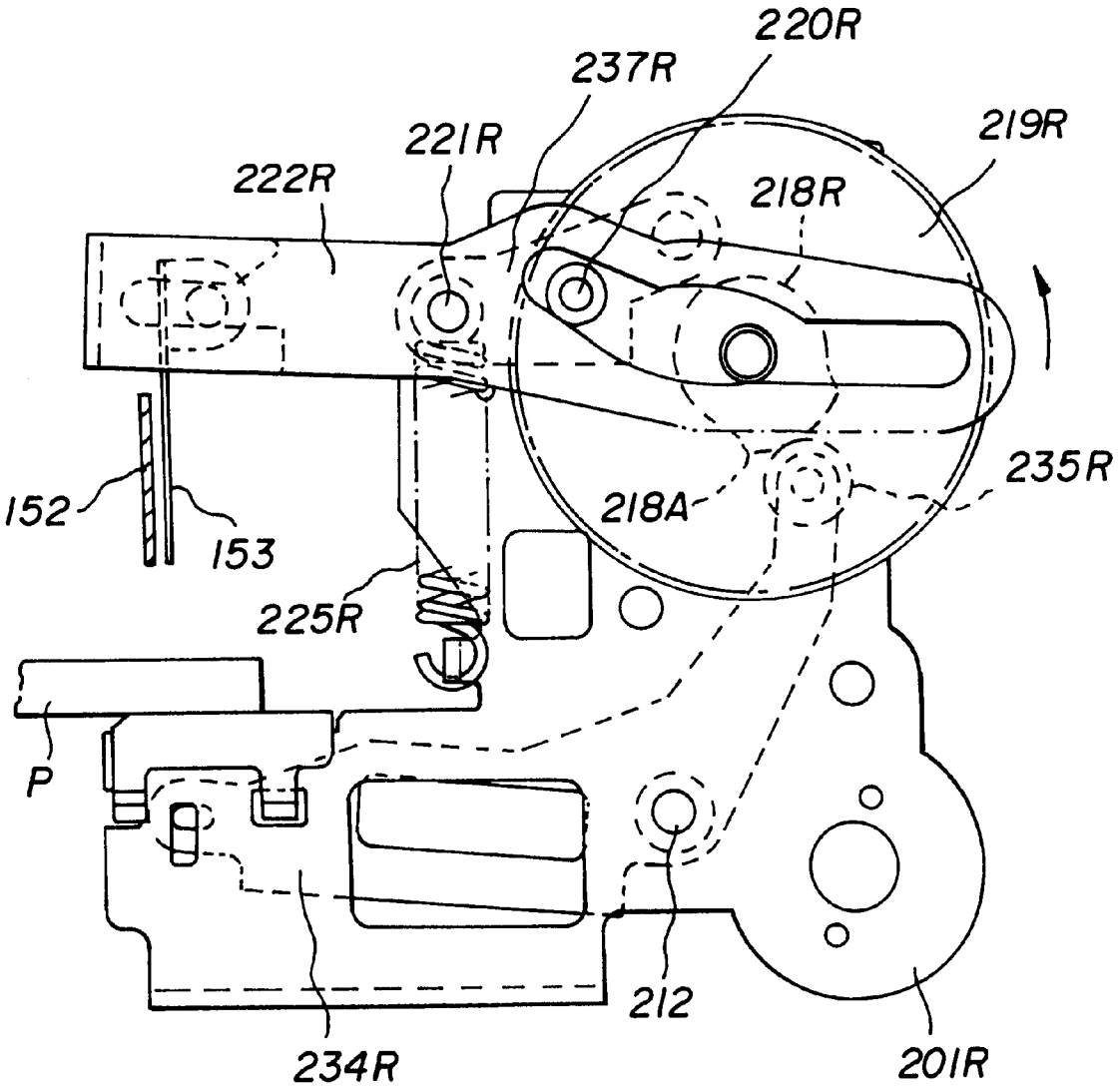
FIG. 44 illustrates the state, in which the driver and the clinch lever return to the initial position.

The follower links 222L and 222R continuously rotate about the shafts 221L and 221R. However, since the driver 153 does not descend any longer, as shown in FIG. 41, the shafts 221L and 221R move upward. In other words, the fulcrums of the follower links 222L and 222R move to prevent the driving means 8 from being locked.

The clinch cams 218L and 218R also rotate in response to the rotation of the driving wheels 219L and 219R. When the follower rollers 235L and 235R of the clinch levers 234L and 234R step onto the swells 218A of the clinch cams 218L and 218R, as shown in FIGS. 37, 38, 42, and 43, the clinch levers 234L and 234R rotate about the shaft 212, and the clincher 233 moves up to push the tips of the U-shaped staple inward until the tips become almost parallel to the paper P.

After the staple is clinched, the driver 153 starts to move up. The former 154 also tries to go up through friction resistance. However, since the top end of the former 154 is limited by the tips of the leaf springs 156L and 156R, the former 154 does not move up. As the driver 153 moves up, the projection 153D passes the projection 151M, and the top end 153H of the driver 153 strikes the stoppers 154H of the former 154. The driver 153 continuously goes up, and the former 154 is also pulled up due to the engagement between the top end 153H of the driver 153 and the stoppers 154H, pushing away the tips of the leaf springs 156L and 156R. Thus, the driver 153 and the former 154 return to the home position, with the tips of the leaf springs 156L and 156R in touch with the side surface of the former 154.

The upward movement of the driver 153 causes the shaft 155 to move up. Consequently, the feed arm 116 is released, as shown in FIG. 9, and it rotates about the shaft 117 due to the return force of the spring 119, which further causes the moving arm 120 to move forward. The moving arm 120 moves only a distance corresponding to the length of a staple because the pushing means 126 and 127 are engaged with the groove of the staple assembly 2.

When the follower roller 235R passes the swell 218A in response to the rotation of the clinch cams 218L and 218R, the clinch levers 234L and 234R retreat about the shaft 212, and the clincher 233 moves downward to the home position.

If the sensor 242 detects one end 241A of the light-blocking member 241 during the movement of the clincher 233 to the home position, the motor 210 is stopped.

By repeating the above-described operations, staples are supplied one by one to the stapling position, and a sheaf of paper P is successively stapled by a staple S.

If the number of staples left in the staple magazine 5 is decreasing, and the rear end of the rolled staple assembly 2 has passed one end 133A of the detection arm 133, then the detection arm 133 rotates about the shaft 113, and the other end 133B of the detection arm 133 is apart from the sensor 239. As a result, the rear end of the staple assembly 2 is detected. A detection signal is generated in response to the detection of the rear end to inform of the short of staples. The detection signal is transmitted to the controller of the sorter or the finisher, and the stapling operation is interrupted after a required number of staples are shot.

[Second Embodiment]

In the first embodiment, the staple magazine 5 has a feed roller 4 and a case 3 which are combined into one unit. In the second embodiment, the feed roller 4 is separated from the staple magazine 5. As shown in FIGS. 45 through 47, a staple magazine 50 is designed so as to accommodates a rolled staple assembly 2 and to be attached to and detached from a roller unit 41 having a feed roller 40 for feeding the leading edge of the rolled staple assembly 2 to a prescribed position.

The staple magazine 50 is made of, for example, paper of a synthetic resin and shaped in a box. The box 50H has a hole 51 in the side wall, which is concentric with the rolled staple assembly 2. The box 50H also has an opening 52 in the bottom wall, through which the rolled staple assembly 2 comes into contact with a feed roller 40 which gives a driving force to the rolled staple assembly 2 to feed the leading staple to the preselected position. The bottom wall of the box 50H also has a fixing hole 54 for fixing the rolled staple assembly with a fixing means, such as a tape 53. The box 50H further has an opening port 55, which allows the leading staple fed by the feed roller 40 to stick out from the box 50H, and a pressing leaf 56 for pressing the leading staple which is being fed from the rolled staple assembly 2. If the staple magazine 50 is made of a bio-decomposable resin, it will be environmentally friendly.

The fixing means 53 fixes the rolled staple assembly 2 onto the bottom face of the box 50H in order to prevent the leading staple of the rolled staple assembly 2 from retracing into the staple magazine 5 from the opening port 55 when the staple magazine 5 is carried prior to the actual use. Accordingly, the fixing means is not limited to a tape, but other devices, such as a clip or stopper, may be used to temporarily fix the rolled staple assembly until the staple magazine 5 is inserted into the stapler apparatus 1.

FIG. 46 illustrates the roller unit 41, which has side walls 42 opposed to each other. Each of the side walls 42 has staple guides 43 and 44. The staple guide 43 has an opening 43A for allowing the rolled staple assembly 2 to come into contact with the feed roller 40, and an opening 43B for peeling the tape 53 off from the bottom face of the staple magazine 50. The other staple guide 44 cooperates with the feed roller 40, and functions as a feeding means.

Each of the staple-guide 43 has a retainer for retaining the rotational shaft 40A of the feed roller 40. A coupler 44A, which corresponds to a coupler 32 in the first embodiment, is provided to the leading edge of the staple guide 44 in order to connect the staple magazine 50 with the attachment 7. The roller unit 41 has a front stopper 46, which extends between the upper corners of the side walls 42, and a rear stopper 47, which extends between the lower corner of the side walls 42. The stoppers 46 and 47 fix the staple magazine 50 when it is loaded on the roller unit 41.

With this arrangement, when the staple magazine 50 is mounted on the roller unit 41, the staple guides 44 are inserted into the staple magazine 50 from the opening 55, and the rear face of the leading staple of the rolled staple assembly comes into contact with the feed roller 40. At the same time, the pressing leaf 56 is apart from the top surface of the leading staple of the rolled staple assembly 2.

The staple magazine 50 is fixed into the roller unit 41 by the front stopper 46 and the rear stopper 47. Then, the tape 53 is peeled off from the bottom of the staple magazine 50 via the opening 43B, thereby releasing the rolled staple assembly 2.

Then, the roller unit 41 which carries the staple magazine 50 is inserted in the attachment 7, as in the first embodiment. By lowering the staple feeder 110, the coupling arm 130 is brought into contact with the coupler 44A, and the roller unit 41 is fixed to the attachment 7.

The subsequent stapling action is the same as in the first embodiment. If the rolled staple assembly 2 accommodated in the stapler magazine 50 has run out, the staple feeder 110 is pulled up by holding the grip 110G in order to unlock the roller unit 41. Then, the roller unit 41 is detached from the attachment 7, and the staple magazine 50 is removed from the roller unit 41. The roller unit 41 is repeatedly used, while the staple magazine 50 may be discarded or recycled.

[Third Embodiment]

Figure 48:
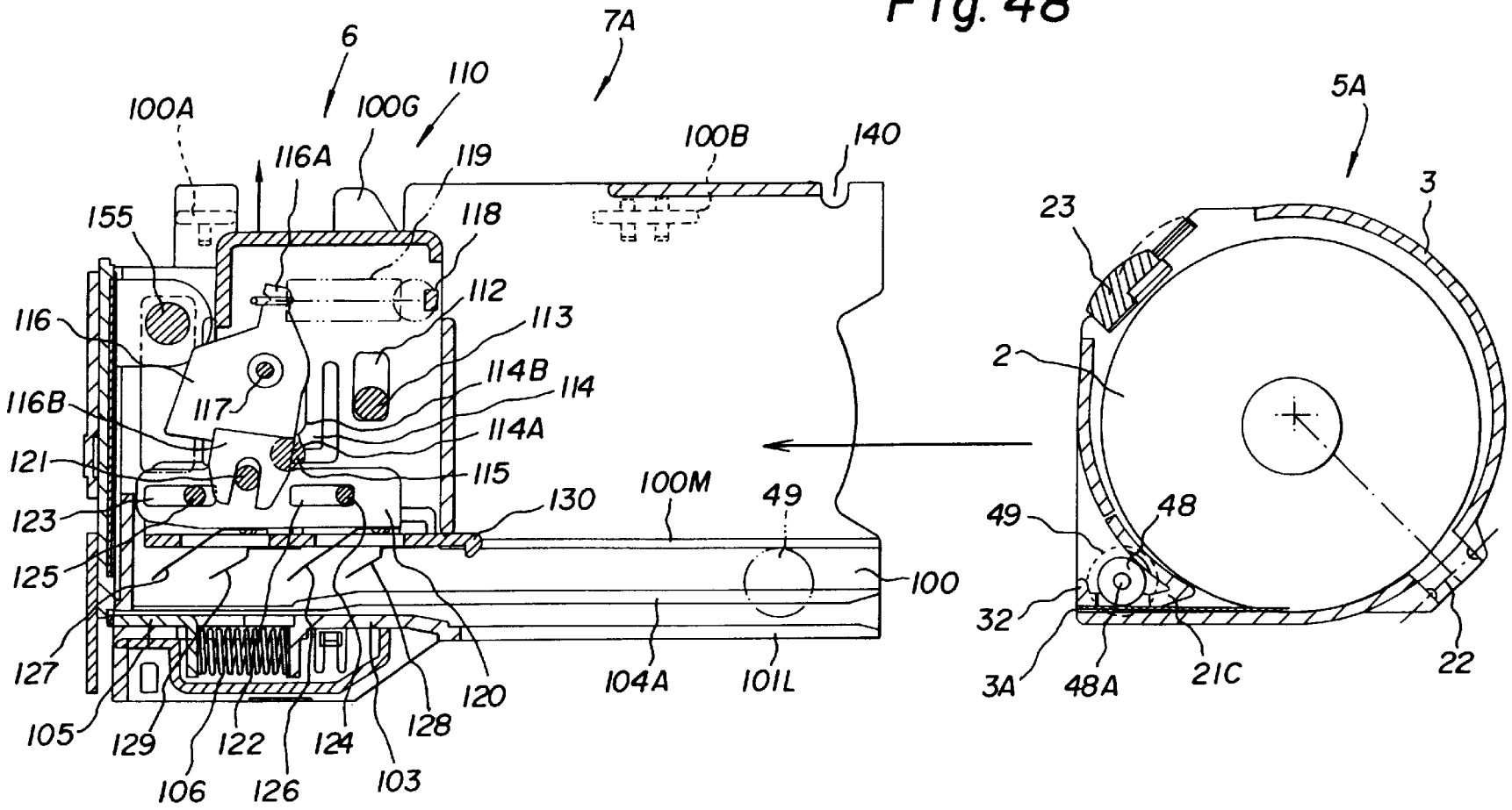
FIG. 48 illustrates the staple magazine and the attachment according to the third embodiment of the invention.
Figure 49:
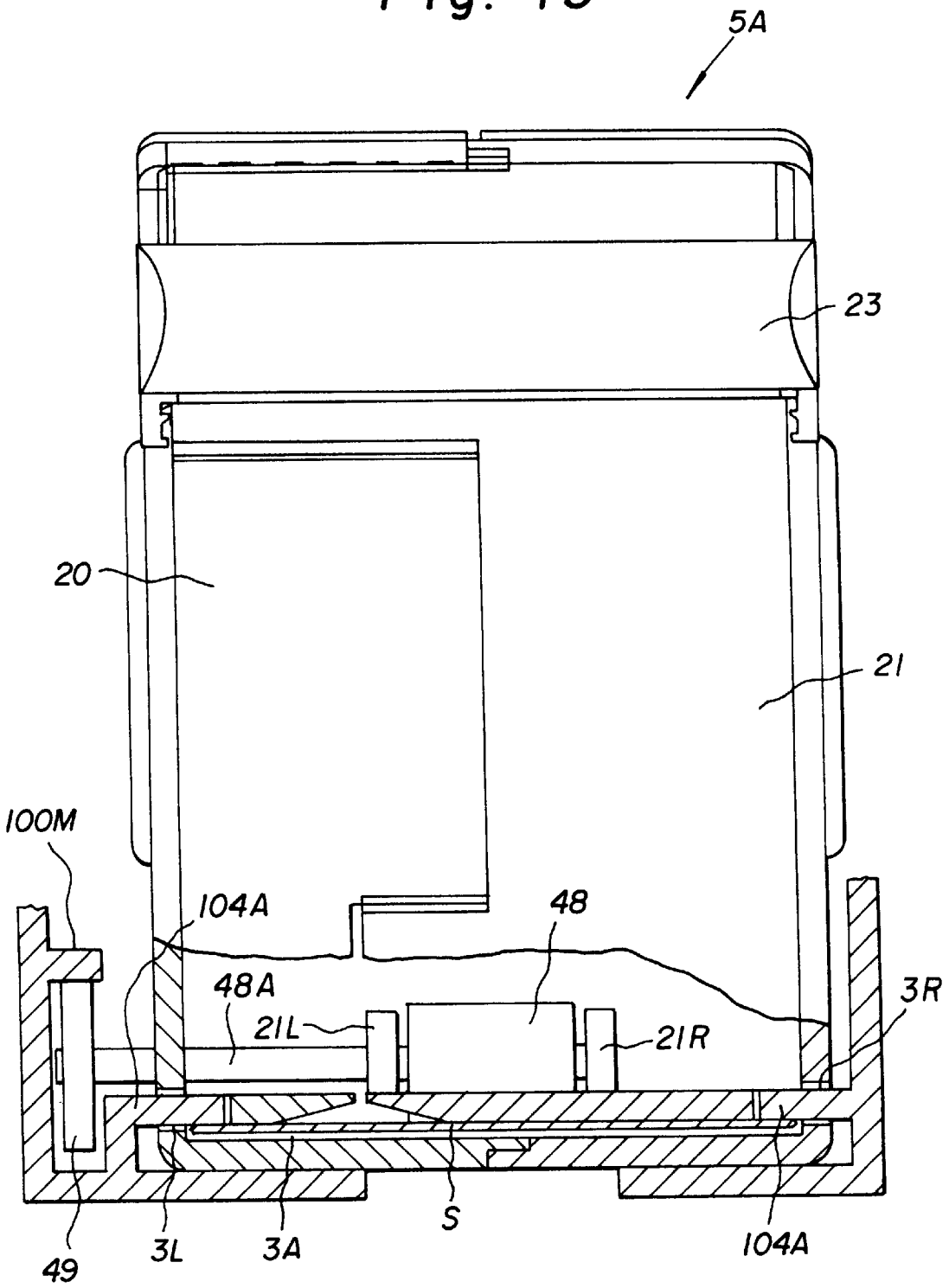
FIG. 49 is a front view of the staple magazine according to the third embodiment of the invention.

In the first embodiment, the feed roller 4 is in contact with the rear face of the leading staple of the staple assembly 2. In this third embodiment, a rolling member, such as a feed paddle 49, is provided to the lower front of the staple magazine 5A in such a manner that the feed paddle 5A comes into contact with the top face of the leading staple of the staple assembly 2, as shown in FIGS. 48 and 49. The rotational axis 48A of the paddle 48 is supported by supporters 21L and 21R formed on the staple guide 21C. The rolling member may be a roller, a belt, or the like.

One end of the rotational axis 48A is provided with a roller 49 for driving the paddle 48.

An attachment 7A, in which the staple magazine 5A is to be inserted, has a roller guide 100M for rotating the roller 49 of the staple magazine 5A in a staple-feeding direction, and a pair of control guides 100A for guiding the leading staple pushed forward by the paddle 48 which rotates together with the roller 49 in response to the insertion of the staple magazine 5A. The staple magazine 5A has guide slits 3L and 3R on the side walls in order to receive the control guide 104A.

In FIGS. 48 and 49, the same elements as those shown in FIGS. 4 through 8 are indicated by the same numerical references, and explanation for these elements will be omitted.

In the first and second embodiments, when the attachment 7 which carries the staple magazine 5 or 50 is inserted in the stapler body 9, the leading staple of the rolled staple assembly 2 is pushed forward by the rotation of the feed roller 4 of 40. However, in the third embodiment, the leading staple of the rolled staple assembly 2 is sent out by the rotation of the paddle 48 during the insertion of the staple magazine 5A in the attachment 7A.

[Fourth Embodiment]

Figure 50B:
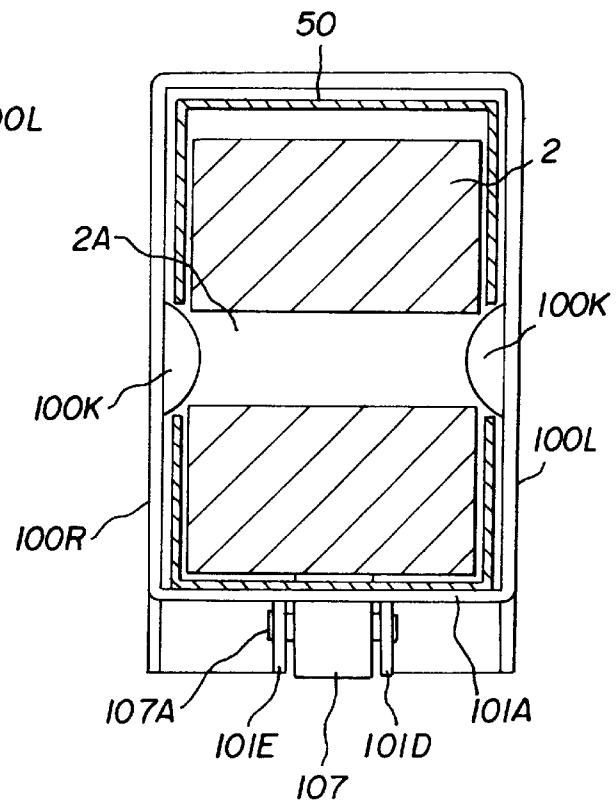
FIG. 50(B) is a cross-sectional rear view.
Figure 50A:
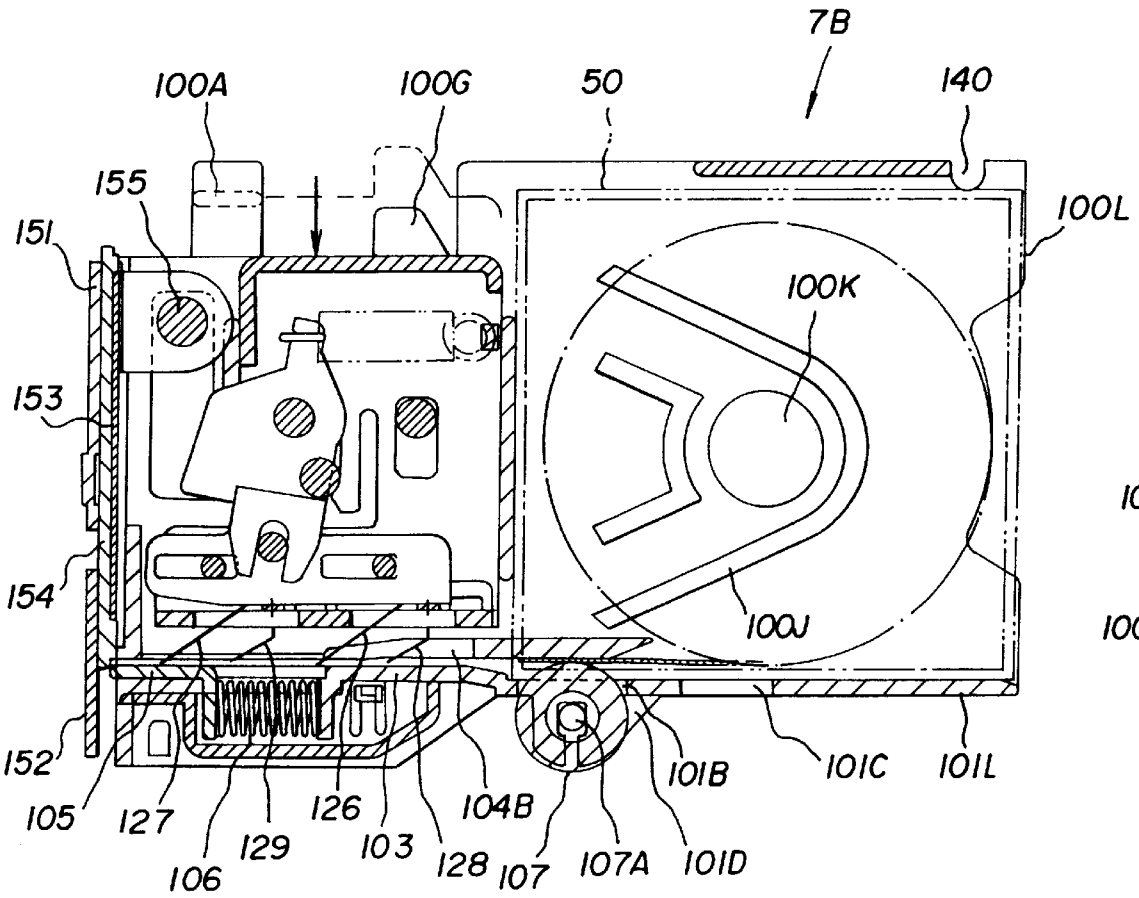
FIG. 50(A) is a cross-sectional side view.
Figure 51:
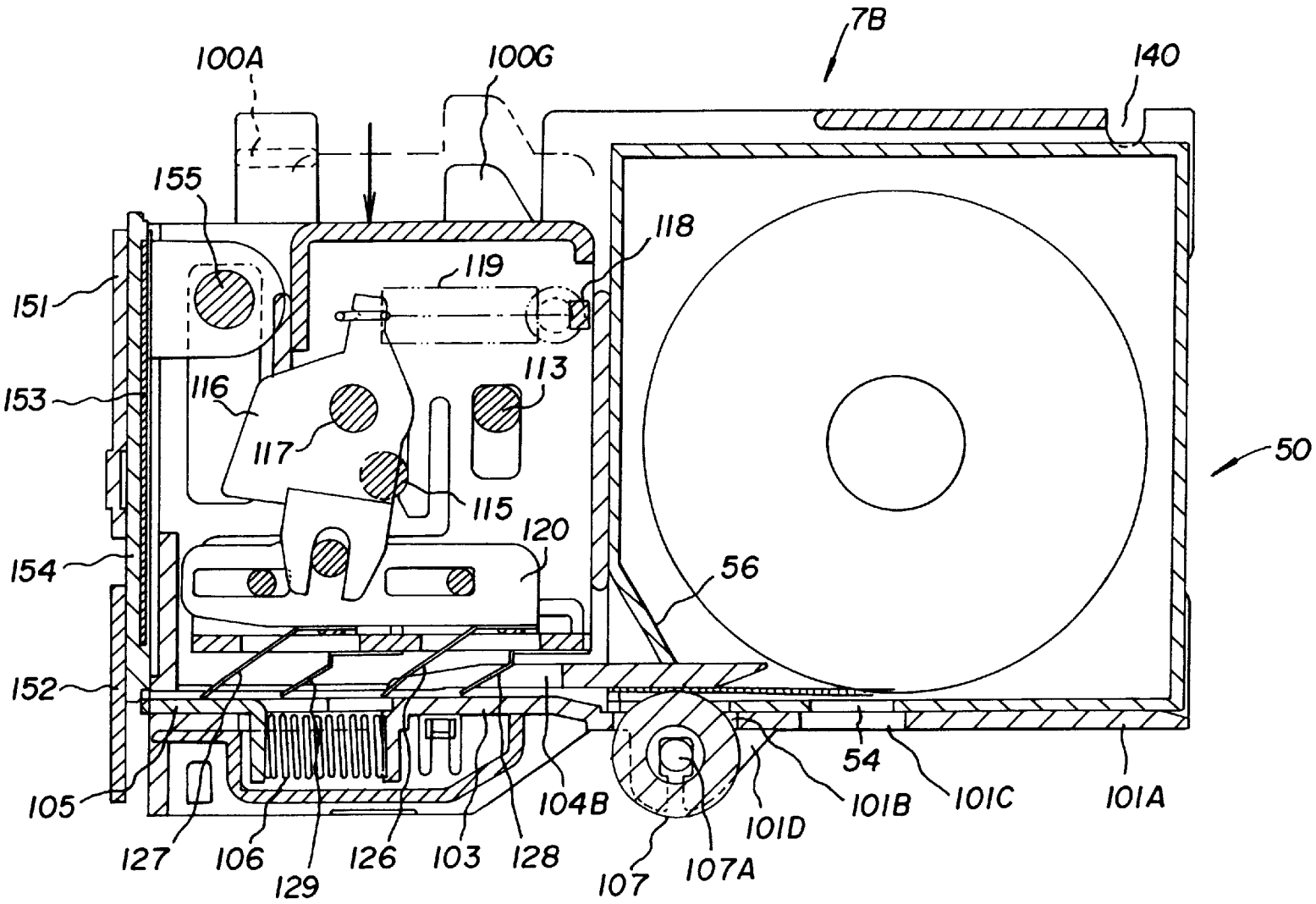
FIG. 51 illustrates how the staple magazine is received by the attachment according to the fourth embodiment of the invention.
Figure 52:
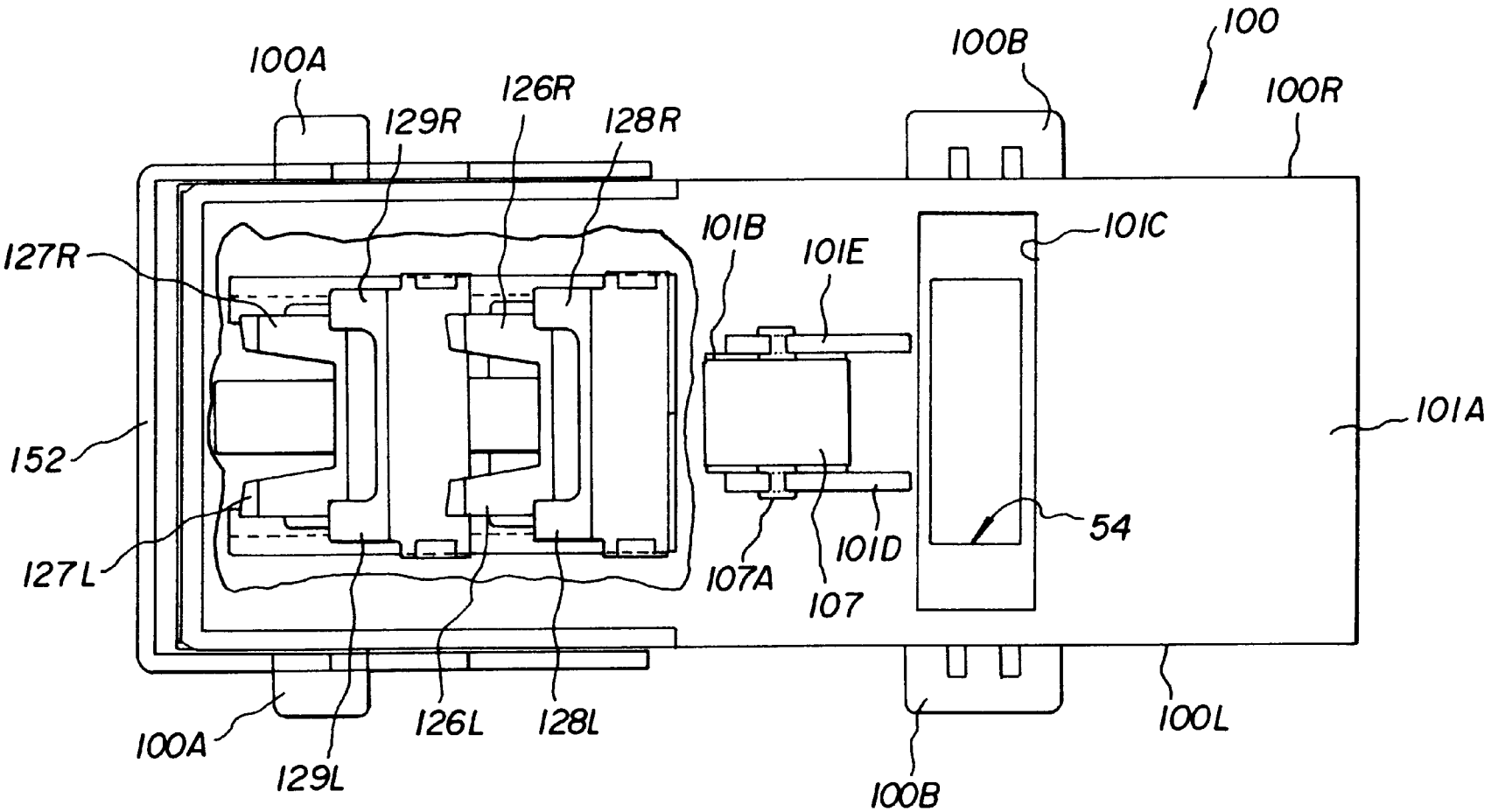
FIG. 52 is a bottom view of the attachment according to the fourth embodiment of the invention.

As shown in FIGS. 50 through 52, in the fourth embodiment, a feed roller 107 is provided to the attachment 7B, and the attachment 7B is designed so as to receive the staple magazine 50 illustrated in the second embodiment. An opening 101B is formed in the bottom wall 101A of the attachment 7B in order to allow the feed roller 107 to touch with the rolled staple assembly 2. An opening 101C is also formed in the bottom wall 101A of the attachment 7B for the purpose of allowing the user to peel off the tape 53 from the bottom face of the staple magazine 50.

A pair of retainers 101D and 101E are attached to the bottom face of the attachment 7B in order to hold the rotational shaft 107A of the feed roller 107. The attachment 7B also has a control guide 104B which is to be inserted in the opening port 55 of the staple magazine 50. The control guide 104B comes into contact with a surface of the leading staple, which is opposite to the surface sliding on the feed roller 107.

Each of the side walls 100L and 100R of the frame 100 of the attachment 7B is provided with an elastic support arm 100J and a conical or hemispherical projection 100K, which project inside the frame 100. The conical or hemispherical projections 100K are received by the hole 51 and the roll hole 2A of the staple magazine 50, as shown in FIG. 50(B).

In FIGS. 50 through 52, the same elements as those shown in the first embodiments are denoted by the same numerical references, and explanation for them will be omitted.

[Fifth Embodiment]

Figure 53B:
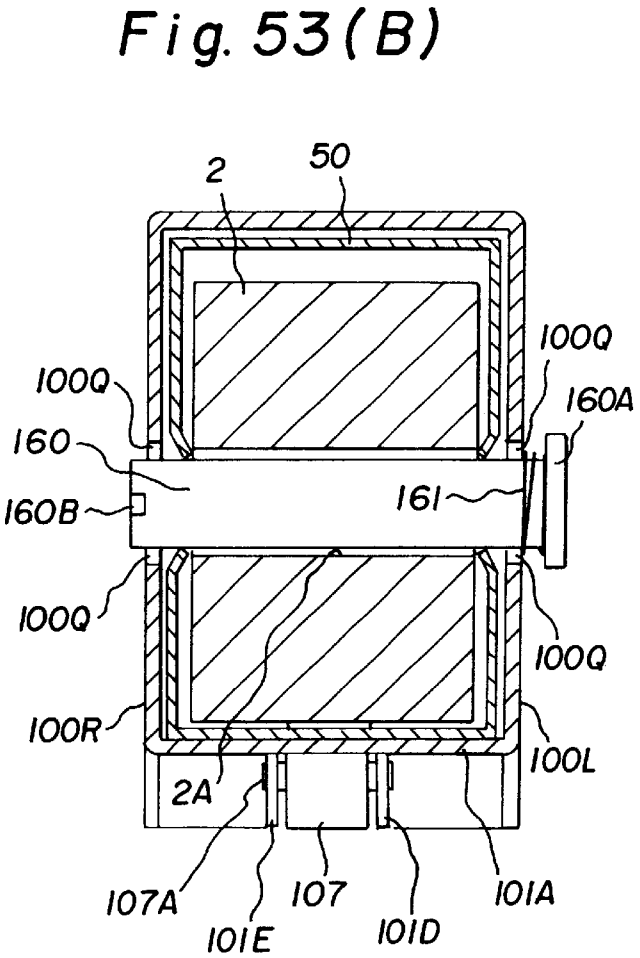
FIG. 53(B) is a partial cross-sectional rear view.
Figure 53A:
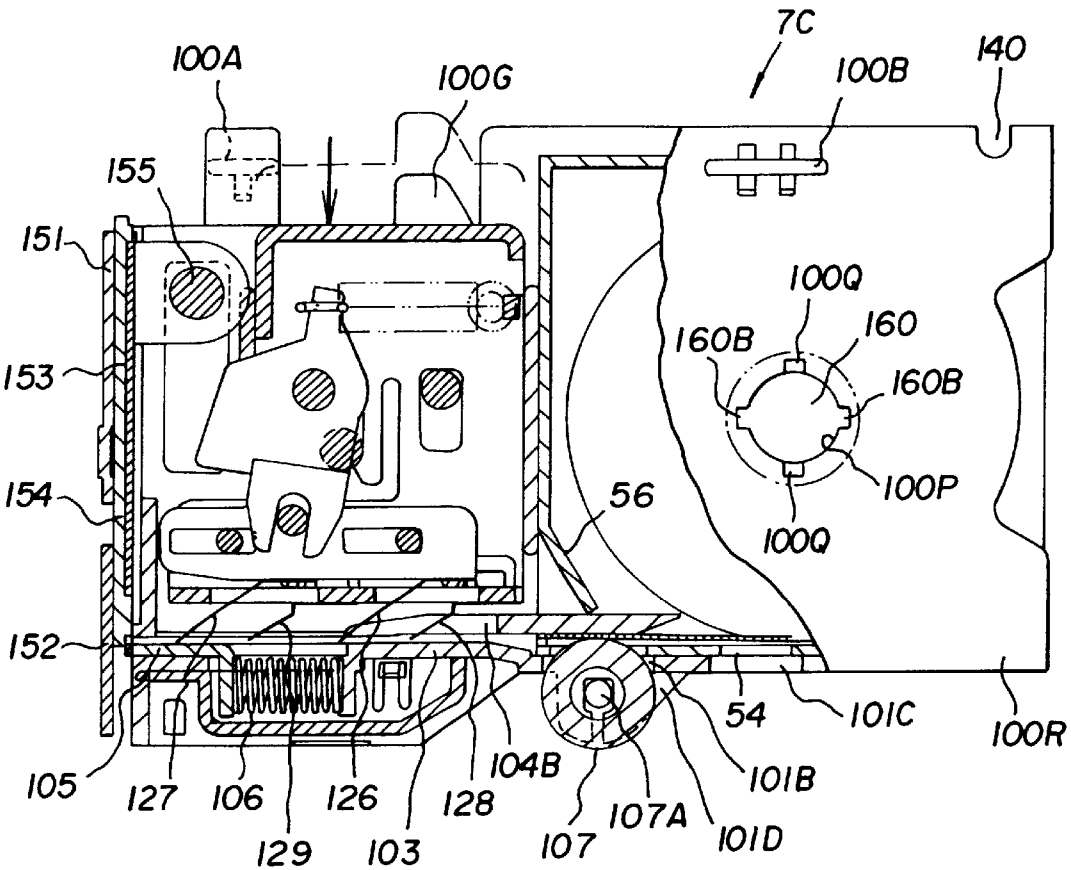
FIG. 53(A) is a cross-sectional side view.
Figure 54A:
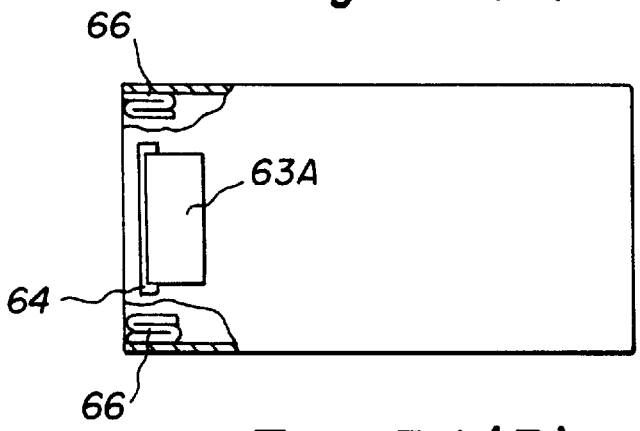
FIG. 54(A) is a top view.
Figure 54B:
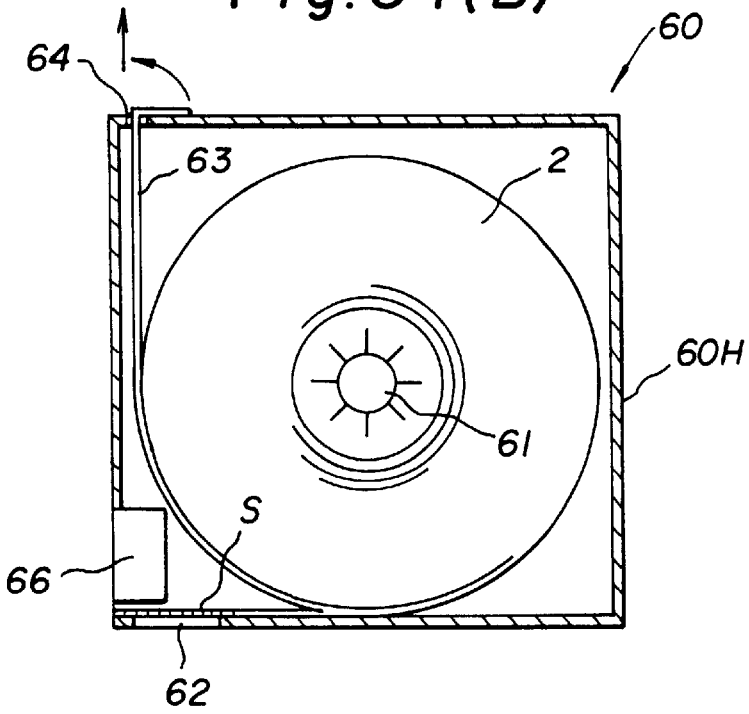
FIG. 54(B) is a cross-sectional view.
Figure 54D:
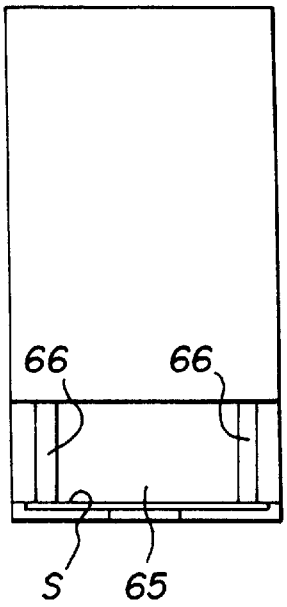
FIG. 54(D) is a front view.
Figure 54C:
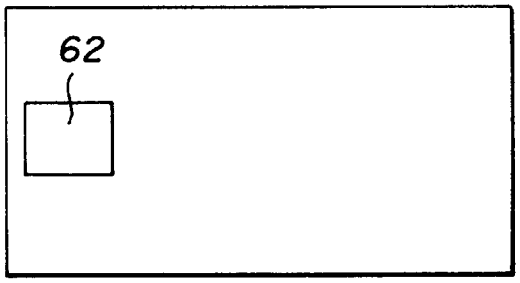
FIG. 54(C) is a bottom view.

As shown in FIG. 53, each of the side walls 100L and 100R of the frame 100 of the attachment 7C has a shaft hole 100P in order to fix the staple magazine 50 inserted in the attachment 7C. The shaft holes 100P of the attachment 7 are aligned with the roll hole 2A of the staple magazine 50, and a shaft 160 in inserted penetrating through the roll hole 2A. One end of the shaft 160 is provided with a flange 160A and a spring 161, and the other end of the shaft 160 is provided with a pair of locks 100B which are perpendicular to the shaft axis.

The shaft hole 100P of each of the side walls 100L and 100R has lock recesses 100Q which receive the locks 100B when the shaft 160 is inserted in the shaft hole 100P. By rotating the shaft 160 to disengage the locks 160B from the recesses 100Q, the shaft 160 is fixed to the frame 100.

In FIG. 53, the same elements as those shown in the fourth embodiment are denoted by the same numerical references, and explanation for them will be omitted.

[Sixth Embodiment]

FIG. 54 illustrates the staple magazine 60 according to the sixth embodiment. The staple magazine 60 is made of, for example, paper or a synthetic resin, and shaped in a box. Recesses 61 are formed in the side walls of the box 60H in order to support the center of the rolled staple assembly 2. The bottom wall of the box 60H has an opening 62, which allows the feeding unit, such as the feed roller 107 of the fourth embodiment, to come into contact with the rolled staple assembly 2. The feeding unit receives a driving fourth for sending the rolled staple assembly 2 forward. The top wall of the box 60H has an opening 64 which allows the user to pull out the expansion prevention sheet 63. The front wall of the box 60H has a feeding port 65, through which the staples are supplied to the stapling position.

A portion of the expansion prevention sheet 63 is rolled together with the rolled staple assembly 2. One end 63A of the expansion prevention sheet 63 is fixed to the top wall of the box 60H by adhesive, thereby preventing the rolled staple assembly 2 from being unrolled due to the vibration during transportation or handling prior to the actual use. The sheet 63 is pulled out from the top opening 64 after the staple magazine 60 is inserted in, for example, the attachment 7B illustrated in FIG. 50. Then, the rolled staple assembly 2 is released, and the leading edge of the staple assembly 2 can be fed by the feed roller 107. With this staple magazine 60, leading edge of the rolled staple assembly 2 is automatically pushed forward by pulling out the sheet 63. Accordingly, the staple magazine 60 can be used in a stapler apparatus which does not have a feeding unit.

A pair of control guides 66 are provided to the feeding port 65 for purposes of registering the leading edge of the rolled staple assembly 2 at a preselected position. The control guides 66 also prevent the leading edge of the rolled staple assembly 2 from rolling back.

[Seventh Embodiment]

Figure 55:
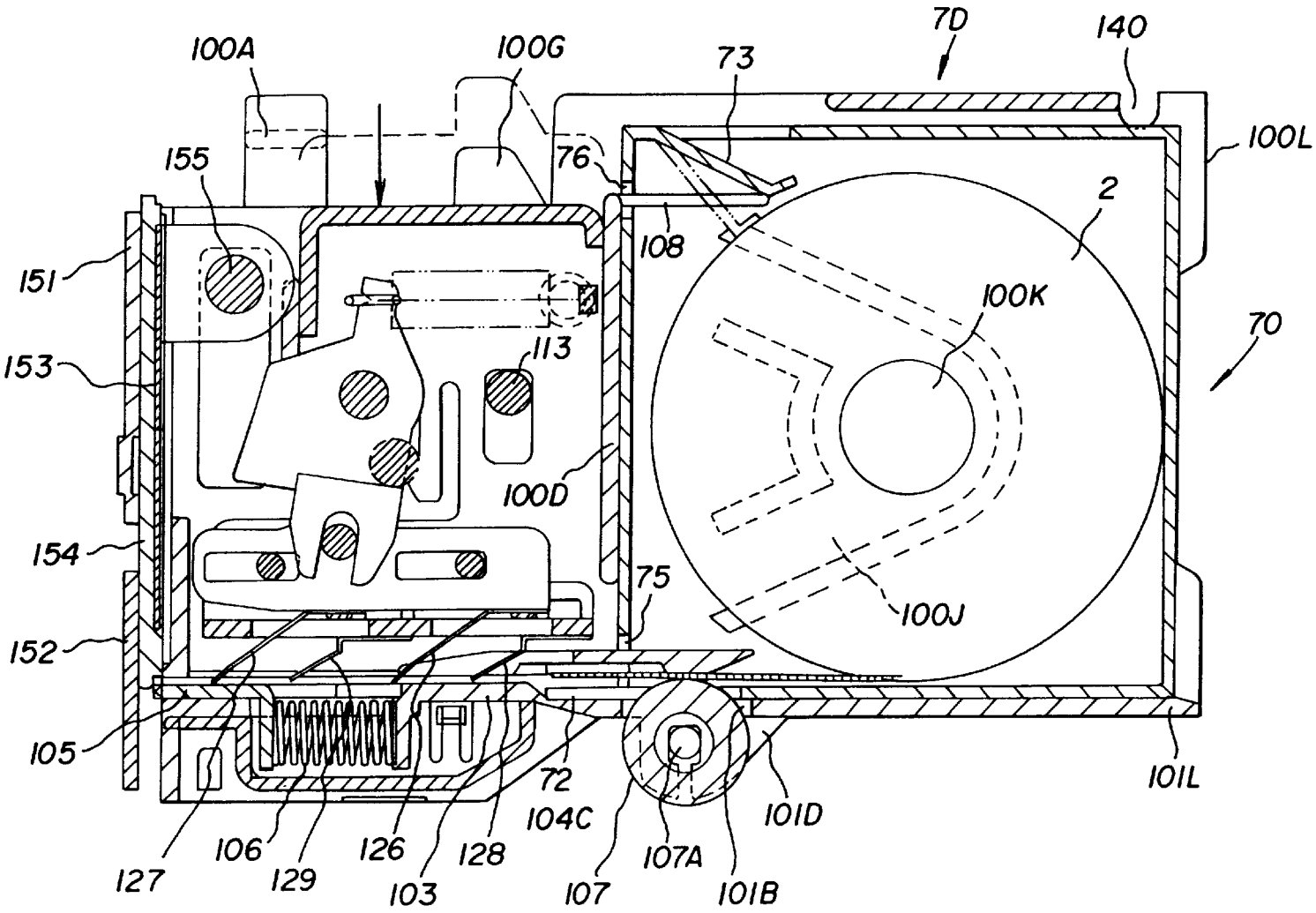
FIG. 55 illustrates how the staple magazine is received by the attachment according in the seventh embodiment of the invention.

As shown in FIG. 55, the attachment 7D according to the seventh embodiment is designed such that the rolled staple assembly 2 fixed in the staple magazine 70 shown in FIG. 56 is automatically released when the staple magazine 70 is inserted in the attachment 7D.

The attachment 7D has a control guide 104C and a releasing member 108 fixed to the guide 100D. In FIG. 55, the same elements as those shown in FIG. 50 are denoted by the same numerical references, and explanation for them will be omitted.

The staple magazine 70 is made of, for example, paper or a synthetic resin, and shaped into a box. A support hole 71 is formed in each of the side walls of the box 70H. An opening 72 is formed in the bottom wall of the box 70H in order to allow a feeding unit, such as a feed roller 107, to come into contact with the rolled staple assembly 2. The feeding unit receives a driving force for sending out the rolled staple assembly to a preselected position. A tongue 73 is fixed to the top wall of the box 70H in order to hold the rolled staple assembly in the box 70H. A feeding port 74, an opening 75 for receiving a control guide 104C, and an opening 76 for receiving a releaser 108 are formed in the front wall of the box 70H.

The tongue 73 extends from the top wall so that the tip of the tongue 73 presses the circumferential surface of the rolled staple assembly 2. The rolled staple assembly 2 is pressed against the inner walls of the box 70H, thereby preventing the rolled staple assembly 2 from being unrolled during transportation or handling prior to actual use.

Figure 56A:
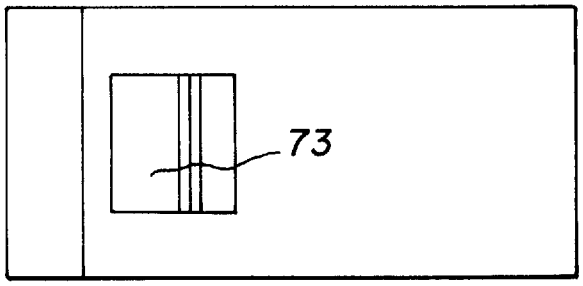
FIG. 56(A) is a top view.
Figure 56D:
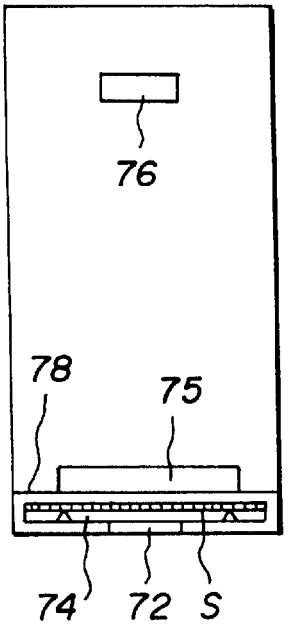
FIG. 56(D) is a front view.
Figure 56B:
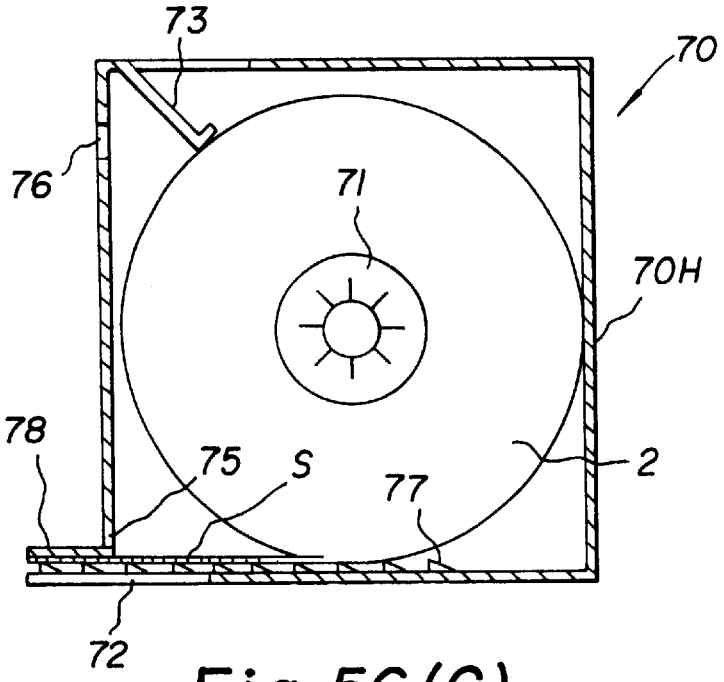
FIG. 56(B) is a cross-sectional view.
Figure 56C:
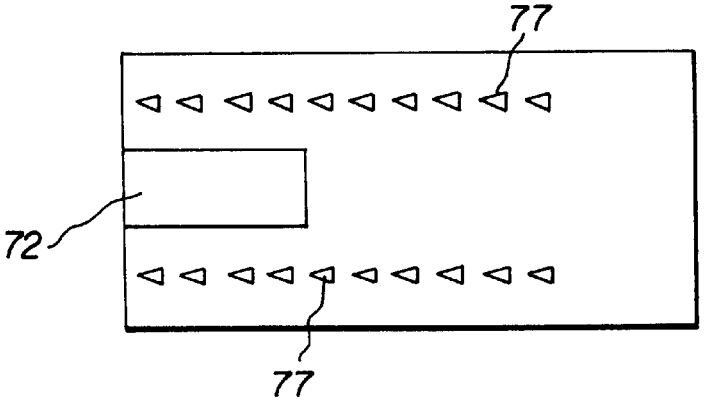
FIG. 56(C) is a bottom view.

A plurality of projections 77 are formed on the inner race of the bottom wall, as shown in FIG. 56(C) in order to prevent the roller staple assembly 2 from retracing.

A flat position-controller 78 is provided to the feeding port 74 for purposes of keeping the leading edge of the rolled staple assembly at a prescribed position, and of preventing the leading edge of the rolled staple assembly 2 from rolling up.

As the staple magazine 70 is inserted in the attachment 7D, the control guide 104C enters the staple magazine 70 through the opening 75, and press down the leading edge of the staple assembly 2 against the feed roller 107, as shown in FIG. 55. At the same time, the releaser 108 pushes up the tongue 73, and release the rolled staple assembly 2 in the box 70H. When the attachment 7D which carries the staple magazine 70 is attached to the stapler body 9, the leading edge of the rolled staple assembly 2 is automatically fed from the staple magazine 70 to a preselected position due to rotation of the feed roller 107.

[Eighth Embodiment]

Figure 64:
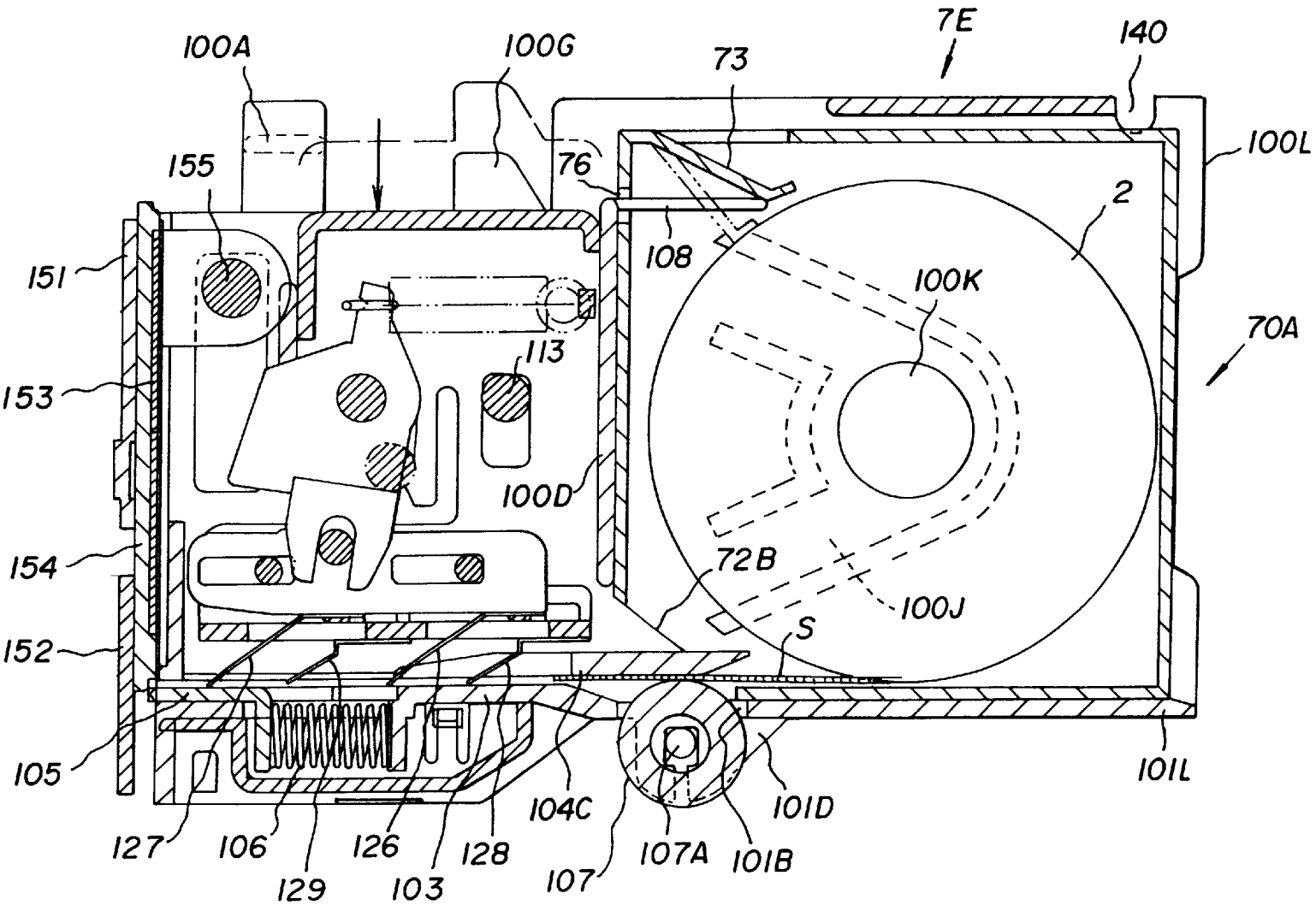
FIG. 64 illustrates how the staple magazine is received in the attachment according to the eighth embodiment of the invention.
Figure 65A:
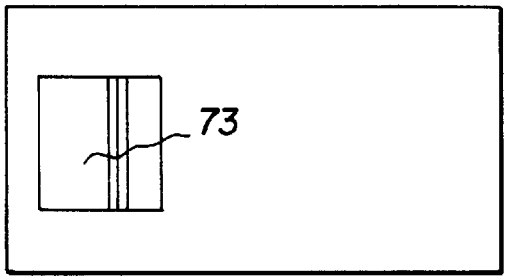
FIG. 65(A) is a top view.
Figure 65B:
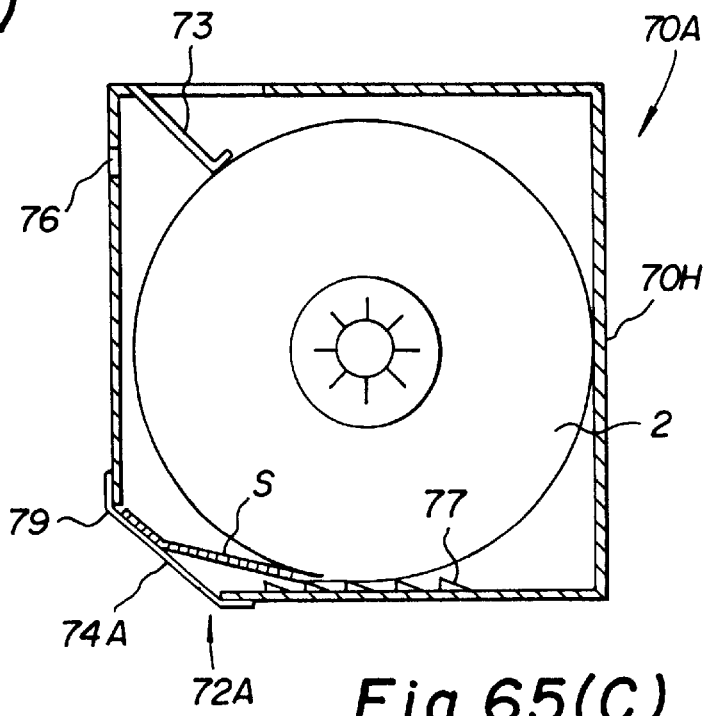
FIG. 65(B) is a cross-sectional view.
Figure 65D:
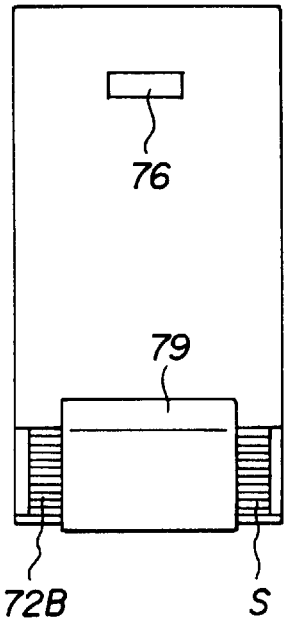
FIG. 65(D) is a front view.
Figure 65C:
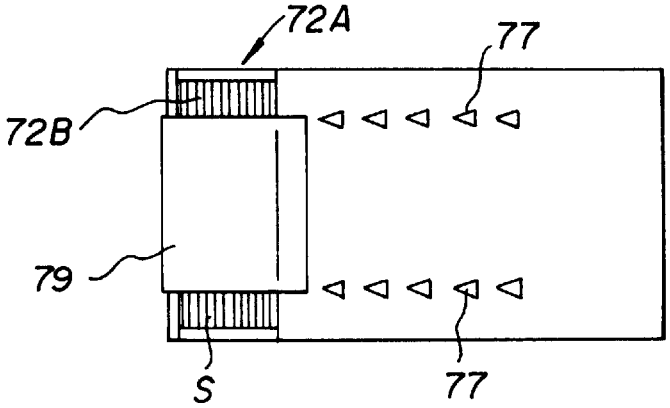
FIG. 65(C) is a bottom view.

In the seventh embodiment, the opening 72 for allowing the feed roller 107 to come into contact with the rolled staple assembly 2, and the opening 75 for receiving the control guide 104C are separately formed, as shown in FIG. 56. In the eighth embodiment, an oblique cut-off 72A is formed in the lower front corner of the box 70H, as shown in FIGS. 64 and 65. The oblique cut-off 72A functions both as a feeding port 74A and a receiving port 72B for receiving the control guide 104C. The leading portion of the rolled staple assembly 2 sticking out of the opening 72B of the oblique cut-off 72A is fixed to the box 70H by an adhesive tape 79, as shown in FIG. 65. The leading portion of the rolled staple assembly 2 comes into contact with the feed roller 107 on its rear face, and with the control guide 104C on its top face at the oblique cut-off 72A.

The tape 79, together with the tongue 73, prevents the rolled staple assembly 2 from being unrolled due to vibration during transportation. In FIGS. 64 and 65, the same elements as those shown in FIGS. 55 and 56 are denoted by the same numerical references.

Prior to an actual use, the tape 79 is peeled off, and the leading edge of the rolled staple assembly 2 is made flat. As the staple magazine 70A is inserted in the attachment 7E shown in FIG. 64. The control guide 104C enters the staple magazine 70A through the upper portion 72B of the oblique cut-off 72A, and presses the rolled staple assembly 2 against the feed roller 107. At the same time, the releaser 108 pushes the tongue 73 up to release the rolled staple assembly 2 in the box 70H. If the attachment 7E which carries the staple magazine 70A is attached to the stapler body 9, the leading edge of the rolled staple assembly 2 is sent out from the staple magazine 70A to a preselected position in the stapler apparatus.

[Ninth Embodiment]

In the first through eighth embodiments, the leading edge of the rolled staple assembly 2 is automatically sent out from the staple magazine in response to insertion of the staple magazine in the attachment, or insertion of the attachment which carries the staple magazine into the stapler body. However, the leading edge of the rolled staple assembly 2 may be manually sent out regardless of insertion of the staple magazine.

Figure 66:
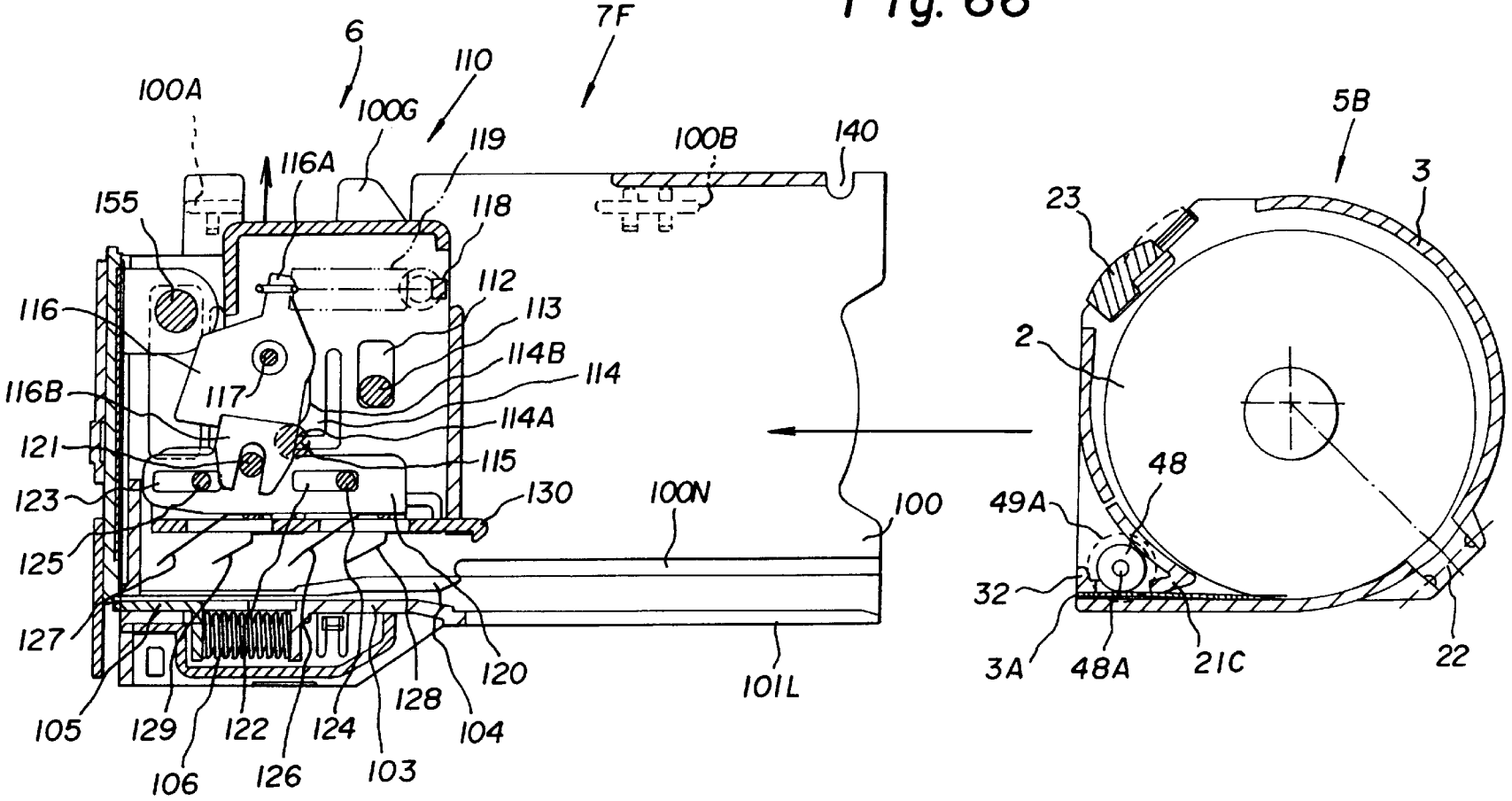
FIG. 66 illustrates how the staple magazine is inserted into the attachment according to the ninth embodiment of the invention.
Figure 67:
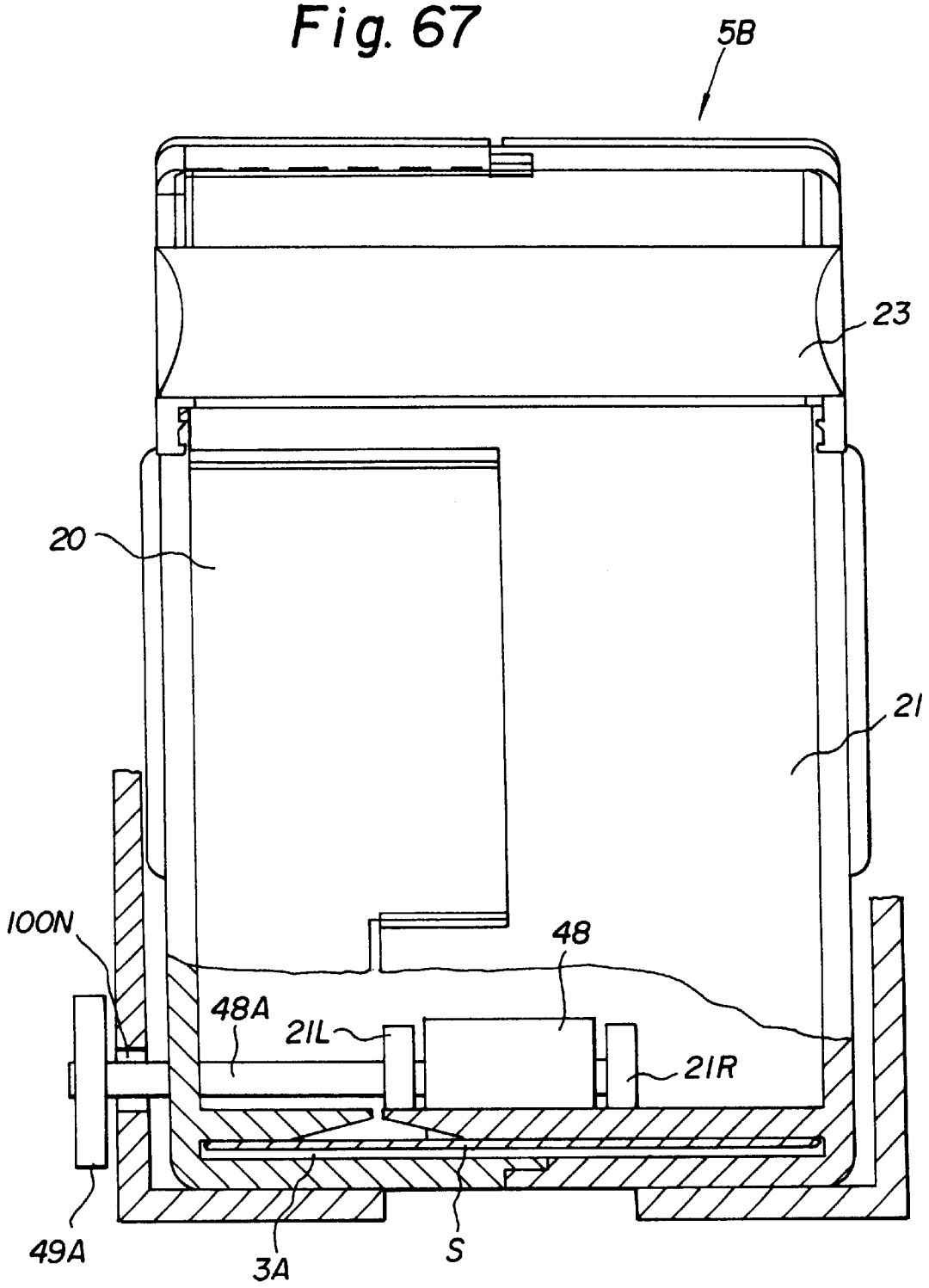
FIG. 67 is a front view of the staple magazine according to the ninth embodiment of the invention.
Figure 68A:
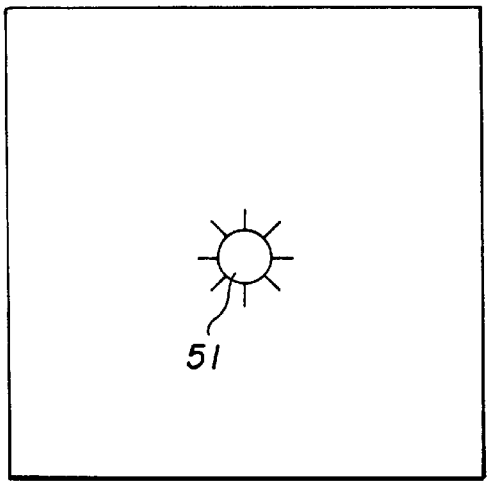
FIG. 68(A) is a top view.
Figure 68D:
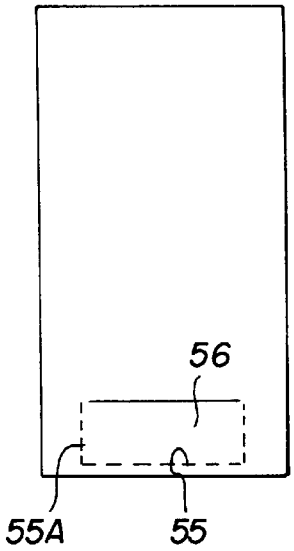
FIG. 68(D) is a front view.
Figure 68B:
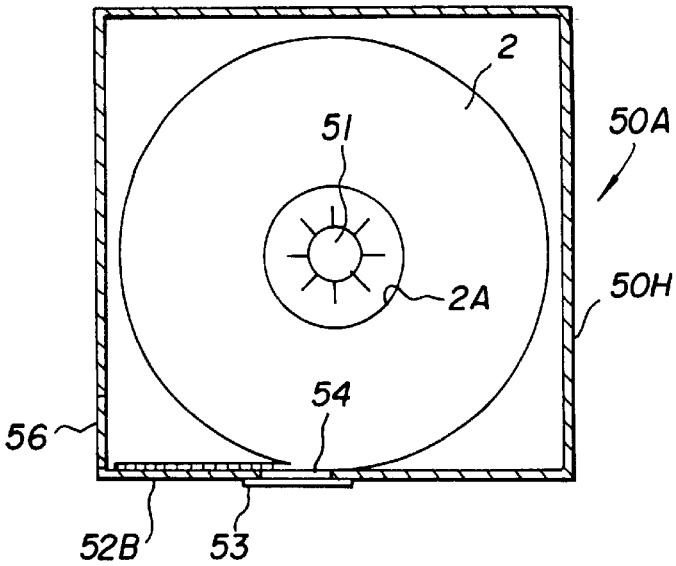
FIG. 68(B) is a cross-sectional view.
Figure 68C:
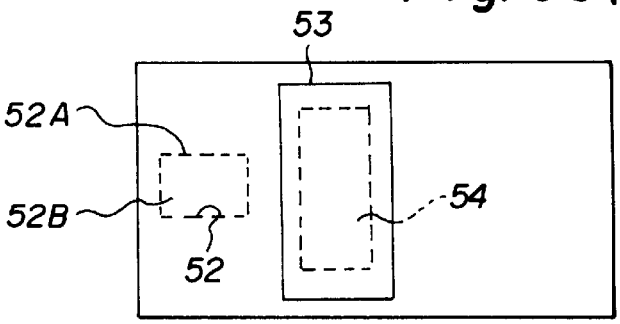
FIG. 68(C) is a bottom view.
Figure 69A:
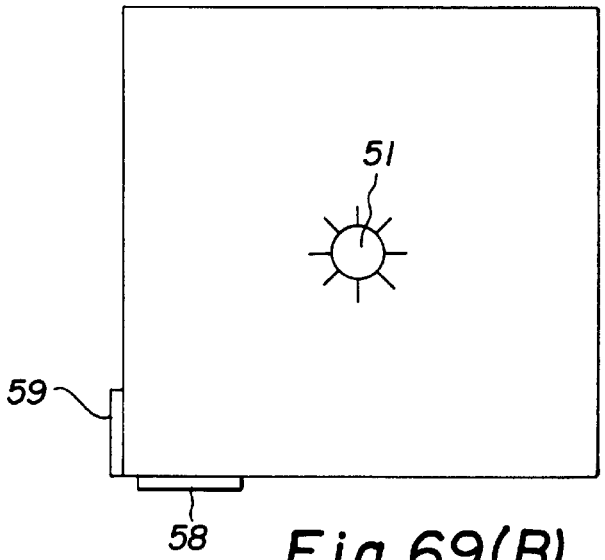
FIG. 69(A) is a top view.
Figure 69D:
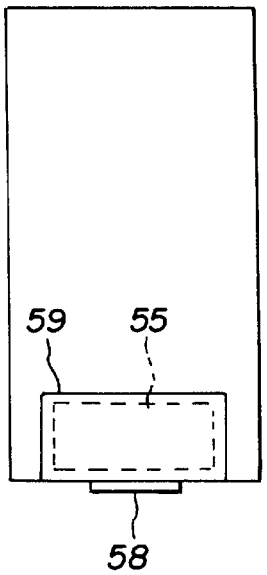
FIG. 69(D) is a front view.
Figure 69B:
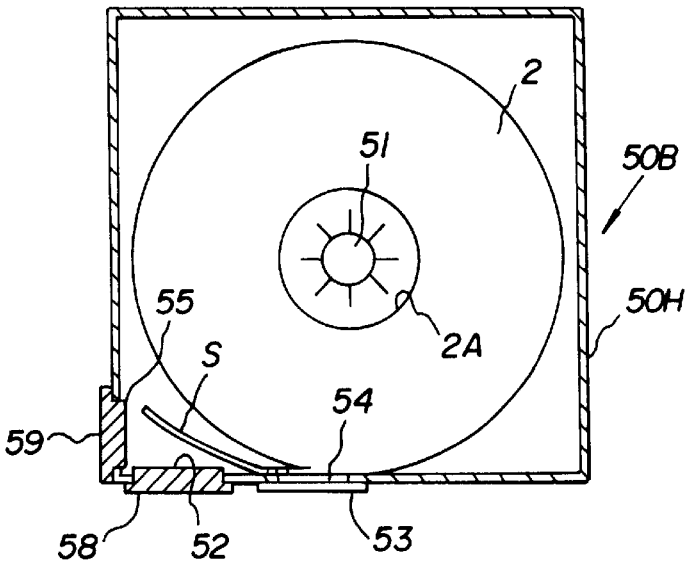
FIG. 69(B) is a cross-sectional view.
Figure 69C:
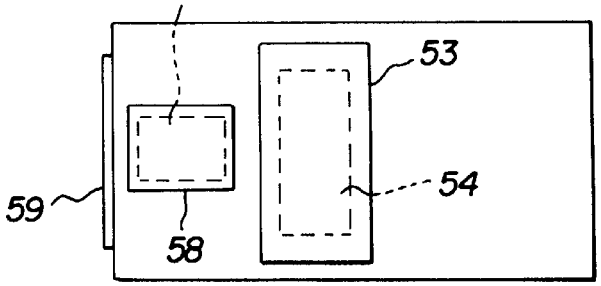
FIG. 69(C) is a bottom view.

As shown in FIGS. 66 and 67, the staple magazine 5B according to the ninth embodiment has a case 20, a paddle 48, and a handle 49 for allowing the user to manually drive the paddle 48. The handle 49A is provided outside the case 20. In order to receive this staple magazine 5B, slits 100N are formed in the side walls of the frame 100 of the attachment 7F. The rotational shaft 48A of the paddle 48 is inserted in the slits 100N.

When the staple magazine 5B is inserted in the attachment 7F, the handle 49A is rotated to drive the paddle 48, which causes the leading edge of the rolled staple assembly 2 to advance to the guides 103 and 104. If there is no previous staple assembly left on the bending plate 105 or a guide 103, the rolled staple assembly 2 is fed by rotating the handle 49 until the leading edge of the rolled staple assembly 2 strikes the former 154. If there are some old staples left on the bending plate 105, the leading edge of the new rolled staple assembly 2 is advanced by manipulating the handle 49 until it strikes the trailing edge of the old staple assembly.

In FIGS. 66 and 67, the same elements as those shown in FIGS. 48 and 49 are denoted by the same numerical references, and explanation for them will be omitted.

[Tenth Embodiment]

In the second embodiment, the staple magazine 50 has an opening 52 for allowing the feed roller 40 to come into contact with the rolled staple assembly 2, and an opening 55 for letting the leading edge of the rolled staple assembly 2 fed by the feed roller stick out from the staple magazine 40, as shown in FIG. 45. In the tenth embodiment, as shown in FIG. 68, a detachable area 52B is defined by perforation 52A. When the staple magazine 50 is actually used, the detachable area 52B is cut off along the perforation 52A to form an opening 52. The opening 55 for letting the leading edge of the rolled staple assembly 2 stick out of the staple magazine 50 may also be formed as perforated area. In this case, three sides of the opening 55 are perforated. Prior to actual use, the perforation 55A is detached, so that the area 56 is pivotable about the non-detached side. The area 56 can function as a presser 56 for pressing the leading portion of the rolled staple assembly 2.

In FIG. 68 , the same elements as those shown in FIG. 45 are denoted by the same numerical references.

[Eleventh Embodiment]

In this embodiment, the openings 52 and 55 are covered with removable covers 58 and 59, as shown in FIG. 69, instead of providing perforations as in the previous embodiment. The covers 58 and 59 are simply removed prior to actual use, and the staple magazine is inserted in the attachment.

In FIG. 69, the same elements as those shown in FIG. 45 are denoted by the same numerical references.

[Modification of Driving Means]

FIGS. 57 through 63 illustrate successive actions of a modification of the driving means.

With a conventional stapler apparatus, if a stapling action is taken without any paper set between the clincher cover 229 and the driver 153, a clinched staple remains in the center hole 231 of the clincher block 230. If the next staple is shot with the clinched staple left in the center hole 231, the next staple forcibly presses the remaining staple into the center hole 231, these two staples are jammed in the center hole 231. The stapling operation is interrupted, and in addition, it is difficult to remove the jammed staples from the center hole 231.

In order to solve this problem, the stapler apparatus according to the invention has clinch cams 218L and 218R, each of which has a tooth 218B for bending a staple, as well as a tooth 218C for removing an error staple from the center hole 231 of the clinch block 230. During one revolution of the clinch cams 218L and 218R, the clincher 233 move down and up twice. The first descent bends both ends of a staple, and the second descent kicks an error staple out of the center hole 231 if any. Accordingly, even if a staple is shot without any paper on the clincher cover 229, staple jam does not occur in the center hole 231.

Figure 57:
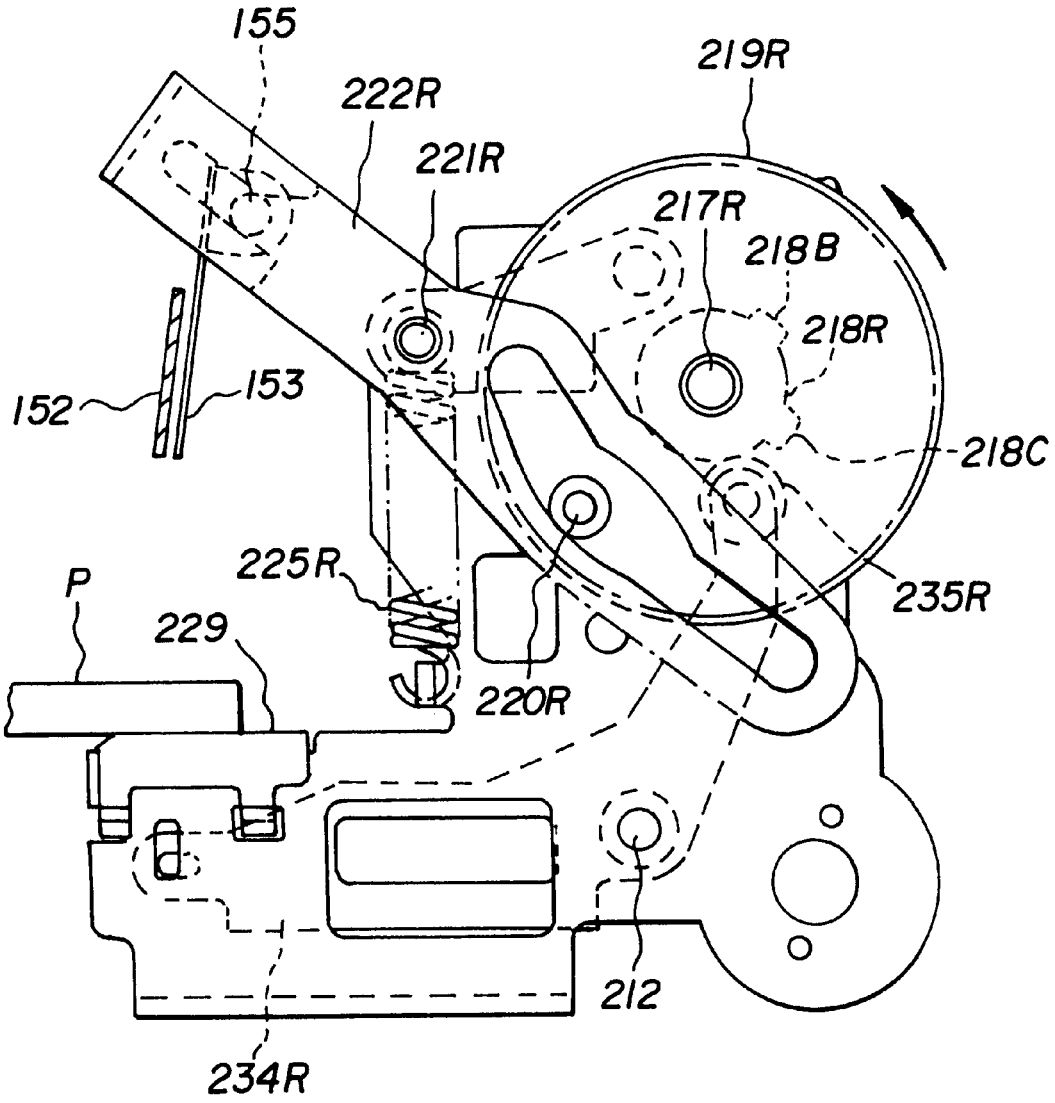
FIG. 57 illustrates a modification of the driving means, wherein the driver and the clinch lever are in the initial state.

FIG. 57 illustrates the initial state of the stapling action. The follower rollers 235L and 235R connected to the clinch levers 234L and 234R are in contact with the circumferential surfaces of the clinch cams 218L and 218R.

Figure 58:
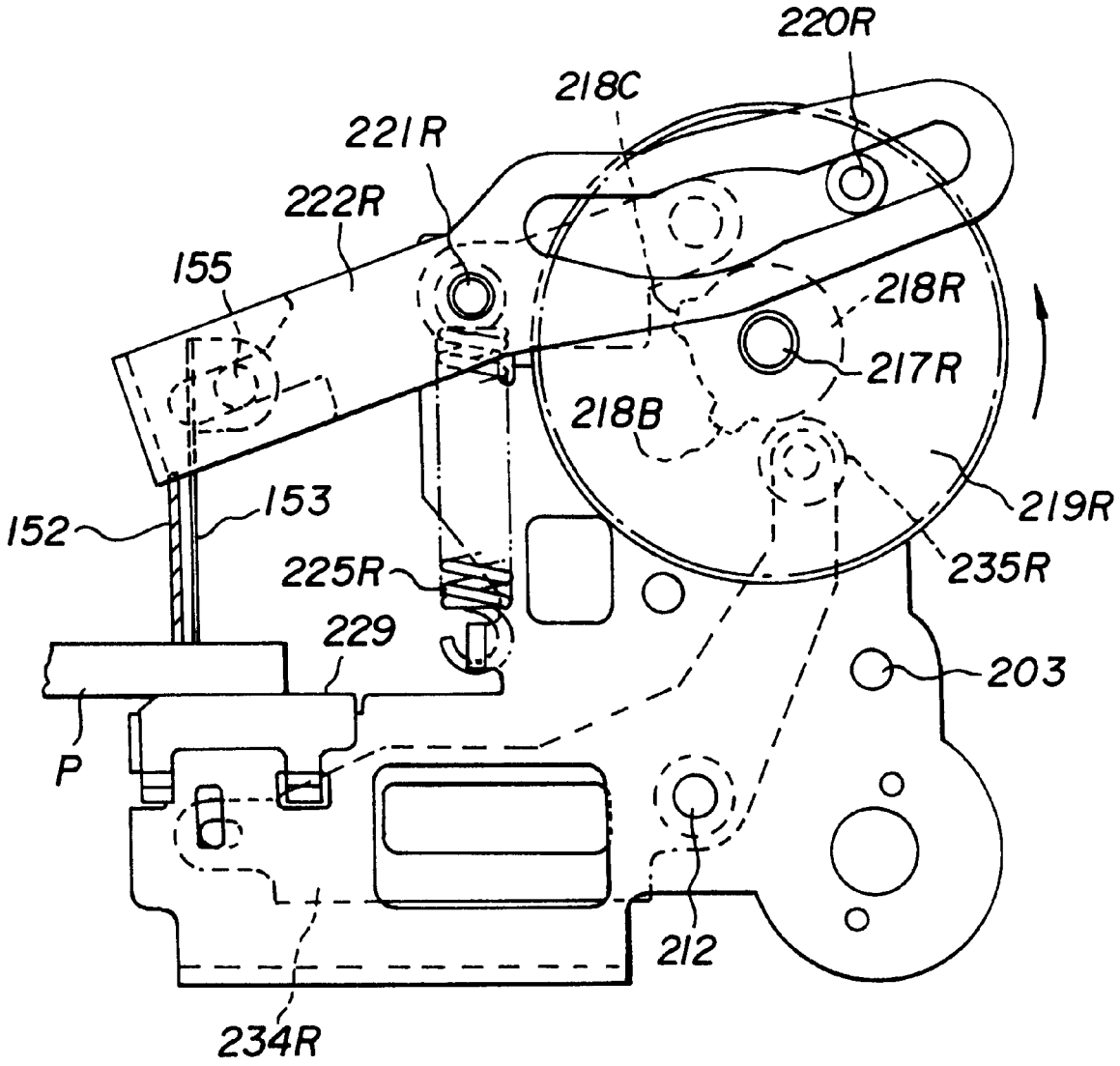
FIG. 58 illustrates the state, in which the driver shown in FIG. 57 has driven a staple into paper.
Figure 59:
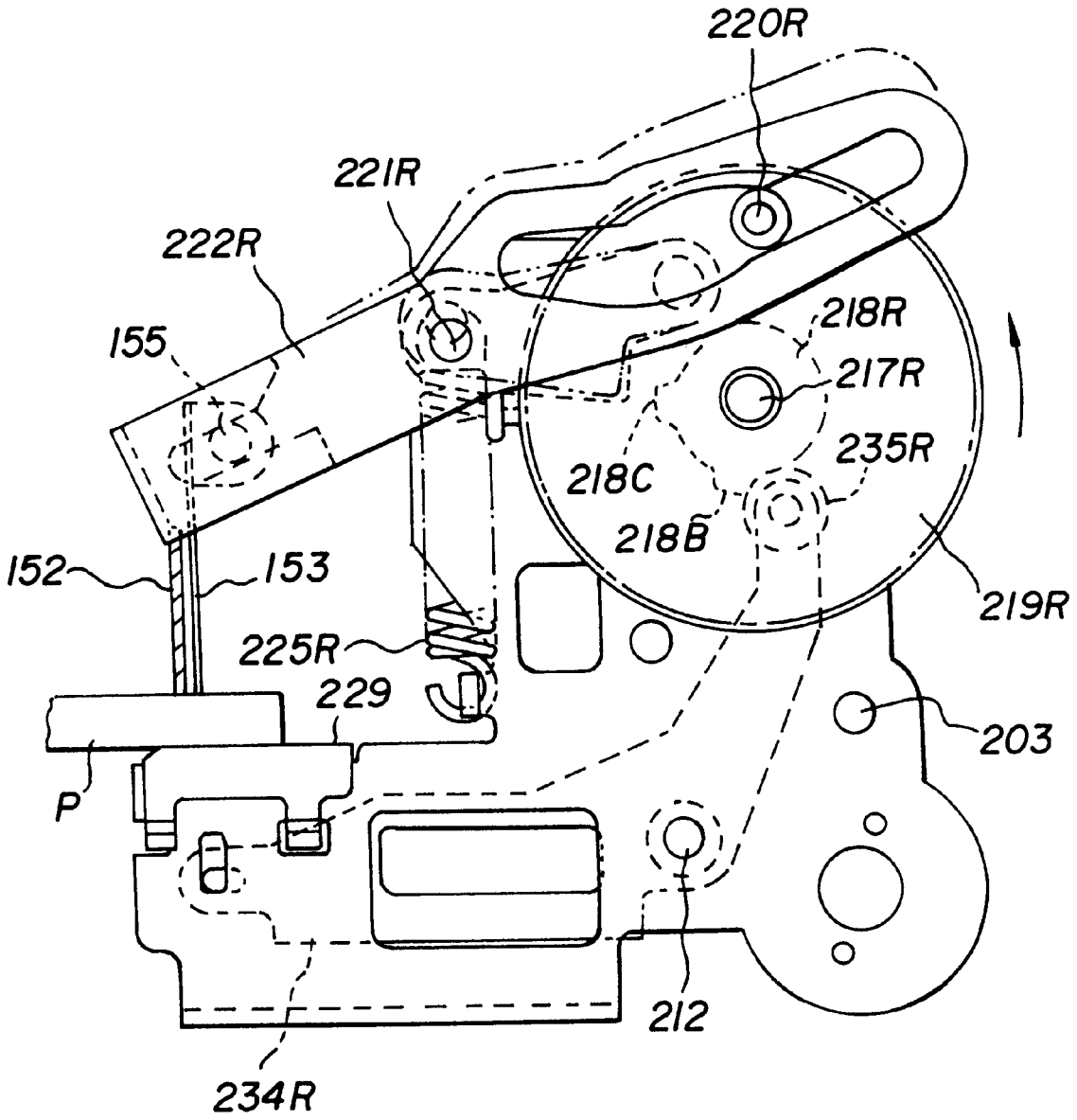
FIG. 59 illustrates the state, in which the moving fulcrum shown in FIG. 57 is being activated.

If the motor 210 shown in FIG. 2 rotates in a normal direction, the driving wheels 219L and 219R rotate, and the follower links 222L and 222R pivot downward about the shafts 221L and 221R, respectively, which cause the driver 153 to stick a staple into papers, as shown in FIG. 58.

The follower links 222L and 222R continuously pivot downward about the 221L and 221R. However, since the driver 153 does not go down any longer, the shafts 221L and 221R go up, thereby preventing the driving means 8 from being locked.

Figure 60:
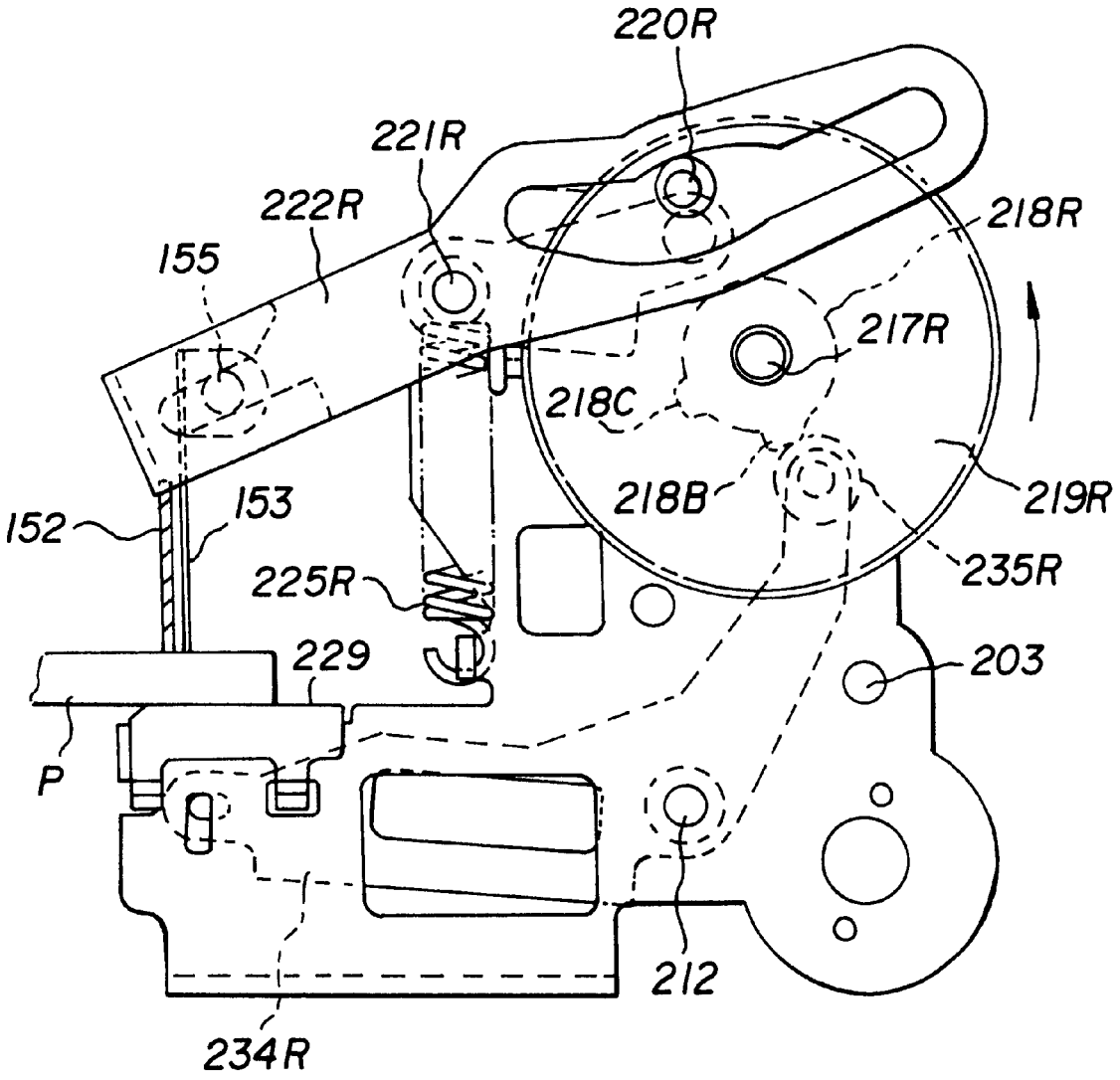
FIG. 60 illustrates the state, in which a clinching action starts in the modification shown in FIG. 57.
Figure 61:
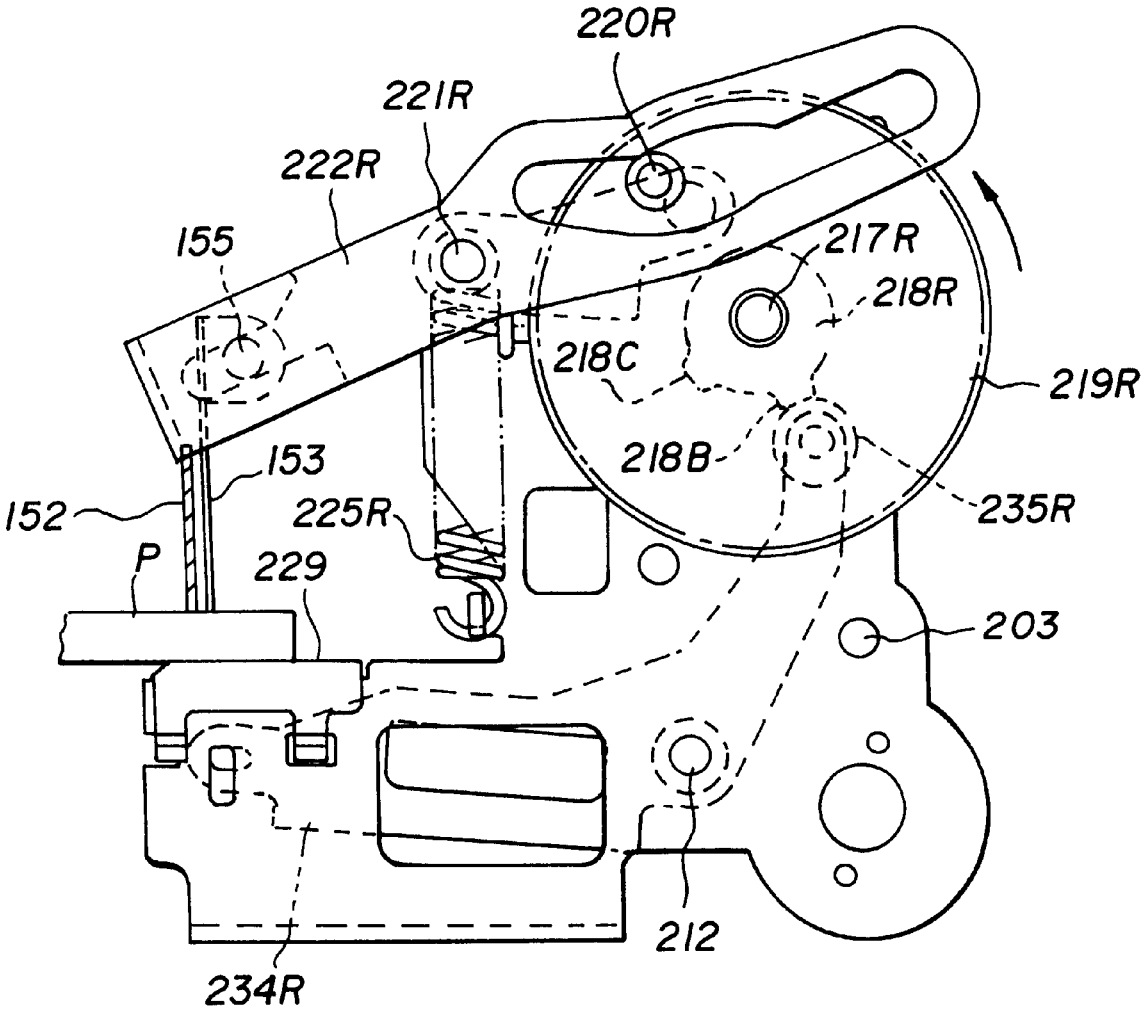
FIG. 61 illustrates the state, in which the clinching action has been completed in the modification shown in FIG. 57.

On the other hand, the clinch cams 218L and 218R also rotate in response to the rotation of the driving wheels 219L and 219R. The follower rollers 235L and 235R of the clinch levers 234L and 234R steps onto the swells 218B of the clinch cams 218L and 218R, as shown in FIGS. 60 and 61. Consequently, the clinch levers 234L and 234R rotate about the shaft 212, which causes the clincher 233 to move upward to push up the tips of the staple inward by almost 90 degrees. In this manner, the paper P is clinched.

Figure 62:
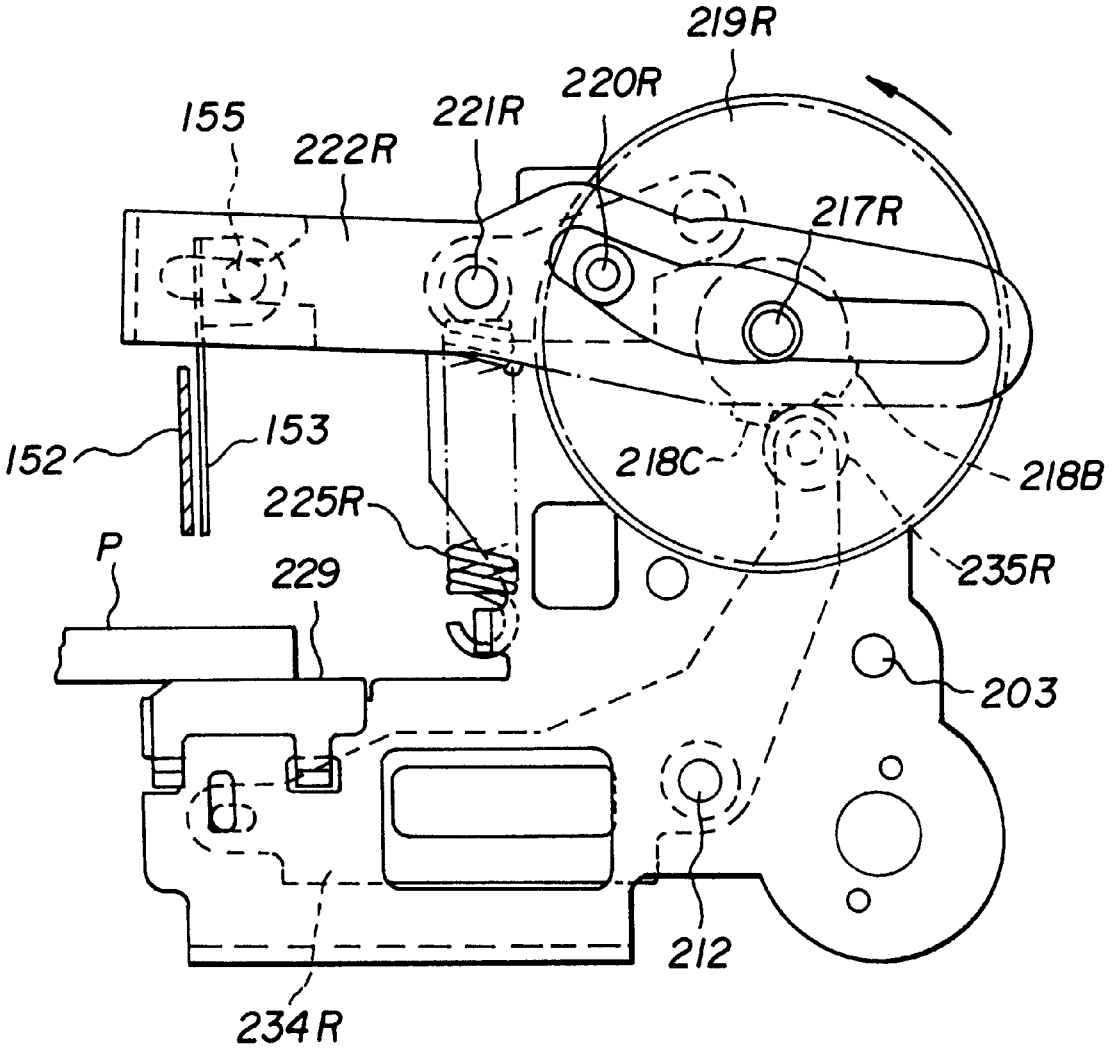
FIG. 62 illustrates the state, in which the driver and the clinch lever return to the initial position in the modification shown in FIG. 57.

After the clinching action has been completed, the driver 153 starts to move up, as shown in FIG. 62, and the clinch levers 234L and 234R retrace in response to the rotation of the clinch cams 218L and 218R, whereby the clincher 233 is lowered to the home position.

Figure 63:
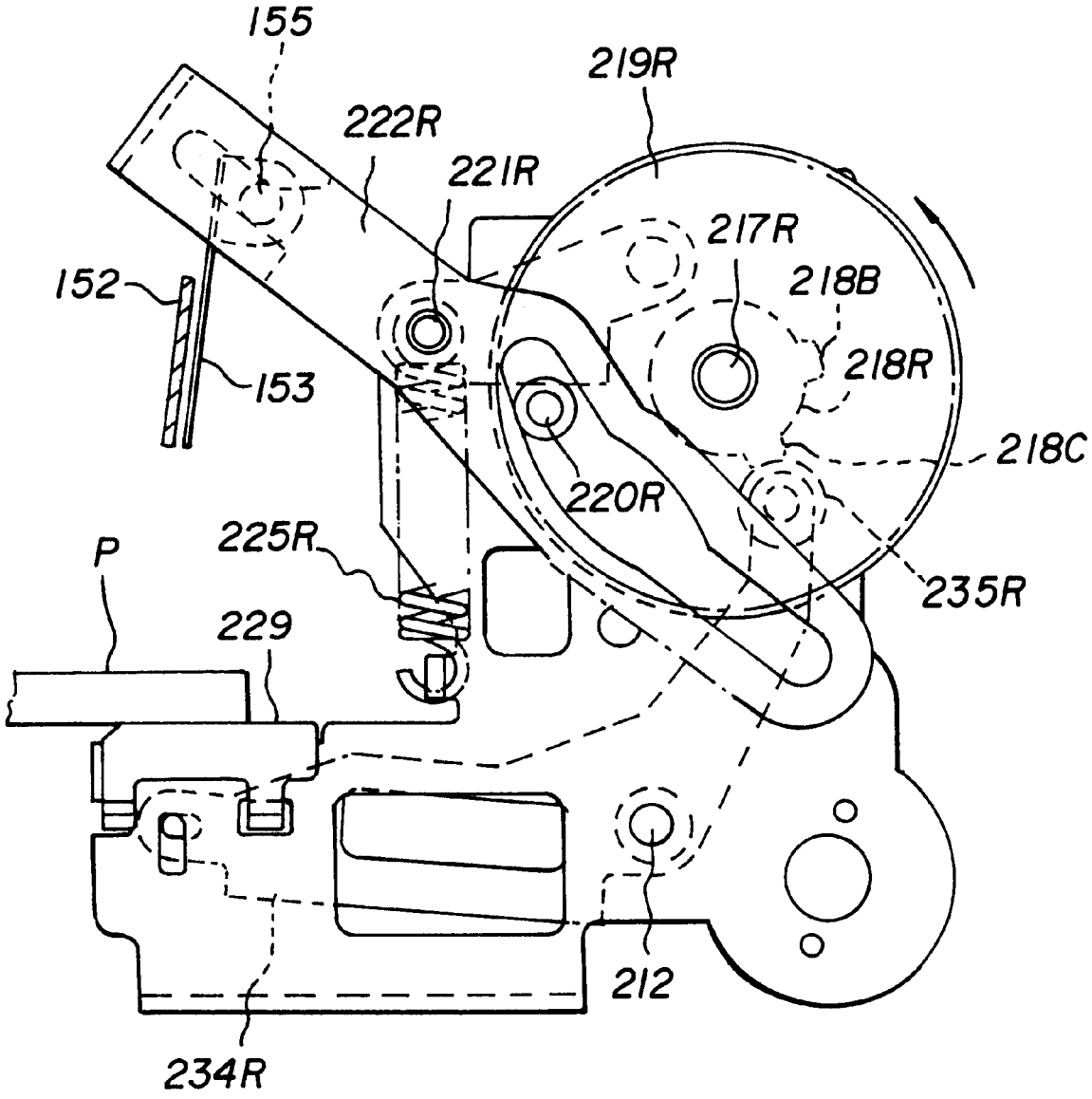
FIG. 63 illustrates the state, in which the clinching action is repeated in the modification shown in FIG. 57.

Then, as shown in FIG. 63, the follower rollers 235L and 235R step onto the swells 218C of the clinch cams 218L and 218R, respectively, and the clincher levers 234L and 234R again cause the clincher 233 to rise. This action forcibly removes an error staple if there is any left in the center hole 231.

If the sensor 242 detects one end 241A of the light-blocking member 241 during the movement to the home position, the motor 210 is stopped.

Although the present invention has been described in conjunction with the preferred embodiments, the invention is not limited to these examples. There are many modifications and substitutions without departing from the scope of the invention, which is defined by the appended claims.

What is claimed is:

1. A staple apparatus comprising:

a shooting unit for shooting a staple penetrating through a sheaf of paper;

a bender for bending both ends of the staple;

a receiver for receiving a detachable staple magazine in which a roller staple assembly is accommodated;

a roller that comes into contact with a portion of the roller staple assembly and feeds the leading edge of the roller staple assembly to a preselected position; and a roller guide that comes into contact with the roller when the staple magazine is mounted in the stapler apparatus and transfers a driving force to the roller.

2. The stapler apparatus according to claim 1, further comprising at least two pushing means for advancing the leading edge of the roller staple assembly to a stapling position, at which the shooting unit shoots the leading staple.

3. A stapler apparatus comprising a shooting unit for shooting a staple penetrating through a sheaf of paper;

a bender for bending both ends of the staple;

a receiver for receiving a detachable staple magazine in which a rolled staple assembly is accommodated, the detachable staple magazine having a roller for feeding the rolled staple assembly; and a roller guide that comes into contact with the roller when the staple magazine is mounted in the stapler apparatus and transfers a driving force to the roller.

4. The stapler apparatus according to claim 3, further comprising at least two pushing means for advancing the leading edge of the roller staple assembly to a stapling position, at which the shooting unit shoots the leading staple.

* * * * *